US007179586B2

(12) United States Patent
Hioki et al.

(10) Patent No.: US 7,179,586 B2
(45) Date of Patent: Feb. 20, 2007

(54) SILVER HALIDE PHOTOGRAPHIC LIGHT-SENSITIVE MATERIAL

(75) Inventors: Takanori Hioki, Kanagawa (JP); Katsumi Kobayashi, Kanagawa (JP); Ryo Suzuki, Kanagawa (JP); Yasutomo Kawanishi, Kanagawa (JP); Takeshi Suzumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/787,395

(22) Filed: Feb. 27, 2004

(65) Prior Publication Data

US 2004/0259043 A1 Dec. 23, 2004

(30) Foreign Application Priority Data

Feb. 28, 2003 (JP) ..... P.2003-053430
Dec. 12, 2003 (JP) ..... P.2003-414328

(51) Int. Cl.

| | |
|---|---|
| ***G03C 1/46*** | (2006.01) |
| ***G03C 1/005*** | (2006.01) |
| ***G03C 1/494*** | (2006.01) |
| ***G03C 1/06*** | (2006.01) |

(52) U.S. Cl. ..... 430/502; 430/503; 430/570; 430/567; 430/600; 430/603

(58) Field of Classification Search ..... 430/502, 430/503, 567, 570, 600, 603
See application file for complete search history.

(56) References Cited

U.S. PATENT DOCUMENTS

| | | | | |
|---|---|---|---|---|
| 5,494,789 | A | 2/1996 | Daubendiek et al. | |
| 6,143,486 | A * | 11/2000 | Parton et al. | 430/574 |
| 6,165,703 | A * | 12/2000 | Parton et al. | 430/572 |
| 6,331,385 | B1 * | 12/2001 | Deaton et al. | 430/572 |
| 6,361,932 | B1 * | 3/2002 | Parton et al. | 430/572 |
| 2003/0228549 | A1 * | 12/2003 | Hioki et al. | 430/581 |

FOREIGN PATENT DOCUMENTS

| | | |
|---|---|---|
| EP | 0 985 965 A1 | 3/2000 |
| JP | 4-109240 A | 4/1992 |
| JP | 10-171058 A | 6/1998 |
| JP | 10-239789 A | 9/1998 |

* cited by examiner

*Primary Examiner*—Geraldina Visconti
(74) *Attorney, Agent, or Firm*—Sughrue Mion, PLLC

(57) ABSTRACT

A high-sensitivity silver halide photographic light-sensitive material is provided, which is a silver halide photographic light-sensitive material, in which a dye chromophore is adsorbed in multiple layers on the surface of a silver halide grain and at least one of the dye chromophore-containing compounds satisfies: a specific condition relating to the aggregation property, hydrophilicity/hydrophobicity or J-aggregation property; or a specific structure.

12 Claims, No Drawings

SILVER HALIDE PHOTOGRAPHIC LIGHT-SENSITIVE MATERIAL

FIELD OF THE INVENTION

The present invention relates to a high-sensitivity silver halide photographic light-sensitive material, more specifically, the present invention related to a silver halide photographic light-sensitive material spectrally sensitized to high sensitivity by a dye.

BACKGROUND OF THE INVENTION

A great deal of effort has heretofore been made for attaining higher sensitivity of silver halide photographic light-sensitive materials. In a silver halide photographic emulsion, a sensitizing dye adsorbed to the surface of a silver halide grain absorbs light entered into a light-sensitive material and transmits the light energy to the silver halide grain, whereby light sensitivity can be obtained. Accordingly, in the spectral sensitization of silver halide, it is considered that the light energy transmitted to silver halide can be increased by increasing the light absorption factor per the unit grain surface area of a silver halide grain and thereby the spectral sensitivity can be elevated. The light absorption factor on the surface of a silver halide grain may be improved by increasing the amount of a spectral sensitizing dye adsorbed per the unit grain surface area.

However, the amount of a sensitizing dye adsorbed to the surface of a silver halide grain is limited and the dye chromophore cannot be adsorbed in excess of a single layer saturation adsorption (namely, one layer adsorption). Therefore, individual silver halide grains currently have a low absorption factor in terms of the quantum of incident light in the spectral sensitization region.

To solve these problems, many methods for attaining larger adsorption of a sensitizing dye than one layer absorption have; been proposed. For example, JP-A-2002-23294 (the term "JP-A" as used herein means an "unexamined published Japanese patent application") describes related documents and patents in the paragraph of Background Art. Particularly, attempts are being recently made to combine a specific cationic dye and a specific anionic dye so as to attain high sensitivity by multilayer adsorption (see, for example, JP-A-10-239789, JP-A-10-171058 and EP-A-0985965).

However, the sensitivity level in these methods is not yet satisfied and the silver halide photographic light-sensitive material is demanded to have still higher sensitivity.

When a tabular silver halide grain having a high aspect ratio (hereinafter called a tabular grain) is used, by virtue of its large ratio of surface area to volume, a large amount of a sensitizing dye can be adsorbed to the surface and a higher color sensitization sensitivity can be obtained as the photographic property (see, for example, U.S. Pat. No. 5,494,789). The aspect ratio as used herein means a ratio of diameter to thickness of a tabular grain. The diameter of a tabular grain indicates a diameter of a circle having an area equal to the projected area of a grain when an emulsion is observed by a microscope or an electron microscope. The thickness is a distance between two parallel planes constituting a tabular grain. In this way, the tabular grain is advantageous for obtaining high color sensitization sensitivity. For attaining high sensitivity, selenium sensitization of a silver halide emulsion is also useful and many selenium compounds are known (see, for example, JP-A-4-109240). However, the sensitivity level in these methods is not yet satisfied and the silver halide photographic light-sensitive material is demanded to have still higher sensitivity.

SUMMARY OF THE INVENTION

An object of the present invention is to provide a high-sensitivity silver halide photographic light-sensitive material.

As a result of intensive investigations, it has been found that the object of the present invention can be attained by the followings.

1. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is Dye X satisfying Condition 1 represented by the following formula (1):

$$\{\mathrm{Agg}(\mathrm{Dye}\ X)/\mathrm{Agg}(\mathrm{Dye}\ 1)\} \geqq 1.1$$

wherein Agg(Dye 1) represents an aggregation property of the following Dye 1 and Agg(Dye X) represents an aggregation property of Dye X:

Dye 1:

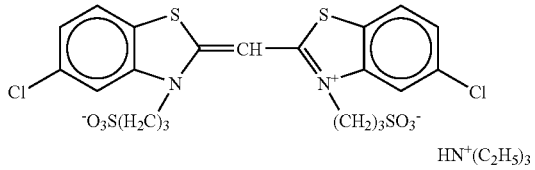

2. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is Dye X satisfying Condition 2 represented by the following formula (2):

$$\{\log P(\mathrm{Dye}\ X)/\log P(\mathrm{Dye}\ 1)\} \geqq 1.1$$

wherein log P(Dye 1) represents a hydrophilicity/hydrophobicity of the following Dye 1 and log P(Dye X) represents a hydrophilicity/hydrophobicity of Dye X:

Dye 1:

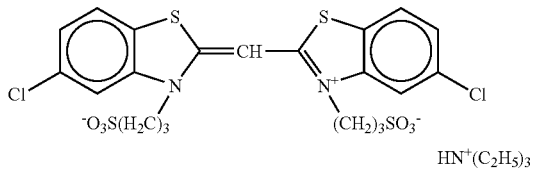

3. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is Dye X satisfying Condition 3 represented by the following formula (3):

$$\{J\text{-Agg(Dye } X)/J\text{-Agg(Dye 1)}\} \geqq 1.1$$

wherein J-Agg(Dye 1) represents a J-aggregation property of the following Dye 1 and J-Agg(Dye X) represents a J-aggregation property of Dye X:

Dye 1:

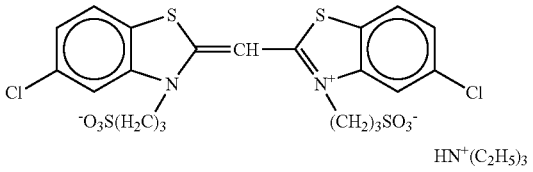

4. The silver halide photographic light-sensitive material as described in any one of the items 1 to 3, wherein the Conditions 1, 2 and 3 is represented by {Agg(Dye X)/Agg (Dye 1)}≧2, {log P(Dye X)/log P(Dye 1)}≧5 and {J-Agg (Dye X)/J-Agg(Dye 1)}≧5, respectively.

5. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is Dye X satisfying all of the above-mentioned Conditions 1 to 3.

6. A silver halide photographic light-sensitive material comprising a silver halide photographic emulsion containing a silver halide grain, wherein the silver halide grain includes a dye chromophore adsorbed in multiple layers on the surface of the silver halide grain, and at least one of compounds containing the dye chromophore is Dye X satisfying all of the above-mentioned Conditions 1 to 3 as described in the item 4.

7. The silver halide photographic light-sensitive material as described in any one of the items 1 to 6, wherein the compound Dye X described in any one of the items 1 to 6 is present in the second or upper layer.

8. The silver halide photographic light-sensitive material as described in any one of the items 1 to 7, wherein the compound containing a dye chromophore described in the items 1 to 7 and another dye compound are bound to each other by an attractive force except for covalent bonding.

9. The silver halide photographic light-sensitive material as described in any one of the items 1 to 8, which contains a compound comprising a plurality of dye chromophores.

10. The silver halide photographic light-sensitive material as described in any one of the items 1 to 9, which contains a dye having a divalent or greater valent electric charge.

11. The silver halide photographic light-sensitive material as described in 1 to 10, wherein the compound Dye X satisfying the Condition 1, 2 or 3 described in any one of the items 1 to 10 has an electric charge opposite to that of another dye compound.

12. The silver halide photographic light-sensitive material as described in any one of the items 1 to 11, wherein the compound Dye X satisfying the Condition 1, 2 or 3 described in the items 1 to 11 has an aromatic group:

13. The silver halide photographic light-sensitive material as described in the item 8, wherein the another dye compound has an aromatic group.

14. The silver halide photographic light-sensitive material as described in any one of the items 1 to 13, which contains a dye having a hydrogen bond group.

15. The silver halide photographic light-sensitive material as described in any one of the items 1 to 14, which contains a silver halide grain having a light absorption intensity of 60 or more when a spectral absorption maximum wavelength is less than 500 nm, or having a light absorption intensity of 100 or more when a spectral absorption maximum wavelength is 500 nm or more.

16. The silver halide photographic light-sensitive material as described in any one of the items 1 to 15, wherein, assuming that the maximum value of the spectral absorption factor of a silver halide grain by a sensitizing dye is Amax, the distance between the shortest wavelength showing 50% of Amax and the longest wavelength showing 50% of Amax is 120 nm or less.

17. The silver halide photographic light-sensitive material as described in any one of the items 1 to 15, wherein, assuming that the maximum value of the spectral sensitivity of a silver halide grain by a sensitizing dye is Smax, the distance between the shortest wavelength showing 50% of Smax and the longest wavelength showing 50% of Smax is 120 nm. or less.

18. The silver halide photographic light-sensitive material as described in any one of the items 1 to 17, wherein, assuming that the maximum value of the spectral absorption factor of a silver halide grain by a dye chromophore in the first layer is A1max, the maximum value of the spectral absorption factor by a dye chromophore in the second or upper layer is A2max, the maximum value of the spectral sensitivity of a silver halide grain by a dye chromophore in the first layer is S1max and the maximum value of the spectral sensitivity by a dye chromophore in the second or upper layer is S2max, A1max and A2max, or S1max and S2max are in the range from 400 to 500 nm, from 500 to 600 nm, from 600 to 700 nm or from 700 to 1,000 nm.

19. The silver halide photographic light-sensitive material as described in any one of the items 1 to 18, wherein the longest wavelength showing a spectral absorption factor of 50% of Amax or Smax is from 460 to 510 nm, from 560 to 610 nm or from 640 to 730 nm.

20. The silver halide photographic light-sensitive material as described in any one of the items 1 to 19, wherein the excitation energy of a dye chromophore in the second or upper layer transfers to a dye chromophore in the first layer at an efficiency of 10% or more.

21. The silver halide photographic light-sensitive material as described in any one of the items 1 to 20, wherein the dye chromophore in the first layer and the dye chromophore in the second or upper layer both exhibit J-band absorption.

22. The silver halide photographic light-sensitive material as described in any one of the items 1 to 21, wherein in the silver halide photographic emulsion, the tabular silver halide grains having an aspect ratio of 2 or more occupy 50% (area) or more of all silver halide grains in the emulsion.

23. The silver halide photographic light-sensitive material as described in any one of the items 1 to 22, wherein the silver halide photographic emulsion is subjected to selenium sensitization.

24. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is a dye represented by the following formula (E):

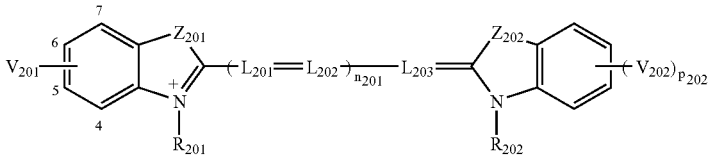

$M_{201}m_{201}$ wherein $Z_{201}$ and $Z_{202}$ each represents an oxygen atom, a sulfur atom, a selenium atom or a nitrogen atom, $V_{201}$ represents a 5-membered aromatic heterocyclic ring, $V_{202}$ represents a substituent, $p_{202}$ represents 0, 1, 2, 3 or 4, $R_{201}$ and $R_{202}$ each represents an alkyl group, an aryl group or a heterocyclic group, $L_{201}$, $L_{202}$ and $L_{203}$ each represents a methine group, $n_{201}$ represents 0 or 1, $M_{201}$ represents an electric charge balancing counter ion; and $m_{201}$ represents a number of 0 to more necessary for neutralizing the electric charge of the molecule.

25. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is a dye represented by the following formula (F):

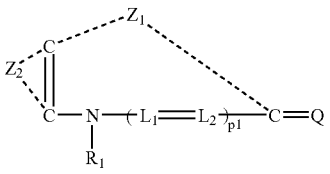

M1m1 wherein $Z_1$ represents an atomic group necessary for forming a nitorgen-containing 5- or 6-membered heterocyclic ring, $Z_2$ represents an atomic group necessary for forming aromatic ring or aliphatic ring, and necessary for forming a 4 membered or more multi-cyclic condensed ring together with the nitorgen-containing 5- or 6-membered heterocyclic ring formed by $Z_1$, Q represents a group necessary for forming a methine dye as the compound represented by the formula (F) forms a methine dye, $R_1$ represents an alkyl group, an aryl group or a heterocyclic group, each of which is substitued by one of an acidic group and a group having a positive electric charge, $L_1$ and $L_2$ each represents a methine group, p1 represents 0 or 1, $M_1$ represents an electric charge balancing counter ion, and $m_1$ represents a number of 0 to more, necessary for neutralizing the electric charge of the molecule.

26. The silver halide photographic light-sensitive material as described in the item 25, the dye represented by the formula (F) is represented by the following formula (F1):

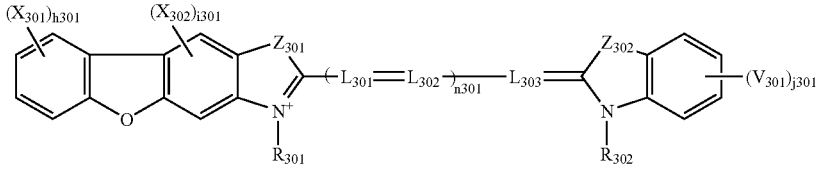

$M_{301}m_{301}$ wherein $Z_{301}$ and $Z_{302}$ each represents an oxygen atom, a sulfur atom, a selenium atom or a nitrogen atom, $X_{301}$ and $X_{302}$ each represents a substituent of the dibenzofuran ring, $V_{301}$ represents a substituent, $R_{301}$ represents an alkyl group, an aryl group or a heterocyclic group, each of which is substitued by one of an acidic group and a group having a positive electric charge is substitued, $L_{301}$, $L_{302}$ and $L_{303}$ each represents a methine group, n301 represents 0 or 1, h301 represents 0, 1, 2, 3 or 4, i301 represents 0, 1 or 2, j301 represents 0, 1, 2, 3 or 4, $M_{301}$ represents an electric charge balancing counter ion, and $m_{301}$, represents a number of 0 to more, necessary for neutralizing the electric charge of the molecule.

27. A silver halide photographic light-sensitive material comprising a silver halide photographic emulsion containing a silver halide grain, wherein the silver halide photographic emulsion includes a dye chromophore adsorbed in multiple layers on the surface of the silver halide grain, and at least one of compounds containing the dye chromophore is a dye represented by the following formula (G):

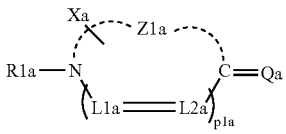

$M1_am1_a$ wherein Z1a represents an atomic group necessary for forming a nitorgen-containing 5- or 6-membered heterocyclic ring, which may be condensed with a ring, Xa represents a substituted or unsubstituted benzofuran ring, L1a and L2a each represents a methine group, p1a represents 0 or 1, Qa represents a group necessary for forming a methine dye as the compound represented by the formula (G), R1a represents an alkyl group, an aryl group or a heterocyclic group, M1a represents an electric charge balancing counter ion, and m1a represents a number of 0 to more, necessary for neutralizing the electric charge of the molecule.

DETAILED DESCRIPTION OF THE INVENTION

The present invention is described in detail below.

In the present invention, when a specific site is called "a group", this means that the site itself may not be substituted or may be substituted by one or more (up to a possible maximum number) substituents. For example, "an alkyl group" means a substituted or unsubstituted alkyl group. The substituent which can be used in the compound for use in the present invention may be any substituent irrespective of the presence or absence of substitution.

Assuming that this substituent is W, the substituent represented by W may be any substituent and is not particularly limited, however, examples thereof include a halogen atom, an alkyl group (including a cycloalkyl group, a bicycloalkyl group and a tricycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phophinyl group, a phosphinyloxy group, a phosphinylamino group, a phosphono group, a silyl group, a hydrazino group, a ureido group, a boronic acid group (—$B(OH)_2$), a phosphato group (—$OPO(OH)_2$), a sulfato group (—$OSO_3H$) and other known substituents.

More specifically, W represents a halogen atom (e.g., fluorine, chlorine, bromine, iodine), an alkyl group [a linear, branched or cyclic, substituted or unsubstituted alkyl group; the alkyl group includes an alkyl group (preferably an alkyl group having from 1 to 30 carbon atoms, e.g., methyl, ethyl, n-propyl, isopropyl, tert-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecyl-cyclohexyl), a bicycloalkyl group (preferably a substituted or unsubstituted bicycloalkyl group having from 5 to 30 carbon atoms, namely, a monovalent group resultant of removing one hydrogen atom from a bicycloalkane having from 5 to 30 carbon atoms, e.g., bicyclo[1,2,2]heptan-2-yl, bicyclo[2,2,2]octan-3-yl), and a tricyclo structure having many cyclic structures; the alkyl group in the substituent described below (for example, an alkyl group in an alkylthio group) means an alkyl group having such a concept and also includes an alkenyl group and an alkynyl group], an alkenyl group [a linear, branched or cyclic, substituted or unsubstituted alkenyl group; the alkenyl group includes an alkenyl group (preferably a substituted or unsubstituted alkenyl group having from 2 to 30 carbon atoms, e.g., vinyl, allyl, prenyl, geranyl, oreyl), a cycloalkenyl group (preferably a substituted or unsubstituted cycloalkenyl group having from 3 to 30 carbon atoms, namely, a monovalent group resultant of removing one hydrogen atom form a cycloalkane having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, namely, a monovalent group resultant of removing one hydrogen atom from a bicycloalkane having one double bond, e.g., bicyclo[2,2,19 hept-2-en-1-yl, bicyclo[2,2,2]oct-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group resultant of removing one hydrogen atom from a 5- or 6-membered substituted or unsubstituted, aromatic or non-aromatic heterocyclic compound, more preferably a 5- or 6-membered aromaheterocyclic group having from 3 to 30 carbon atoms, e.g., 2-furyl, 2-thienyl, 2-pyrimidinyl, 2-benzothiazolyl; the heterocyclic group may also be a cationic heterocyclic group such as 1-methyl-2-pyridinio and 1-methyl-2-quinolinio), a cyano group, a hydroxyl group, a nitro group, a carboxyl group, an alkoxy group (preferably a substituted or unsubstituted alkoxy group having from 1 to 30 carbon atoms, e.g., methoxy, ethoxy, isopropoxy, tert-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-tert-butylphenoxy, 3-nitrophenoxy, 2-tetradecanoylaminophenoxy), a silyloxy group (preferably a silyloxy group having from 3 to 20 carbon atoms, e.g., trimethylsilyloxy, tert-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms, or a substituted or unsubstituted arylcarbonyloxy group having from 6 to 30 carbon atoms, e.g., formyloxy, acetyloxy, pivaloyloxy, stearoyloxy, benzoyloxy, p-methoxyphenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy-, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, tert-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms, or a substituted or unsubstituted anilino group having from 6 to 30 carbon atoms, e.g., amino, methylamino, dimethylamino, anilino, N-methyl-anilino, diphenylamino), an ammonio group (preferably an ammonio group or an ammonio group substituted by a substituted or unsubstituted alkyl, aryl or heterocyclic group having from 1 to 30 carbon atoms, e.g., trimethylammonio, triethylammonio, diphenylmethylammonio), an acylamino group (preferably a formylamino group, a substituted or unsubstituted alkylcarbonylamino group having from 1 to 30 carbon atoms, or a substituted or unsubstituted arylcarbonylamino group having from 6 to 30 carbon atoms, e.g., formylamino, acetylamino, pivaloylamino lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, tert-butoxycarbonylamino, n-octadecyloxycarbonylamino, N-methyl-methoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkyl- or arylsulfonylamino group (preferably a substituted or unsubstituted alkylsulfonylamino group having from 1 to 30 carbon atoms, or a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino,. p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g.$_1$ 2-benzo-thiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkyl- or arylsulfinyl group (preferably a substituted or unsubstituted alkylsulfinyl group having from 1 to 30 carbon atoms, or a substituted or unsubstituted arylsulfinyl group having from 6 to 30 carbon atoms, e.g., methylsulfinyl, ethylsulfinyl, phenylsulfinyl, p-methylphenylsulfonyl), an alkyl- or arylsulfonyl group (preferably a substituted or unsubstituted alkylsulfonyl group having from 1 to 30 carbon atoms, or a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, or a substituted or unsubstituted heterocyclic carbonyl group having from 4 to 30 carbon atoms and being bonded to a carbonyl group through the carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxy-carbonyl, m-nitrophenoxycarbonyl, p-tert-butylphenoxy-carbonyl), an alkoxycarbonyl group (preferably a substituted or unsubstituted alkoxycarbonyl group having from 2 to 30 carbon atoms, e.g., methoxycarbonyl, ethoxy-carbonyl, tert-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an aryl or heterocyclic azo group (preferably a substituted or unsubstituted arylazo group having from 6 to 30 carbon atoms, or a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido or N-phthalimido), a phosphino group (preferably a substituted or unsubstituted phosphino group having from 2 to 30 carbon atoms, e.g., dimethylphosphino, diphenylphosphino, methylphenoxy-phosphino), a phosphinyl group (preferably a substituted or unsubstituted phosphinyl group having from 2 to 30 carbon atoms, e.g., phosphinyl, dioctyloxyphosphinyl, diethoxy-phosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), a phospho group, a silyl group (preferably a substituted or unsubstituted silyl group having from 3 to 30 carbon atoms, e.g., trimethylsilyl, tert-butyldimethylsilyl, phenyl-dimethylsilyl), a hydrazino group (preferably a substituted or unsubstituted hydrazino group having from 0 to 30 carbon atoms, e.g., trimethylhydrazino), or a ureido group (preferably a substituted or unsubstituted ureido group having from 0 to 30 carbon atoms, e.g., N,N-dimethylureido).

Two Ws may form a ring in cooperation (an aromatic or non-aromatic hydrocarbon or heterocyclic ring or a polycyclic condensed ring comprising a combination of these rings may be formed and examples thereof include a benzene ring, a naphthalene ring, an anthracene ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolidine ring, a quinoline ring, a phthalazine ring, a naphthylidine ring, a quinoxaline ring, a quinoxazoline ring, an isoquinoline ring, a carbazole ring, a phenanthridine ring, an acridine ring, a phenanthroline ring, a thianthrene ring, a chromene ring, a xanthene ring, a phenoxathiine ring, a phenothiazine ring and a phenazine ring).

Among these substituents W, those having a hydrogen atom may be deprived of the hydrogen atom and substituted by the above-described group. Examples of such a substituent include —$CONHSO_2$— group (e.g., sulfonylcarbamoyl group, carbonylsulfamoyl group), —CONHCO— group (e.g., carbonylcarbamoyl group) and —$SO_2NHSO_2$— group (e.g., sulfonylsulfamoyl group).

Specific examples thereof include an alkylcarbonylaminosulfonyl group (eg., acetylaminosulfonyl), an arylcarbonylaminosulfonyl group (e.g., benzoylaminosulfonyl), an alkylsulfonylaminocarbonyl group (e.g., methylsulfonylaminocarbonyl) and an arylsulfonylaminocarbonyl group (e.g., p-methylphenylsulfonylaminocarbonyl).

In the present invention, a dye chromophore may be present as a partial structure of a dye compound, or a dye compound may be formed only by a dye chromophore. In the latter case, the dye chromophore indicates a dye compound. A dye compound containing a dye chromophore can be preferably used as a sensitizing dye.

The dye chromophore for use in the present invention is described in [1] Chromophore below.

[1] Chromophore:

The "chromophore" as used herein means an atomic group mainly responsible for the absorption band of a molecule as described in *Rikagaku Jiten* (*Physicochemical Dictionary*), 5th ed., page 1052, Iwanami Shoten (1998), and any atomic group, for example, an atomic group having an unsaturated bond such as C═C or N═N, may be used.

Specific examples of the dye chromophore include a cyanine dye, a styryl dye, a hemicyanine dye, a merocyanine dye (including zero-methine merocyanine (simple merocyanine)), a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye and a metal complex dye.

Among these, preferred are methine dye chromophores such as cyanine dye, styryl dye, hemicyanine dye, merocyanine dye, trinuclear merocyanine dye, tetranuclear merocyanine dye, rhodacyanine dye, complex cyanine dye, complex merocyanine dye, allopolar dye, oxonol dye, hemioxonol dye, squarium dye, croconium dye and azamethine dye, more preferred are a cyanine dye, a merocyanine dye, a trinuclear merocyanine dye, a tetranuclear merocyanine dye, a rhodacyanine dye and an oxonol dye, still more preferred are a cyanine dye, a merocyanine dye, a rhodacyanine dye and an oxonol dye, and most preferred is a cyanine dye.

These dyes are described in detail in [2] Dye Publications below.

[2] Dye Publications:

These dyes are described in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Section 14, pp. 482–515, John Wiley & Sons, New York, London (1977), and *Rodd's Chemistry of Carbon Compounds,* 2nd ed., Vol. IV, Part B, Chap. 15, pp. 369–422, Elsevier Science Publishing Company Inc., New York (1977).

In addition, the dyes described in *Research Disclosure* (*RD*), 17643, pp. 23–24, RD, 18716, page 648, right column to page 649, right column, *RD,* 308119, page 996, right column to page 998, right column, and EP-A-0565096, page 65, lines 7 to 10, may be preferably used. Also, dyes having a partial structure or a structure shown by formulae and specific examples described in U.S. Pat. No. 5,747,236 (particularly pp. 30–39), U.S. Pat. No. 5,994,051 (particularly pp. 32–43) and U.S. Pat. No. 5,340,694 (particularly, pp. 21–58, however, in the dyes represented by formulae (XI), (XII) and (XIII), the numbers of $n_{12}$, $n_{15}$, $n_{17}$ and $n_{18}$ are not limited and each is an integer of 0 or more (preferably 4 or less)) may be preferably used.

Furthermore, dyes having a partial structure or a structure shown by formulae and specific examples described in JP-A-10-239789, JP-A-11-133531, JP-A-2000-267216, JP-A-2000-275772, JP-A-2001-75222, JP-A-2001-75247, JP-A-2001-75221, JP-A-2001-75226, JP-A-2001-75223, JP-A-2001-255615, JP-A-2002-23294, JP-A-10-171058, JP-A-10-186559, JP-A-10-197980, JP-A-2000-81678, JP-A-2001-5132, JP-A-2001-166413, JP-A-2002-49113, JP-A-64-91134, JP-A-10-110107, JP-A-10-171058, JP-A-10-226758, JP-A-10-307358, JP-A-10-307359, JP-A-10-310715, JP-A-2000-231174, JP-A-2000-231172, JP-A-2000-231173, JP-A-2001-356442, EP-A-0985965, EP-A-0985964, EP-A-0985966, EP-A-0985967, EP-A-1085372, EP-A-1085373, EP-A-1172688, EP-A-1199595, EP-A-887700, JP-A-10-239789, JP-A-2001-75222 and JP-A-10-171058 may also be preferably used.

The multilayer adsorption in the present invention is described below. The term "multilayer adsorption" as used in the present invention means that a dye chromophore is adsorbed (in another way, stacked) in two or more layers on the surface of a silver halide grain.

Specific examples of the method therefor include a method of adsorbing a dye on the silver halide grain surface in an amount larger than a single-layer saturation coverage by utilizing an intermolecular force, and a method of adsorbing a compound comprising a plurality of dye chromophores (so-called multi-chromophore dye compound or connection-type dye) (in this compound, the plurality of dye chromophores are preferably not conjugated) to a silver halide grain. These are described in [3] Multilayer Adsorption Related Patents below.

[3] Multilayer Adsorption Related Patents

JP-A-10-239789, JP-A-11-133531, JP-A-2000-267216, JP-A-2000-275772, JP-A-2001-75222, JP-A-2001-75247, JP-A-2001-75221, JP-A-2001-75226, JP-A-2001-75223, JP-A-2001-255615, JP-A-2002-23294, JP-A-10-171058, JP-A-10-186559, JP-A-10-197980, JP-A-2000-81678, JP-A-2001-5132, JP-A-2001-166413, JP-A-2002-49113, JP-A-64-91134, JP-A-10-110107, JP-A-10-171058, JP-A-10-226758, JP-A-10-307358, JP-A-10-307359, JP-A-10-310715, JP-A-2000-231174, JP-A-2000-231172, JP-A-2000-231173, JP-A-2001-356442, EF-A-0985965, EP-A-0985964, EP-A-0985966, EP-A-0985967, EP-A-1085372, EP-A-1085373, EP-A-1172688, EP-A-1199595 and EP-A-887700. Furthermore, the technique described in JP-A-10-239789, JP-A-2001-75222 and JP-A-10-171058 is preferably used in combination.

In the present invention, the term "a dye chromophore is adsorbed in multiple layers on the surface of a silver halide grain" indicates a silver halide emulsion where a dye chromophore is adsorbed in two or more layers on the surface of a silver halide grain, and this term means a state such that when the saturated adsorption amount per unit surface area achieved by, among dyes added to the emulsion, a dye having a minimum dye occupation area on the silver halide grain surface is defined as a single-layer saturation coverage, the amount of a dye chromophore adsorbed per unit area is larger based on the single-layer saturation coverage. The number of layers adsorbed means the amount of a dye chromophore adsorbed per unit surface area of a grain based on the single-layer saturation coverage. In the case of a multi-chromophore dye compound, the dye occupation area of a dye having individual dye chromophores which are not connected can be used as the basis. For example, a dye having one dye chromophore resulting from changing the connection site to an alkyl group or an alkylsulfonic acid group may be used.

The dye occupation area can be obtained from an adsorption isotherm showing the relationship between the free dye concentration and the amount of dye adsorbed, and a grain surface area. The adsorption isotherm can be obtained by referring, for example, to A. Herz et al., *Adsorption from Aqueous Solution, Advances in chemistry Series*, No. 17, page 173 (1968).

For determining the amount of a dye adsorbed to an emulsion grain, two methods may be used, namely, a method of centrifuging an emulsion having adsorbed thereto a dye, separating the emulsion grains from the supernatant aqueous gelatin solution, measuring the spectral absorption of the supernatant to obtain the concentration of non-adsorbed dye, and subtracting the obtained concentration from the amount of dye added to thereby determine the amount of the dye adsorbed, and a method of drying the emulsion grains precipitated, dissolving a predetermined mass of the precipitate in a silver halide-dissolving agent and a dye-dissolving agent, for example, a mixed solution of aqueous sodium thiosulfate solution and methanol, and measuring the spectral absorption to thereby determine the amount of the dye adsorbed. In the case where a plurality of sensitizing dyes are used, the amount of individual dyes adsorbed may also be determined by +a technique such as high-performance liquid chromatography. The method of determining the amount of the dye adsorbed by quantitating the amount of the dye in the supernatant is described, for example, in W. West et al., *Journal of Physical Chemistry*, Vol. 56, page 1054 (1952). However, under the conditions of adding the dye in a large amount, even non-adsorbed dyes may precipitate and exact determination of the amount of the dye adsorbed may not be obtained by the method of quantitating the dye concentration in the supernatant. On the other hand, according to the method of dissolving precipitated silver halide grains and measuring the amount of the dye adsorbed, the amount of only the dye adsorbed to grains can be exactly determined, because the emulsion grain is by far higher in the precipitation speed and the grains can be easily separated from the precipitated dye. This method is most reliable as the method for determining the amount of a dye adsorbed.

According to one example of the method for measuring the surface area of a silver halide grain, a photograph of grains is taken through a transmission electron microscope by a replica process, individual grains are measured on the shape and the size, and the surface area is calculated from the obtained values. In this case, the thickness of a tabular grain is calculated from the length of a shadow of the replica. The method for taking a photograph through a transmission electron microscope is described, for example, in *Denshi Kenbikyo Shiryo Gijutsu Shu* (*Electron Microscopic Sample Technologies*), Nippon Denshi Kenbikyo Gakkai Kanto Shibu (compiler), Seibundo Shinko Sha (1970), and P. B. Hirsch et al., *Electron Nicroscopy of Thin Crystals*, Butterworths, London (1965).

Other examples of the measuring method include those described in A. M. Kragin et al., *The Journal of Photographic Science*, Vol. 14, page 185 (1966), J. F. Paddy, *Transactions of the Faraday Society*, Vol. 60, page 1325 (1964), S. Boyer et al., *Journal de Chimie Physique et de Physicochimie Biologique*, Vol. 63, page 1123 (1963), W. West et al., *Journal of Physical Chemistry*, Vol. 56, page 1054 (1952), and H. Sauvernier (compiler), E. Klein et al., *International Colloquium, Scientific Photography*, Liege (1959).

The occupation area of individual dye chromophores can be experimentally determined by the above-described methods, however, the molecular occupation area of a sensitizing dye usually used is nearly in the vicinity of 80 $Å^2$ and therefore, the number of layers adsorbed can be roughly estimated by counting the dye occupation area as 80 $Å^2$ for all dyes.

The dye chromophore is preferably adsorbed to a silver halide grain in 1.3 layers or more, more preferably 1.5 layers or more, still more preferably 1.7 layers or more. The upper bound which is not particularly limited is preferably 10 layers or less, more preferably 5 layers or less, still more preferably 3 layers or less.

The silver halide photographic emulsion for use in the present invention preferably contains a silver halide grain having a light absorption intensity of 100 or more in the case of a grain having a spectral absorption maximum wavelength of 500 nm or more, or having a light absorption intensity of 60 or more in the case of a grain having a spectral absorption maximum wavelength of less than 500 nm, in a proportion of a half or more of the projected area of all silver halide grains. In the case of a grain having a spectral absorption maximum wavelength of 500 nm or more, the light absorption intensity is preferably 150 or more, more preferably 170 or more, still more preferably 200 or more. In the case of a grain having a spectral absorption maximum wavelength of less than 500 nm, the light absorption intensity is preferably 90 or more, more preferably 100 or more, still more preferably 120 or more. The upper bound which is not particularly limited is preferably 2,000 or less, more preferably 800 or less, still more preferably 400 or less.

In the present invention, the light absorption intensity is an integrated intensity of light absorption by a sensitizing dye per the unit surface area of a grain and defined as a value obtained by integrating the optical density $\mathrm{Log}(I_0/(I_0-I))$ with respect to the wave number ($cm^{-1}$), wherein $I_0$ is the quantity of light incident on the unit surface area of a grain and I is the quantity of light absorbed into a sensitizing dye on the surface. The integration range is from 5,000 $cm^{-1}$ to 35,000 $cm^{-1}$.

One example of the method for measuring the light absorption intensity is a method using a microspectrophotometer. The microspectrophotometer is a device capable of performing the measurement in a microscopic area and by using this device, the transmission spectrum and reflection spectrum of one grain can be measured. From these two spectra measured, an absorption spectrum can be obtained. The measurement of absorption spectrum of one grain by the microspectrometry is described in the report by Yamashita et al. (see, Nippon Shashin Gakkai, 1996 *Nendo Nenji Taikai Ko'en Yoshi Shu* (*Lecture Summary at Annual Meeting of Japan Photographic Association in* 1996), page 15). From this absorption spectrum, the absorption intensity per one grain can be determined, however, the light transmitted through the grain is absorbed on two faces of upper face and lower face and therefore, the absorption intensity per unit area on the grain surface can be obtained as a half (½) of the absorption intensity per one grain determined by the above-described method. At this time, the segment for the integration of absorption spectrum is from 5,000 to 35,000 $cm^{-1}$ in the definition, however, in experiments, the integration may be performed in the segment containing the region of 500 $cm^{-1}$ shorter or longer than the segment having absorption by the sensitizing dye.

The light absorption intensity is a value unequivocally determined by the oscillator strength of the sensitizing dye and the number of molecules adsorbed per unit area and therefore, when the oscillator strength of the sensitizing dye, the amount of the dye adsorbed and the surface area of the grain are obtained, the values obtained can be converted into the light absorption intensity.

The oscillator strength of the sensitizing dye can be experimentally determined as a value proportional to the absorption integrated intensity (optical density×$cm^{-1}$) of a sensitizing dye solution. Therefore, assuming that the absorption integrated intensity of a dye per 1 M is A (optical density×$cm^{-1}$), the amount of sensitizing dye adsorbed is B (mol/mol-Ag) and the surface area of grain is C ($m^2$/mol-Ag)., the light absorption intensity can be obtained according to the following formula within an error of about 10%:

$$0.156 \times A \times B/C$$

The light absorption intensity calculated from this formula is substantially the same as the light absorption intensity measured based on the above-described definition (a value obtained by the integration of $\mathrm{Log}(I_0/(I_0-I))$ with respect to the wave number ($cm^{-1}$)).

In the present invention, in the case of a normal dye comprising one dye chromophore, the dye in the first layer means a dye adsorbed in the inner side adjacently to a silver halide grain and the dye in the second or upper layer means a dye which is adsorbed to a silver halide grain as confirmed by the above-described measurement of the adsorbed amount but adsorbed in the outer side adjacently to the first-layer dye without directly adsorbing to the silver halide grain. In the case of a multi-chromophore dye compound, the dye in the first layer means a dye chromophore adsorbed in the inner side adjacently to a silver halide grain and the dye in the second or upper layer means a dye chromophore adsorbed in the outer side adjacently to the dye chromophore in the inner side.

In the present invention, the absorption maximum wavelength of the dye in the second or upper layer is preferably equal to or shorter than the absorption maximum wavelength of the first-layer dye and the distance between these wavelengths is preferably from 0 to 50 nm, more preferably from 0 to 30 nm, still more preferably from 0 to 20 nm.

In the present invention, the first-layer dye and the dye in the second or upper layer may have any reduction potential and any oxidation potential, however, the reduction potential of the first-layer dye is preferably higher than the value obtained by subtracting 0.2 V, more preferably 0.1 V, from the reduction potential of the dye in the second or upper layer. The reduction potential of the first-layer dye is still more preferably higher than the reduction potential of the dye in the second or upper layer.

The reduction potential and the oxidation potential can be measured by various methods, however, these are preferably measured by phase discrimination-type second harmonic a.c. polarography for obtaining exact values. The method for measuring the potential by phase discrimination-type second harmonic a.c. polarography is described in *Journal of Imaging Science*, Vol. 30, page 27 (1986).

The dye in the second or upper layer preferably exhibits light-emitting property in a gelatin dry film. The light-emitting dye preferably has a skeleton structure of a dye used for dye lasers. These are described, for example, in Mitsuo Maeda, *Laser Kenkyu* (*Study of Laser*), Vol. 8, page 694, page 803 and page 958 (1980), ibid., Vol. 9, page 85 (1981), and F. Sehaefer, *Dye Lasers*, Springer (1973).

The light emission yield in a gelatin dry film of the dye only in the second-layer dye portion is preferably 0.05 or more, more preferably 0.1 or more, still more preferably 0.2 or more, particularly preferably 0.5 or more.

In the case where energy transfer from the dye in the second or upper layer to the first-layer dye occurs by a non-equilibrium excitation energy transfer mechanism, the excitation life in a gelatin dry film of only the second-layer dye portion is preferably longer. In this case, the light emission yield of the second-layer dye portion may be high or low. The fluorescence life in a gelatin dry film of only the second-layer dye portion is preferably 10 ps or more, more preferably 40 ps or more, still more preferably 160 ps or more. The upper bound of the fluorescence life of the dye in the second or upper layer, which is not particularly limited, is preferably 1 ms or less.

The light emission of the dye in the second or upper layer preferably has large overlapping with the absorption of the first-layer dye.

Assuming that the light emission spectrum of the dye in the second or upper layer is $l(\nu)$ and the absorption spectrum of the first-layer dye is $a(\nu)$, the product $l(\nu)\cdot a(\nu)$ thereof is preferably 0.001 or more, more preferably 0.01 or mote, still more preferably 0.1 or more, particularly preferably 0.5 or more. Here, $\nu$ is a wave number ($cm^{-1}$) and in each spectrum, the spectrum area is normalized to 1.

The excitation energy of the dye in the second or upper layer preferably transfers to the first-layer dye at a transfer energy efficiency of 10% or more, more preferably 30% or more, still more preferably 60% or more, and most preferably 90% or more. The term "excitation energy of the dye in the second or upper layer" as used herein means the energy of a dye in the excited state produced as a result of the dye in the second or upper layer absorbing light energy. When excitation energy of a certain molecule transfers to another molecule, the excitation energy is considered to transfer through an excitation electron transfer mechanism, a Forster model energy transfer mechanism, a Dextor model energy transfer mechanism or the like. Therefore, it is also preferred for the multilayer adsorption system of the present invention to satisfy the conditions for causing an efficient excitation energy transfer achievable by these mechanisms, more preferably the conditions for causing a Forster model energy transfer mechanism. In order to elevate the efficiency of the Forster model energy transfer, reduction in the refractive index near the surface of an emulsion grain is also effective.

The efficiency of the energy transfer from the dye in the second or upper layer to the first-layer dye can be determined by the analysis of the fluorescence attenuation rate of the second-layer dye or by the dynamics analysis of the light excitation state such as fluorescence rising rate of the first-layer dye.

The efficiency of the energy transfer from the dye chromophore in the second or upper layer to the first-layer dye can also be determined as (spectral sensitization efficiency at the excitation of the dye in the second or upper layer/spectral sensitization efficiency at the excitation of the first-layer dye).

In the present invention, the dye adsorbed in the first layer preferably forms a J-aggregate. The dye in the second or upper layer may be adsorbed as a monomer or may form short wavelength aggregation such as H-aggregate, but is preferably adsorbed to form a J-aggregate. The J-aggregate is advantageous in view of high absorption coefficient and sharp absorption and therefore, this is very useful in the spectral sensitization by the normal single-layer adsorption but it is also very preferred that the dye in the second or upper layer has this spectral property. Moreover, a high fluorescence yield and a small Stokes' shift are obtained and this is preferred for transmitting the light energy absorbed by the dye in the second or upper layer to the first-layer dye approximated in the light absorption wavelength, by a Forster model energy transfer mechanism.

In the emulsion containing silver halide photographic emulsion grains having a light absorption intensity of 60 or more or a light absorption intensity of 100 or more, the distance between the shortest wavelength showing 50% of the maximum value Amax of spectral absorption factor by a sensitizing dye and the longest wavelength showing 50% of Amax and the distance between the shortest wavelength showing 50% of the maximum value Smax of spectral sensitivity and the longest wavelength showing 50% of Smax each is preferably 120 nm or less, more preferably 100 nm or less.

The distance between the shortest wavelength showing 80% of Amax and the longest wavelength showing 80% of Amax and the distance between the shortest wavelength showing 80% of Smax and the longest wavelength showing 80% of Smax each is preferably 20 nm or more and preferably 100 nm or less, more preferably 80 nm or less, still more preferably 50 nm or less.

The distance between the shortest wavelength showing 20% of Amax and the longest wavelength showing 20% of Amax and the distance between the shortest wavelength showing and 20% of Smax and the longest wavelength showing 20% of Smax each is preferably 180 nm or less, more preferably 150 nm or less, still more preferably 120 nm or less, and most preferably 100 nm or less.

The longest wavelength showing spectral absorption factor of 50% of Amax or Smax is preferably from 460 to 510 nm, from 560 nm to 610 nm, or from 640 to 730 nm.

Assuming that the maximum value of spectral absorption factor by the dye chromophore in the first layer of a silver halide grain is A1max and the maximum value of spectral absorption factor by the dye chromophore in the second or upper layer is A2max, A1max and A2max each is preferably present in the range from 400 to 500 nm, from 500 to 600 nm, from 600 to 700 nm, or from 700 to 1,000 nm.

Assuming that the maximum value of spectral sensitivity by the dye chromophore in the first layer of a silver halide grain is S1max and the maximum value of spectral sensitivity by the dye chromophore in the second or upper layer is S2max, S1max and S2max each is preferably present in the range from 400 to 500 nm, from 500 to 600 nm, from 600 to 700 nm, or from 700 to 1,000 nm.

The aggregation property (Agg) of Condition 1 is described below.

Condition 1 of the present invention is, in formula (1), {Agg(Dye X)/Agg(Dye 1)}>1.1, preferably 1.5 or more, more preferably 2 or more, still more preferably 3.5 or more, and most preferably 5 or more. The upper bound which is not particularly limited is preferably 20 or less, more preferably 15 or less.

The dye has a property of causing aggregation (this may also be called "association") due to interaction of dyes with each other. This aggregation property is here defined by a ratio of absorption of an aggregate to absorption of a monomer shown in the following formula (B1):

$$Agg=A/M \quad (B1)$$

wherein A represents an absorption intensity of aggregate absorption and M represents an absorption intensity of monomer absorption. The measurement conditions are as follows:

Dye concentration: $1\times10^{-5}$ mol/L

Solvent: water

Measuring temperature: 25° C.

Under these conditions, the absorption spectrum is measured and A and M are determined.

The aggregate absorption may be any absorption if it is not the monomer absorption, and examples thereof include dimer absorption and H-aggregate absorption.

Incidentally, the aggregate absorption exhibited under the above-described conditions is in most cases dimer aggregate absorption at a wavelength shorter than that of the monomer absorption maximum. In this case, A means the absorption intensity (D) of dimer absorption.

However, H-aggregate or J-aggregate absorption is sometimes exhibited under those conditions and, for example, when three absorptions of dimer absorption, H-aggregate absorption and J-aggregate absorption are exhibited as the aggregate absorption, A means the sum of absorption intensity (D) of dimer absorption, absorption intensity (H) of H-aggregate absorption and absorption intensity (J) of J-aggregate absorption.

In the case where Dye X has a group capable of dissociating at a pH of 10 or less, the measurement is performed in the dissociated state. For example, the dissociation may be attained by adding NaOH (other than this, any base may be used, such as KOH or triethylamine) equivalent to the dye (the number of equivalence of the base to the dye may be increased to a necessary amount according to the pRa of the dissociating group and the base).

For reference, the aggregate is described below. The aggregate is described in detail, for example, in James (compiler), *The Theory of the Photographic Process,* 4th ed., Chap. 8, pp. 214–222, Macmillan (1977), Takayoshi Kobayashi, *J-Aggregates*, World Scientific Publishing Co., Ltd. (1996), *Chemical Physics Letters*, Vol. 6, page 183 (1970), *Zeitschrift fur Physikalische Chemie*, Vol. 49, page 324 (1941), Koji Matsubara and Toshio Tanaka, *Nippon Shashin Gakkai Shi* (*The Journal of The Society of Photographic Science and Technology of Japan*), Vol. 52, No. 5, pp. 395–399 (1989), and *Photographic Science and Engineering*, Vol. 18, No. 3, page 335 (1974).

The monomer means a monomeric substance. In view of the absorption wavelength of aggregates, an aggregate having an absorption shifted to the shorter wavelength with respect to the monomer absorption is called an H-aggregate (a dimeric substance is particularly called "a dimer"; in the present invention, the H-aggregate absorption is an absorption excluding the dimer absorption) and an aggregate shifted to the longer wavelength is called a J-aggregate. It is known that when a J-aggregate is formed, the absorption width in the longer wavelength side generally becomes small as compared with the monomer state.

The hydrophilicity/hydrophobicity (LogP) as used in the present invention is described below.

Condition 2 of the present invention is, in formula (2), {log(Dye X)/log(Dye 1)}≧1.1, preferably 1.5 or more, more preferably 3 or more, still more preferably 5 or more, and most preferably 7.5 or more. The upper bound which is not particularly limited is preferably 20 or less, more preferably 15 or less.

The LogP value used in the present invention is an n-octanol/water distribution coefficient and this value can be specifically determined by actually measuring it according to the Flask Shaking Method described in the following Publication (1).

Publication (1)

Toshio Fujita (compiler), a representative of Kozo Kassei Sokan Kondankai, "Yakubutsu no Kozo Kassei Sokan—Drug Design to Sayo Kisa Kenkyu he no Shishin (Structure and Activity Correlation of Drugs—Guideline for Drug Design and Study of Operation/Mechanism)", *Kagakuno Ryoiki* (*Region of Chemistry*), Extra Number, No. 122, Chap. 2, pp. 43–203, Nanko Do (1979).

Particularly, the Flask Shaking Method is described at pages 86 to 89.

In the case where Dye X has a group capable of dissociating at a pH of 10 or less, the measurement is performed in the dissociated state. For example, the dissociation may be attained by adding NaOH (other than this, any base may be used, such as KOH or triethylamine) equivalent to the dye (the number of equivalence of the base to the dye may be increased to a necessary amount according to the pKa of the dissociating group and the base).

The LogP value of the present invention is as defined above but this value can be also simply and easily determined by the following method of (a). When the LogP value is referred to in the present invention, the LogP value determined by the method of (a) may be used.

(a) High-performance Liquid Chromatography Described in Publication (1), pp. 90–91

The high-performance liquid chromatography is a simple and easy method and the LogP can be determined according to the following formulae (B2) and (B3):

$$\text{Log } P' = \text{Log } \{(t_R - t_0)/t_0\} \quad \text{(B2)}$$

$$\text{Log } P = a \text{ Log } P' + b \quad \text{(B3)}$$

wherein $t_0$ is a holding time of a substance not to be held (for example, a holding time of potassium iodide can be used), $t_R$ is a holding time of a sensitizing dye, and a and b each is a constant determined by the measurement conditions.

The measurement conditions for the liquid chromatography may be any conditions, but, for example, the following measurement conditions may be used. The column is TSK-gel, ODS-80TS (produced by TOSOH), the eluent is a solution prepared by incorporating acetic acid-triethylamine salt to a concentration of 0.2% into a methanol:water (60:40) mixed solution, and the measurement temperature is 25° C.

For reference, other methods known in publications are shown below:

(b) thin-layer chromatography described in Publication (1), pp. 89–90; and (c) method by calculation.

The LogP value determined by calculation is referred to as CLogP. The CLogP value can be determined by the fragment method described in the following Publication (2) or by the method using a software package described in (3) below.

Publication (2):

C. Hansch and A. J. Leo, *Substituent Constants for Correlation Analysis in Chemistry and Biology*, John Wiley and Sons, New York (1979).

(3):

Medchem Software Package (developed and sold by Pomoa College, Claremont, Calif., Ver. 3.54).

The J-aggregation property (J-Agg) as used in the present invention is described below.

Condition 3 of the present invention is, in formula (3), {J-Agg(Dye X)/J-Agg(Dye 1)}≧1.1, preferably 5 or more, more preferably 25 or more, still more preferably 50 or more, particularly preferably 100 or more, and most preferably 150 or more. The upper bound which is not particularly limited is preferably 500 or less, more preferably 250 or less.

As described above with respect to the condition (1), the dye has a property of causing aggregation (this may also be called association) due to interaction of dyes with each other. In the condition (3), among these aggregation properties, the J-aggregation property is evaluated and this property is defined by a ratio of absorption of a J-aggregate to absorption of aggregates except for J-aggregate of the following formula (B4):

$$J\text{-Agg} = J/G \quad \text{(B4)}$$

wherein J represents an absorption intensity of J-aggregate absorption and G represents an absorption intensity of absorption except for J-aggregate absorption. The measurement conditions are as follows:

Dye concentration: $1\times10^{-5}$ mol/L solvent: 0.5% aqueous gelatin (the gelatin used is deionized gelatin)

Measuring temperature: 25° C.

After allowing to stand for 3 hours under these conditions, the absorption spectrum is measured at 25° C. and J and G are determined.

The absorption except for J-aggregate absorption may be any absorption if it is not the J-aggregate absorption, and examples thereof include monomer absorption, dimer absorption and H-aggregate absorption.

Incidentally, under the above-described conditions, monomer absorption and dimer absorption are exhibited in most cases as the absorption except for J-aggregate absorption. In this case, G means the sum of absorption intensity (M) of monomer absorption and absorption intensity (D) of dimer absorption.

In the case where Dye X has a group capable of dissociating at a pH of 10 or less, the measurement is performed in the dissociated state. For example, the dissociation may be attained by adding NaOH (other than this, any base may be used, such as KOH or triethylamine) equivalent to the dye (the number of equivalence of the base to the dye may be increased to a necessary amount according to the pKa of the dissociating group and the base).

In the present invention, it may suffice if at least one of Conditions 1, 2 and 3 is satisfied, however, it is preferred to satisfy two conditions of Conditions 1 and 2, Conditions 2 and 3 or Conditions 1 and 3, more preferably two conditions of Conditions 2 and 3, still more preferably all conditions of Conditions 1, 2 and 3.

In the present invention, a dye other than the compound satisfying Condition 1, 2 or 3 of the present invention may be added but the dye of the present invention is preferably added to a concentration of 50 mol % or more, more preferably 70 mol % or more, and most preferably 90 mol % or more, based on the amount of all dyes added.

The compound satisfying at least one of Conditions 1, 2 and 3 is preferably present in the second or upper layer, more preferably in the outermost layer (layer in the most exterior side).

With respect to the properties required of the sensitizing dye, such as aggregation property and hydrophilicity/hydrophobicity, for example, when the aggregation property is high, the stability is enhanced in many cases in conventional silver halide photographic light-sensitive materials where a dye chromophore is adsorbed in a single layer. However, an unintended inefficient aggregate is sometimes formed to cause an adverse effect such as desensitization. Therefore, it is difficult to specify the preferred aggregation property. Conventionally, many researchers have made an invention by limiting the structure or the like of a preferred dye.

Also in the silver halide photographic light-sensitive material of the present invention where a dye chromophore is adsorbed in multiple layers, the properties required of the preferred dye have been heretofore not clarified. As a result of various investigations, the present inventors have found that in a system where a dye chromophore is adsorbed in multiple layers, when at least one of Conditions 1, 2 and 3 is satisfied, the excellent performance is particularly outstandingly exhibited.

The case where "bound to each other by an attractive force except for covalent bonding" described in (8) above is described below.

The attractive force except for covalent bonding may be any attractive force but examples thereof include van der Waals force (more specifically, orientation force acting between permanent dipole-permanent dipole, induction force acting between permanent dipole-induced dipole, and dispersion force acting between temporary dipole-induced dipole), charge transfer force (CT), Coulomb force (electrostatic force), hydrophobic bond force, hydrogen bond force and orientation bond force. One of these bonding forces may be used alone or a plurality of these bonding forces may be freely combined and used.

Among these, preferred are van der Waals force, electric charge transfer force, Coulomb force, hydrophobic bond force and hydrogen bond force, more preferred are van der Waals force, Coulomb force and hydrogen bond force, still more preferred are van der Waals force and Coulomb force, and most preferred is van der Waals force.

The term "bound to each other" means that the dye chromophores are constrained by the above-described attractive force. In other words, the attracting energy (namely, adsorption energy ($\Delta G$)) is preferably 15 kJ/mol or more, more preferably 20 kJ/mol or more, still more preferably 40 kJ/mol or more. The upper limit which is not particularly limited is preferably 5,000 kJ/mol Or less, more preferably 1,000 kJ/mol or less.

Specific examples of the method which is preferably used therefor include a method of using a dye having an aromatic group or a cationic dye having an aromatic group and an anionic dye in combination described in JP-A-10-239789, a method of using a dye having a polyvalent electric charge described in JP-A-10-171058, a method of using a dye having a hydrophobic group described in JP-A-10-186559, a method of using a dye having a coordinate bond group described in JP-A-10-197980, a method of using a dye having a trinuclear basic nucleus described in JP-A-2001-5132, a method of using a dye having a specific hydrophilicity/hydrophobicity described in JP-A-2001-13614, a method of using a specific intramolecular base-type dye described in JP-A-2001-75220, a method of using a specific dye except for cyanine described in JP-A-2001-75221, a method of using a dye having an acid dissociative group with specific pKa described in JP-A-2001-152038, a method of using dye having a specific hydrogen bond group described in JP-A-2001-166413, JP-A-2001-323180 and JP-A-2001-337409, a method of using a dye having a specific fluorescent quantum yield described in JP-A-2001-209143, a method of using a specific decolorizing dye described in JP-A-2001-264913, a method of using a dye contained in a gelled matrix described in JP-A-2001-343720, a method of using a specific infrared dye described in JP-A-2002-23294, a method of using a dye having a specific potential described in JP-A-2002-99053, and a method of using a specific cationic dye described in European Patent Nos. 0985964, 0985965, 0985966, 0985967, 1085372, 1085373, 1172688 and 1199595.

The compound comprising a plurality of dye chromophores in (9) above is described below. This multi-chromophore dye compound is a dye compound containing a plurality of dye chromophores.

In this compound, the plurality of dye chromophores can be connected by covalent bonding or coordinate bonding but these are preferably connected by covalent bonding. (Here, the coordinate bonding can be regarded as coordinate boding force which is one of intermolecular forces of (8).) Furthermore, in this compound, the covalent bonding or coordinate bonding may be previously formed or may be formed in the process of preparing a silver halide light-sensitive material (for example, in the silver halide emulsion). In the latter case, the method described, for example, in JP-A2000-81678 may be used. Preferred is the case where the bonding is previously formed.

The number of dye chromophores in the multi-chromophore dye compound may be any number insofar as it is at least 2, but this number is preferably from 2 to 7, more preferably from 2 to 5, still more preferably from 2 or 3, and most preferably 2. The plurality of dye chromophores may be the same or different. The dye chromophore may be any dye chromophore but preferred examples thereof include dye chromophores described above in [1] Chromophore. In particular, dye chromophores represented by formulae (A), (B), (C) and (D) described later are preferred.

Examples of the multi-chromophore dye compound include a multi-chromophore dye connected through a methine chain described in JP-A-9-265144, a multi-chromophore dye connected with an oxonol dye described in JP-A-10-226758, a specific multi-chromophore dye having a benzimidazole nucleus or the like described in JP-A-10-110107, JP-A-10-307358, JP-A-10-307359 and JP-A-10-310715, a multi-chromophore dye connected through a specific group described in JP-A-9-265143, JP-A-2000-231172, JP-A-2000-231173, JP-A-2002-55406, JP-A-2.002-82403, JP-A-2002-82404 and JP-A-2002-82405, a multi-chromophore dye produced in an emulsion by using a dye having a reactive group described in JP-A-2000-81678, a specific multi-chromophore dye having a specific benzoxazole nucleus described in JP-A-2000-231174, a multi-chromophore dye having a specific property or dissociating group described in JP-A-2001-311015, a multi-chromophore dye having a specific property described in JP-A-2001-356442, a multi-chromophore dye having a specific merocyanine described in JP-A-2002-90927, and a multi-chromophore dye having a specific dissociating group described in JP-A-2002-90928 and JP-A-2002-90929.

The multi-chromophore dye compound of the present invention is a compound represented by the following formula (Q):

$$(D_a)_{xa}([—L_a—]_{sa}[D_b]_{qa})_{rb}$$

$$M_b m_b \qquad \text{Formula (Q)}$$

wherein $D_a$ and $D_b$ each represents a dye chromophore, $L_a$ represents a linking group, sa represents an integer of 1 to 4, qa represents an integer of 1 to 5, ra and rb each represents an integer of 1 to 100, $M_b$ represents an electric charge balancing counter ion, and $m_b$ represents a number necessary for neutralizing the electric charge of the molecule.

Formula (Q) shows that dye chromophores can be connected to each other by any connection style.

The dye chromophore represented by $D_a$ and $D_b$ may be any dye chromophore but examples thereof include those described above in [1] Chromophore and preferred examples are the same.

At least one of $D_a$s is preferably selected from cyanine and merocyanine dye chromophores, more preferably from cyanine dye chromophores. $D_a$ and $D_n$ may be the same or different but these are preferably different.

In the present invention, in the case where the compound represented by formula (Q) is adsorbed to a silver halide grain, $D_a$ is preferably adsorbed to the silver halide and $D_b$ is preferably not adsorbed directly to the silver halide. In other words, the adsorption strength of ($[—L_a—]_{sa}[D_b]_{qa}$) to a silver halide grain is preferably lower than that of $D_a$.

In this way, $D_a$ is preferably a dye moiety having adsorptivity to a silver halide grain but the adsorption may be attained by either physical adsorption or chemical adsorption.

$D_b$ is preferably weak in the adsorptivity to a silver halide grain and is also preferably a light-emitting dye. With respect to the kind of the light-emitting dye, those having a skeleton structure of a dye used for dye lasers are preferred. These are described, for example, in Mitsuo Maeda, *Laser Kenkyu* (*Study of Laser*), Vol. 8, page 694, page 803 and page 958 (1980), ibid., Vol. 9, page 85 (1981), and F. Schaefer, *Dye Lasers*, Springer (1973).

The absorption maximum wavelength of $D_a$ in a silver halide photographic light-sensitive material is preferably longer than the absorption maximum wavelength of ($[—L_a—]_{sa}[D_b]_{qa}$). Furthermore, the light emission of ($[—L_a—]_{sa}[D_b]_{qa}$) preferably overlaps the absorption of $D_a$. In addition, $D_a$ preferably forms a J-aggregate. In order to allow the connected dye represented by formula (I) to have absorption and spectral sensitivity in a desired wavelength range, ($[—L_a—]_{sa}[D_b]_{qa}$) also preferably forms a J-aggregate.

$D_a$ and ($[—L_a—]_{sa}[D_b]_{qa}$) each may have any reduction potential and any oxidation potential, however, the reduction potential of $D_a$ is preferably higher than the value obtained by subtracting 0.2 V from the reduction potential of ($[—L_a—]_{sa}[D_b]_{qa}$).

$L_a$ represents a linking group (preferably a divalent linking group). Here, the linking group includes a single bond (sometimes also referred to as a mere bond). This linking group preferably comprises a single bond or an atom or atomic group containing at least one of carbon atom, nitrogen atom, sulfur atom and oxygen atom. $L_a$ is preferably a single bond or a linking group having from 0 to 100 carbon atoms, preferably from 1 to 20 carbon atoms, constituted by one or a combination of two or more of an alkylene group (e.g., methylene, ethylene, trimethylene, tetramethylene, pentamethylene), an arylene group (e.g., phenylene, naphthylene), an alkenylene group (e.g., ethenylene, propenylene), an alkynylene group (e.g., ethynylene, propynylene), an amido group, an ester group, a sulfoamido group, a sulfonic acid ester group, a ureido group, a sulfonyl group, a sulfinyl group, a thioether group, an ether group, a carbonyl group, —N(Va)— (wherein Va represents hydrogen atom or a monovalent substituent; examples of the monovalent substituent include those represented by W above) and a heterocyclic divalent group (e.g., 6-chloro-1,3,5-triazine-2,4-diyl, pyrimidine-2,4-diyl, quinoxaline-2,3-diyl).

These linking groups each may have a substituent represented by W described above. Furthermore, these linking groups each may contain a ring (an aromatic or non-aromatic hydrocarbon or heterocyclic ring).

$L_a$ is more preferably a single bond or a divalent linking group having from 1 to 10 carbon atoms, constituted by one or a combination of two or more of an alkylene group having from 1 to 10 carbon atoms (e.g., methylene, ethylene, trimethylene, tetramethylene, pentamethylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group and a sulfonic acid ester group. These linking groups each may be substituted by W described above.

$L_a$ is a linking group which may perform energy transfer or electron transfer by a through-bond interaction. The through-bond interaction includes a tunnel interaction and a super-exchange interaction. In particular, a through-bond interaction based on a super-exchange interaction is preferred. The through-bond interaction and super-exchange interaction are interactions defined in Shammai Speiser, *Chem. Rev.*, Vol. 96, pp. 1960–1963 (1996). As the linking group which performs the energy transfer or electron transfer by such an interaction, those described in Shammai Speiser, *Chem. Rev.*, Vol. 96, pp. 1967–1969 (1996) are preferred.

sa represents an integer of 1 to 4. when sa is 2 or more, this means that $D_a$ and $D_b$ are connected through a plurality of linking groups. sa is preferably 1 or 2, more preferably 1. When sa is 2 or more, a plurality of linking groups Lo contained may be different from each other.

qa represents an integer or 1 to 5, preferably 1 or 2, more preferably 1. ra and rb each represents an integer of 1 to 100, preferably from 1 to 5, more preferably 1 or 2, still more preferably 1. When qa, ra and rb each is 2 or more, a plurality of dye chromophores $D_a$, linking groups $L_a$, integers sa or integers qa contained may be different from each other.

The compound represented by formula (Q) may be further substituted by a dye chromophore.

In formula (Q), the compound as a whole preferably has an electric charge of −1 or less, more preferably −1.

Examples of the dye chromophore for use in the present invention include those described above in [1] Chromophore and preferred examples are the same, but particularly preferred are methine dye chromophores represented by the following formulae (A), (B), (C) and (D):

Formula (A):

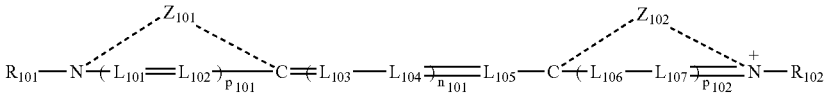

$M_{101}m_{101}$ wherein $L_{101}$, $L_{102}$, $L_{103}$, $L_{104}$, $L_{105}$, $L_{106}$ and $L_{107}$ each represents a methine group, $p_{101}$ and $p_{102}$ each represents 0 or 1, $n_{101}$ represents 0, 1, 2, 3 or 4, $Z_{101}$ and $Z_{102}$ each represents an atomic group necessary for forming a nitrogen-containing heterocyclic ring, provided that $Z_{101}$ and $Z_{102}$ each may be condensed with a ring or may have a substituent, $M_{101}$ represents an electric charge balancing counter ion, $m_{101}$ represents a number of 0 or more necessary for neutralizing the electric charge of the molecule, and $R_{101}$ and $R_{102}$ each represents a hydrogen atom, an alkyl group, an aryl group or a heterocyclic group;

Formula (B)

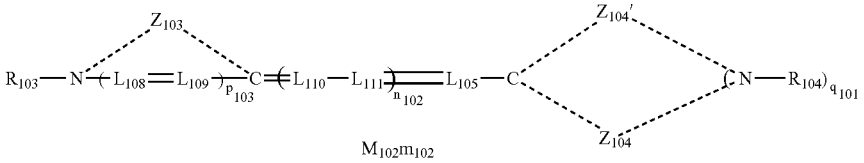

$M_{102}m_{102}$ wherein $L_{108}$, $L_{109}$, $L_{110}$ and $L_{111}$ each represents a methine group, $p_{103}$ represents 0 or 1, $q_{101}$ represents 0 or 1, $n_{102}$ represents 0, 1, 2, 3 or 4, $2Z_{103}$ represents an atomic group necessary for forming a nitrogen-containing heterocyclic ring, $Z_{104}$ and $Z_{104}'$ each represents an atomic group necessary for forming a ring or an acyclic acidic terminal group together with $(N—R_{104})_{q101}$, provided that $Z_{103}$, and $Z_{104}$ with $Z_{104}'$ each may be condensed with a ring or may have a substituent, $M_{102}$ represents an electric charge balancing counter ion, $M_{102}$ represents a number of 0 or more necessary for neutralizing the electric charge of the molecule, and $R_{103}$ and $R_{104}$ each represents a hydrogen atom, an alkyl group, an aryl group or a heterocyclic group;

Formula (D):

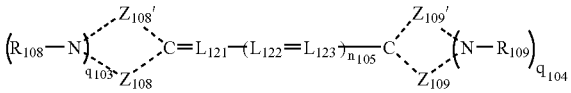

$M_{104}m_{104}$ wherein $L_{121}$, $L_{122}$ and $L_{123}$ each represents a methine group, $q_{103}$ and $q_{104}$ each represents 0 or 1, $n_{105}$ represents

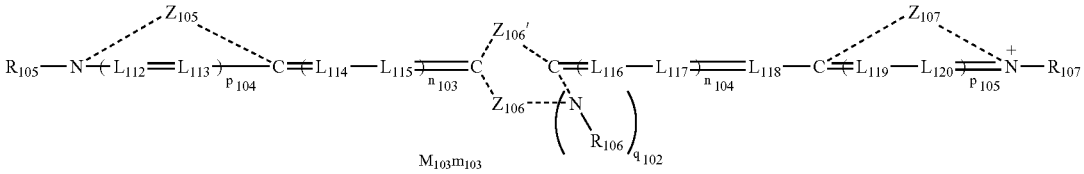

$M_{103}m_{103}$ wherein $L_{112}$, $L_{113}$, $L_{114}$, $L_{115}$, $L_{116}$, $L_{117}$, $L_{118}$, $L_{119}$ and $L_{120}$ each represents a methine group, $p_{104}$ and $p_{105}$ each represents 0 or 1, $q_{102}$ represents 0 or 1, $n_{103}$ and $n_{104}$ each represents 0, 1, 2, 3 or 4, $Z_{105}$ and $Z_{107}$ each represents an atomic group necessary for forming a nitrogen-containing heterocyclic ring, $Z_{106}$ and $Z_{106}'$ each represents an atomic group necessary for forming a ring together With $(N—R_{106})_{q102}$, provided that $Z_{105}$, $Z_{106}$ with $Z_{106}'$, and $Z_{107}$ each may be condensed with a ring or may have a substituent, $M_{103}$ represents an electric charge balancing counter ion, $m_{103}$ represents a number of 0 or more necessary for neutralizing the electric charge of the molecule, and $R_{105}$, $R_{106}$ and $R_{107}$ each represents a hydrogen atom, an alkyl group, an aryl group or a heterocyclic group; and 0, 1, 2, 3 or 4, $Z_{108}$ and $Z_{108}'$ each represents an atomic group necessary for forming a ring or an acyclic acidic terminal group together with $(N—R_{109})_{q104}$, provided that $Z_{108}$ with $Z_{108}'$, and $Z_{109}$ with $Z_{109}'$ each may be condensed with a ring or may have a substituent, $M_{104}$ represents an electric charge balancing counter ion, $m_{104}$ represents a number of 0 or more necessary for neutralizing the electric charge of the molecule, and $R_{108}$ and $R_{109}$ each represents a hydrogen atom, an alkyl group, an aryl group or a heterocyclic group.

The dye chromophores represented by formulae (A), (B), (C) and (D) are described in detail below.

$Z_{101}$, $Z_{102}$, $Z_{103}$, $Z_{105}$ and $Z_{107}$ each represents an atomic group necessary for forming a nitrogen-containing heterocyclic ring, preferably a 5- or 6-membered nitrogen-containing heterocyclic ring. However, these groups each may be condensed with a ring or may have a substituent. The ring may be either an aromatic ring or a non-aromatic ring or may be a hydrocarbon ring or a heterocyclic ring. The ring is preferably an aromatic ring and examples thereof include hydrocarbon aromatic rings such as benzene ring and naphthalene ring, and heteroaromatic rings such as pyrazine ring and thiophene ring. Examples of the substituent include W described above.

Specific examples of the nitrogen-containing heterocyclic ring include thiazoline nucleus, thiazole nucleus, benzothiazole nucleus, oxazoline nucleus, oxazole nucleus, benzoxazole nucleus, selenazoline nucleus, selenazole nucleus, benzoselenazole nucleus, tellurazoline nucleus, tellurazole nucleus, benzotellurazole nucleus, 3,3-dialkylindolenine nucleus (e.g., 3,3-dimethylindolenine), imidazoline nucleus, imidazole nucleus, benzimidazole nucleus, pyrroline nucleus, 2-pyridine nucleus, 4-pyridine nucleus, 2-quinoline nucleus, 4-quinoline nucleus, 1-isoquinoline nucleus, 3-isoquinoline nucleus, imidazo[4,5-b]quinoxaline nucleus, oxadiazole nucleus, thiadiazole nucleus, pyrazole nucleus, tetrazole nucleus and pyrimidine nucleus. Among these, preferred are benzothiazole nucleus, benzoxazole nucleus, 3,3-dialkylindolenine nucleus (e.g., 3,3-dimethylindolenine), benzimidazole nucleus, 2-pyridine nucleus, 4-pyridine nucleus, 2-quinoline nucleus, 4-quinoline nucleus, 1-isoquinoline nucleus and 3-isoquinoline nucleus.

These nuclei each may be substituted or condensed with a substituent or ring represented by W. The substituent or ring is preferably an alkyl group, an aryl group, an aromatic (preferably 5-membered) heterocyclic group, an alkoxy group, a halogen atom, an aromatic ring condensation, a sulfo group, a carboxyl group or a hydroxyl group.

Specific examples of the heterocyclic ring formed by $Z_{101}$, $Z_{102}$, $Z_{103}$, $Z_{105}$ and $Z_{107}$ include those described as examples of $Z_{11}$, $Z_{12}$, $Z_{13}$, $Z_{14}$ and $Z_{16}$ in U.S. Pat. No. 5,340,694, columns 23 to 24.

When the dye chromophore represented by formula (A), (B) or (C) is the dye chromophore in the first layer, $Z_{101}$, $Z_{102}$, $Z_{103}$, $Z_{105}$ and $Z_{107}$ each is preferably benzothiazole nucleus, benzoxazole nucleus, 3,3-dialkylindolenine nucleus (e.g., 3,3-dimethylindolenine) or benzimidazole nucleus, more preferably benzoxazole nucleus, benzothiazole nucleus or benzimidazole nucleus, still more preferably benzoxazole nucleus or benzothiazole nucleus. The substituent W on these nuclei is preferably a halogen atom, an aryl group, an aromaheterocyclic (preferably 5-membered) group or an aromatic ring condensation.

When the dye chromophore represented by formula (A), (B) or (C) is the dye chromophore in the second or upper layer, $Z_{101}$, $Z_{102}$, $Z_{103}$, $Z_{105}$ and $Z_{107}$ each is preferably benzothiazole nucleus, benzoxazole nucleus, 3,3-dialkylindolenine nucleus (e.g., 3,3-dimethylindolenine) or benzimidazole nucleus, more preferably benzoxazole nucleus, benzothiazole nucleus or benzimidazole nucleus, still more preferably benzoxazole nucleus or benzothiazole nucleus. The substituent W on these nuclei is preferably a halogen atom, an aryl group, an aromaheterocyclic (preferably 5-membered) group, an aromatic ring condensation or an acid radical, more preferably a halogen atom, an aryl group, an aromaheterocyclic (preferably 5-membered) group or an aromatic ring condensation, still more preferably a 5-membered aromaheterocyclic group. The 5-membered aromaheterocyclic group is preferably a furan ring, a thiophene ring or a pyrrole ring, more preferably a thiophene ring. Examples of the substituent or ring condensed include W described above. The substitution site is preferably 5-position.

The acid radial is described below. The acid radial is a group having a dissociative proton.

Specific examples thereof include a group from which a proton dissociates depending on the pKa thereof and the pH in the environment, such as sulfo group, carboxyl group, sulfato group, $—CONHSO_2$ group (e.g., sulfonylcarbamoyl group, carbonylsulfamoyl group), —CONHCO— group (e.g., carbonylcarbamoyl group), $—SO_2NHSO_2—$ group (e.g., sulfonylsulfamoyl group), sulfonamido group, sulfamoyl group, phosphato group, phosphono group, boronic acid group and phenolic hydroxyl group. A proton-dissociative acid radical capable of dissociating in 90% or more, for example, at a pH between 5 and 11 is preferred.

The acid radical is more preferably a sulfo group, a carboxyl group, a $—CONHSO_2—$ group, a —CONHCO— group or a $—SO_2NHSO_2—$ group, still more preferably a sulfo group or a carboxyl group, and most preferably a sulfo group.

Each of the trios $Z_{104}$, $Z_{104}'$ and $(N—R_{104})_{q101}$, $Z_{108}$, $Z_{108}'$ and $(N—R_{108})_{q103}$, and $Z_{109}$, $Z_{109}'$ and $(N—R_{109})_{q104}$ combine with each other to represent an atomic group necessary for forming a ring or an acyclic acidic terminal group. The ring may be any ring but is preferably a 5- or 6-membered heterocyclic ring, more preferably an acidic nucleus. The acidic nucleus and the acyclic acidic terminal group are described below. The acidic nucleus and the acyclic acidic terminal group may have any acidic nucleus or acyclic acidic terminal group form of general merocyanine dyes. In preferred forms, $Z_{104}$, $Z_{108}$ and $Z_{109}$ each is a thiocarbonyl group (including a thioester group, a thiocarbamoyl group and the like) represented by —(C═S)—, a carbonyl group (including an ester group, a carbamoyl group and the like) represented by —(C═O)—, a sulfonyl group (including a sulfonic acid ester group, a sulfamoyl group and the like) represented by $—(SO_2)—$, a sulfinyl group represented by —(S═O)— or a cyano group, more preferably a thiocarbonyl group or a carbonyl group. $Z_{104}'$, $Z_{108}'$ and $Z_{109}'$ each represents a remaining atomic group necessary for forming the acidic nucleus or acyclic acidic terminal group. Xn the case of forming an acyclic acidic terminal group, $Z_{104}'$, $Z_{108}'$ and $Z_{109}$ ' each is preferably a thiocarbonyl group, a carbonyl group, a sulfonyl group, a sulfinyl group or a cyano group. Also, an exomethylene structure where the carbonyl or thiocarbonyl group constituting the acidic nucleus or acyclic acidic terminal group is substituted at the active methylene position of an active methylene compound as a starting material of the acidic nucleus or acyclic acidic terminal group, and a structure where the exomethylene structure is repeated may be used. When the acidic nucleus is substituted by an acidic nucleus, a dye such as so-called trinuclear merocyanine or tetranuclear merocyanine is formed, and when the acidic terminal group is substituted by an acidic terminal group, examples of the structure include those having a dicyanomethylene group and a cyano group at the terminal.

$q_{101}$, $q_{103}$ and q104 each is 0 or 1, preferably 1.

The "acidic nucleus and acyclic acidic terminal group" as used herein are described, for example, in James (compiler), *The Theory of the Photographic Process,* 4th ed., pp. 197–200, Macmillan (1977). The acyclic acidic terminal group as used herein means an acidic, namely, electron-accepting terminal group which does not form a ring. Specific examples of the acidic nucleus and acyclic acidic terminal group include those described in U.S. Pat. Nos. 3,567,719, 3,575,869, 3,804,634, 3,837,862, 4,002,480 and 4,925,777, JP-A-3-167546, and U.S. Pat. Nos. 5,994,051 and 5,747,236.

The acidic nucleus preferably forms a heterocyclic ring (preferably a 5- or 6-membered nitrogen-containing heterocyclic ring) comprising carbon, nitrogen and/or chalcogen (typically oxygen, sulfur, selenium and tellurium) atoms, more preferably a 5- or 6-membered nitrogen-containing heterocyclic ring comprising carbon, nitrogen and/or chalcogen (typically oxygen, sulfur, selenium and tellurium) atoms. Specific examples thereof include the following nuclei:

nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]-pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]-quinazolone, pyrazolo[1,5-a]benzimidazole, pyrazolopyridone, 1,2,3, 4-tetrahydroquinoline-2,4-dione, 3-oxo-2,3-dihydrobenzo[d]thiophene-1,1-dioxide and 3-dicyanomethine-2,3-dihydrobenzo[d]thiophene-1,1-dioxide.

These acidic nuclei and acyclic acidic terminal groups each may be condensed with a ring or substituted by a substituent (for example, W described above).

Among those acidic nuclei, preferred are hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid and 2-thiobarbituric acid, more preferred are hydantoin, 2- or 4-thiohydantoin, 2-oxazolin-5-one, rhodanine, barbituric acid and 2-thiobarbituric acid.

In the case where the dye chromophore represented by formula (B) or (D) is the dye chromophore in the first layer, the acidic nucleus is particularly preferably 2- or 4-thiohydantoin, 2-oxazolin-5-one or rhodanine.

In the case where the dye chromophore represented by formula (B) or (D) is the dye chromophore in the second or upper layer, the acidic nucleus is particularly preferably a barbituric, acid.

The ring formed by $Z_{106}$, $Z_{106}$' and $(N—R_{106})_{q102}$ may be any ring but is preferably a heterocyclic ring (more preferably a 5- or 6-membered heterocyclic ring) and examples thereof are the same as those described above for the ring formed, for example, by $Z_{104}$, $Z_{104}$' and $(N—R_{104})_{q101}$. Among these, preferred are acidic nuclei described above with respect to the ring formed, for example, by $Z_{104}$, $Z_{104}$' and $(N—R_{104})_{q101}$, from which an oxo group or a thioxo group is removed.

More preferred are acidic nuclei described above as specific examples of the ring formed, for example, by $Z_{104}$, $Z_{104}$' and $(N—R_{104})_{q101}$, from which an oxo group or a thioxo group is removed, still more preferred are hydantoin, 2- or 4-thiohydantoin, 2-oxazolin-5-one, 2-thiooxazoline-2,4-dione, thiazolidine-2,4-dione, rhodanine, thiazolidine-2,4-dione, barbituric acid and 2-thiobarbituric acid, from which an oxo group or a thioxo group is removed, particularly preferred are hydantoin, 2- or 4-thiohydantoin, 2-oxazolin-5-one, rhodanine, barbituric acid and 2-thiobarbituric acid, from which an oxo group or a thioxo group is remove, and most preferred are 2- or 4-thiohydantoin, 2-oxazolin-5-one and rhodanine, from which an oxo group or a thioxo group is removed.

$q_{102}$ is 0 or 1, preferably 1.

$R_{101}$, $R_{102}$, $R_{103}$, $R_{104}$, $R_{105}$, $R_{106}$, $R_{107}$, $R_{108}$ and $R_{109}$ each represents a hydrogen atom, an alkyl group, an aryl group or a heterocyclic group, preferably an alkyl group, an aryl group or a heterocyclic group. Specific examples of the alkyl group, aryl group and heterocyclic group represented by $R_{101}$ to $R_{109}$ include an unsubstituted alkyl group preferably having from 1 to 18, more preferably from 1 to 7, still more preferably from 1 to 4, carbon atoms (e.g., methyl, ethyl, propyl, isopropyl, butyl, isobutyl, hexyl, octyl, dodecyl, octadecyl), a substituted alkyl group preferably having from 1 to 18, more preferably from 1 to 7, still more preferably from 1 to 4, carbon atoms {for example, an alkyl group substituted by the above-described substituent W, preferably an alkyl group having an acid radical described above; preferred examples thereof include an aralkyl group (e.g., benzyl, 2-phenylethyl, 2-(4-biphenyl)ethyl, 2-sulfobenzyl, 4-sulfobenzyl, 4-sulfophenethyl, 4-phosphobenzyl, 4-carboxybenzyl), an unsaturated hydrocarbon group (e.g., allyl, vinyl, that is, the substituted alkyl group as used herein includes an alkenyl group and an alkynyl group), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(4-biphenyloxy)ethyl, 2-(1-naphthoxy)ethyl, 2-(4-sulfophenoxy)ethyl, 2-(2-phosphophenoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl, 3-sulfophenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl, 3-phenyl-3-sulfopropyl, 4-phenyl-4-sulfobutyl, 3-(2-pyridyl)-3-sulfopropyl), a sulfoalkenyl group, a sulfatoalkyl group, (e.g., 2-sulfatoethyl, 3-sulfatopropyl, 4-sulfatobutyl), a heterocyclic ring-substituted alkyl group (e.g., 2-(pyrrolidin-2-on-1-yl)ethyl, 2-(2-pyridyl)ethyl, tetrahydrofurfuryl, 3-pyridiniopropyl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) an alkylsulfonylsulfamoylalkyl group (e.g., methane-sulfonylsulfamoylmethyl), an ammonioalkyl group (e.g., 3-(trimethylammonio)propyl, 3-ammoniopropyl), an aminoalkyl group (e.g., 3-aminopropyl, 3-(dimethylamino)propyl, 4-(methylamino)butyl) and a guanidinoalkyl group (e.g., 4-guanidinobutyl)}, an unsubstituted or substituted aryl group preferably having from 6 to 20, more preferably from 6 to 10, still more preferably from 6 to 8, carbon atoms (examples of the substituted aryl group include an aryl group substituted by the substituent W described above) (e.g., phenyl, 1-naphthyl, p-methoxyphenyl, p-methylphenyl, p-chlorophenyl, biphenyl, 4-sulfophenyl, 4-slfonaphthyl), and an unsubstituted or substituted heterocyclic group preferably having from 1 to 20, more preferably from 3 to 10, still more preferably from 4 to 8, carbon atoms (examples of the substituted heterocyclic group include a heterocyclic group substituted by the substituent W described above) (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyrimidyl, 4-sulfo-2-pyridyl).

In the case where the dye chromophore represented by formula (A), (B), (C) or (D) is the dye chromophore in the first layer, the substituents represented by $R_{101}$ to $R_{109}$ each is preferably an unsubstituted alkyl group or a substituted alkyl group. The substituted alkyl group is preferably an alkyl group having an acid radical described above. The acid radical is preferably a sulfo group, a carboxyl group, a —$CONHSO_2$— group, a —CONHCO— group or a —$SO_2NHSO_2$— group, more preferably a sulfo group or a carboxyl group, and most preferably a sulfo group.

In the case where the dye chromophore represented by formula (A), (B), (C) or (D) is the dye chromophore in the second or upper layer, the substituents represented by $R_{101}$ to $R_{109}$ each is preferably an unsubstituted alkyl group or a substituted alkyl group, more preferably an alkyl group having an acid radical described above or an alkyl group substituted by a group having a positive charge. The acid radical is preferably a sulfo group, a carboxyl group, a —$CONHSO_2$— group, a —CONHCO— group or a —$SO_2NHSO_2$— group, more preferably a sulfo group or a carboxyl group, and most preferably a sulfo group. The group having a positive charge is preferably an ammonio group (e.g., trimethylammonio, ammonio) or a guanidino group, more preferably an ammonio group. To speak specifically, the substituent is particularly preferably a Sulfoalkyl group (e.g., 2-sulfoethyl, 3-sulfopropyl, 3-sulfobutyl, 4-sulfobutyl), an ammonioalkyl group (e.g., 3-(trimethylammonio)propyl, 3-ammoniopropyl) or a guanidinoalkyl group (e.g., 4-guanidinobutyl).

$L_{101}$, $L_{102}$, $L_{103}$, $L_{104}$, $L_{105}$, $L_{106}$, $L_{107}$, $L_{108}$, $L_{109}$, $L_{110}$, $L_{111}$, $L_{112}$, $L_{113}$, $L_{114}$, $L_{115}$, $L_{116}$, $L_{117}$, $L_{118}$, $L_{119}$, $L_{120}$, $L_{121}$, $L_{122}$ and $L_{123}$ each independently represents a methine group. The methine group represented by $L_{101}$ to $L_{123}$ may have a substituent. Examples of the substituent include W described above, such as a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-dimethylbarbituric acid), a halogen atom (e.g., chlorine, bromine, iodine, fluorine), an alkoxy group having from 1 to 15, preferably from 1 to 10, more preferably from 1 to 5, carbon atoms (e.g., methoxy, ethoxy), an amino group having from 0 to 15, preferably from 2 to 10, more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, more preferably from 1 to 5, carbon atoms (e.g., methylthio, ethylthio) and an arylthio group having from 6. to 20, preferably from 6 to 12, more preferably from 6 to 10, carbon atoms (e.g., phenylthio, p-methylphenylthio). The methine group may form a ring together with another methine group or together with $Z_{101}$, $Z_{102}$, $Z_{103}$, $Z_{104}$, $Z_{105}$, $Z_{106}$, $Z_{107}$, $Z_{108}$, $Z_{109}$, $R_{101}$, $R_{102}$, $R_{103}$, $R_{104}$, $R_{105}$, $R_{106}$, $R_{107}$, $R_{108}$ or $R_{109}$.

$L_{101}$, $L_{102}$, $L_{106}$, $L_{107}$, $L_{108}$, $L_{109}$, $L_{112}$, $L_{113}$, $L_{119}$ and $L_{120}$ each is preferably an unsubstituted methine group.

$n_{101}$, $n_{102}$, $n_{103}$, $n_{104}$ and $n_{105}$ each independently represents 0, 1, 2, 3 or 4. $n_{101}$ to $n_{105}$ each is preferably 0, 1, 2 or 3, more preferably 0, 1 or 2, still more preferably 0 or 1. When $n_{101}$ to $n_{105}$ each is 2 or more, the methine group is repeated but these methine groups need not be the same.

$p_{101}$, $p_{102}$, $p_{103}$, $p_{104}$ and $p_{105}$ each independently represents 0 or 1, preferably 0.

$M_{101}$, $M_{102}$, $M_{103}$, $M_{104}$ and $M_b$ each is included in the formulae for the purpose of showing the presence of a cation or an anion when required for neutralizing the ion charge of the dye. Typical examples of the cation include inorganic cation such as hydrogen ion ($H^+$), alkali metal ion (e.g., sodium ion, potassium ion, lithium ion) and alkaline earth metal ion (e.g., calcium ion), and organic cation such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion and examples thereof include halogen anion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite the dye may be used. When the counter ion is hydrogen ion, $CO_2^-$ and $SO_3^-$ may be denoted as $CO_2H$ and $SO_3H$, respectively.

$m_{101}$, $m_{102}$, $m_{103}$, $m_{104}$ and $m_b$ each represents a number of 0 or more necessary for balancing the electric charge, preferably a number of 0 to 4, more preferably from 0 to 1, and is 0 when an inner salt is formed.

The dye for use in the present invention is particularly preferably a dye represented by the following formula (E):

Formula (E):

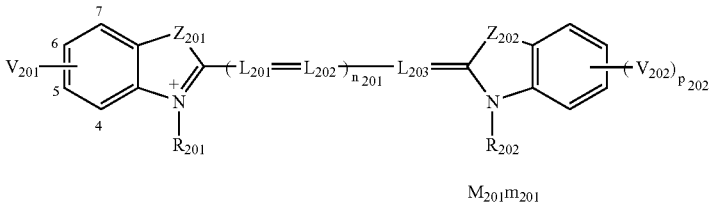

wherein $Z_{201}$ and $Z_{202}$ each represents an oxygen atom, a sulfur atom, a selenium atom or a nitrogen atom, $V_{201}$ represents a 5-membered aromaheterocyclic ring, $V_{202}$ represents a substituent, $P_{202}$ represents 0, 1, 2, 3 or 4, $R_{201}$ and $R_{202}$ each represents an alkyl group, an aryl group or a heterocyclic group, $L_{201}$, $L_{202}$ and $L_{203}$ each represents a methine group, $n_{201}$ represents 0 or 1, $M_{201}$ represents an electric charge balancing counter ion, and $m_{201}$ represents a number of 0 to more necessary for neutralizing the electric charge of the molecule.

Formula (E) is described in detail below. $Z_{201}$ and $Z_{202}$ each represents an oxygen atom, a sulfur atom, a selenium atom or a nitrogen atom (N—$R_{203}$), preferably an oxygen atom, a sulfur atom or a nitrogen atom, more preferably an oxygen atom or a sulfur atom, still more preferably a sulfur atom. $R_{203}$ represents a hydrogen atom, an alkyl group, an aryl group or a heterocyclic group. Examples thereof include those described above for $R_{101}$ and preferred examples are also the same. $R_{203}$ is most preferably methyl or ethyl.

$V_{201}$ represents a 5-membered aromaheterocyclic ring and the ring may be further substituted or may be condensed with a ring. Specific examples thereof include the aromaheterocyclic rings described above for W. Among these, preferred are a furan ring, a thiophene ring and a pyrrole ring, more preferred is a thiophene ring. Examples of the substituent or ring condensed include W described above. The substitution site of $V_{201}$ is preferably 5-position. The substituent $V_{202}$ may be any substituent but preferred examples thereof include W described above. Also, two or more substituents may form a ring in cooperation. $V_{202}$ is preferably a halogen atom, an aromatic group, an aromaheterocyclic (preferably 5-membered) group or an aromatic ring condensation, more preferably an aromatic group, an aromaheterocyclic (preferably 5-membered) group or an aromatic ring condensation, still more preferably a 5-membered aromaheterocyclic group. The 5-membered aromaheterocyclic group is preferably a furan ring, a thiophene ring or a pyrrole ring, more preferably a thiophene ring. Examples of the substituent or ring condensed include W described above. The substitution site of $V_{201}$ is preferably 5-position. $P_{202}$ is preferably 1 or 2, more preferably 1.

$R_{201}$ and $R_{202}$ each represents an alkyl group, an aryl group or a heterocyclic group. Examples thereof include those described above for $R_{101}$, and preferred examples are also the same. $R_{201}$ and $R_{202}$ each is more preferably an unsubstituted alkyl group, an alkyl group substituted by an acid radical or an alkyl group substituted by a group having a positive charge. The acid radical is preferably a sulfo group, a carboxyl group, a —$CONHSO_2$— group, a —CONHCO— group or a —$SO_2NHSO_2$— group, more preferably a sulfo group or a carboxyl group, and most preferably a sulfo group.

The group having a positive charge is preferably an ammonio group (e.g., trimethylammonio, ammonio) or a guanidino group, more preferably an ammonio group. To speak specifically, $R_{201}$ and $R_{202}$ each is particularly preferably a sulfoalkyl group (e.g., 2-sulfoethyl, 3-sulfopropyl, 3-sulfobutyl, 4-sulfobutyl), an ammonioalkyl group (e.g., 3-(trimethylammonio)propyl, 3-ammoniopropyl) or a guanidinoalkyl group (e.g., 4-guanidinobutyl).

$L_{201}$, $L_{202}$ and $L_{203}$ each represents a methine group. Examples thereof include those described above for $L_{103}$, $L_{104}$ and $L_{105}$. $L_{201}$ and $L_{203}$ each is preferably an unsubstituted methine group. $L_{202}$ is preferably a methine group substituted by an unsubstituted alkyl group (preferably ethyl). $n_{201}$ represents 0 or 1, preferably 1. $M_{201}$ represents an electric charge balancing counter ion and examples thereof include those described above for $M_{101}$. $m_{201}$ represents a number of 0 or more necessary for neutralizing the electric charge of the molecule, preferably a number of 0 to 4.

Specific examples of the dye which is particularly preferably used in the present invention are set forth below of course, the present invention is not limited thereto.

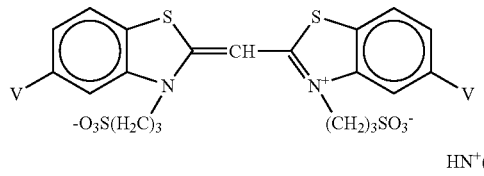

(E-1)

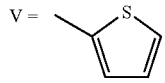

(E-2)

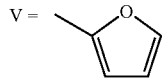

(E-3)

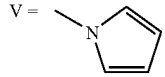

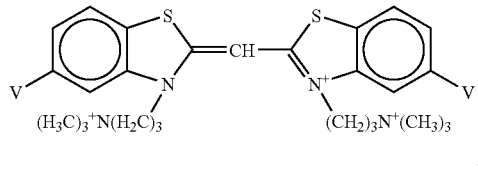

(E-4)

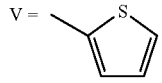

(E-5)

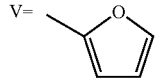

(E-6)

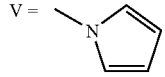

(E-7)

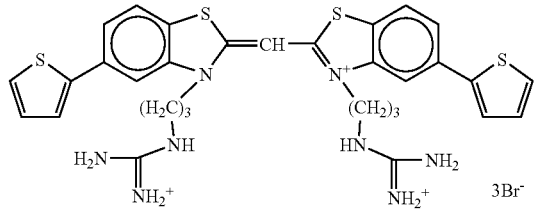

(E-8)

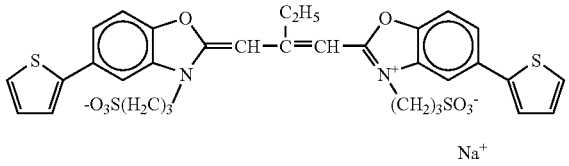

-continued (E-9)

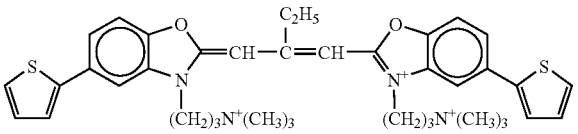

3Br⁻

(E-10)

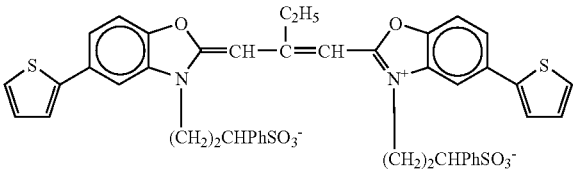

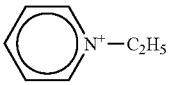

(E-11)

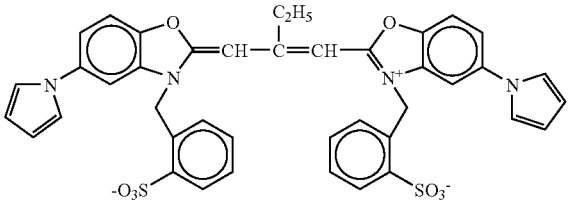

$HN^+(C_2H_5)_3$ (E-12)

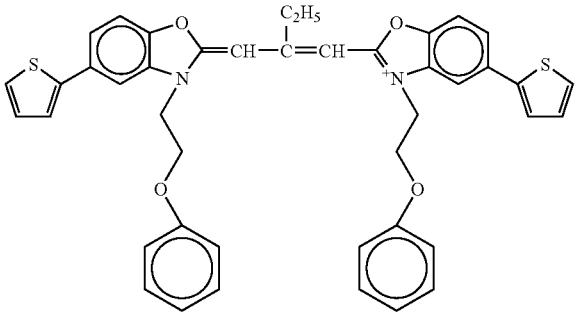

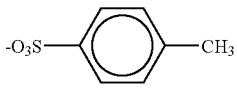

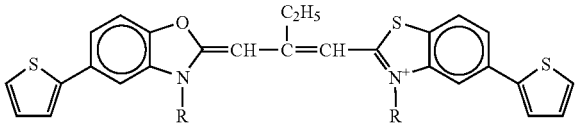

(E-13) R = $(CH_2)_3SO_3^-$, M = $Na^+$
(E-14) R = $(CH_2)_3N^+(CH_3)_3$, M = $3Br^-$

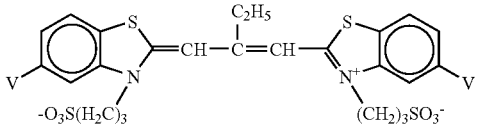

$Na^+$

-continued (E-15)

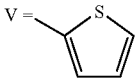

(E-16)

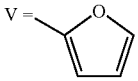

(E-17)

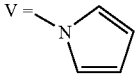

(E-18)

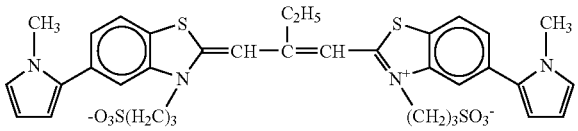

$HN^+(C_2H_5)_3$

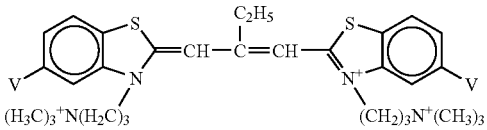

$3Br^-$ (E-19)

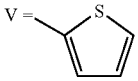

(E-20)

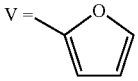

(E-21)

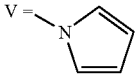

In the present invention, the dye represented by the general formula (F) is more preferably used.

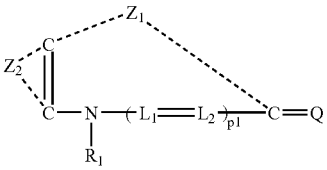

M1m1 wherein $Z_1$ represents an atomic group necessary for forming a nitorgen-containing 5- or 6-membered heterocyclic ring, $Z_2$ represents an atomic group necessary for forming aromatic ring or aliphatic ring, and necessary for forming a 4 membered or more multi-cyclic condensed ring together with the nitorgen-containing 5- or 6-membered heterocyclic ring formed by $Z_1$, Q represents a group necessary for forming a methine dye as the compound represented by the formula (F) forms a methine dye, $R_1$ represents an alkyl group, an aryl group or a heterocyclic group, each of which is substitued by one of an acidic group and a group having a positive electric charge, $L_1$ and $L_2$ each represents a methine group, p1 represents 0 or 1, $M_1$ represents an electric charge balancing counter ion, and $m_1$ represents a number of 0 to more, necessary for neutralizing the electric charge of the molecule.

The dye represeted by the general formula (F) is still more preferably the dye represeted by the general formula (F1).

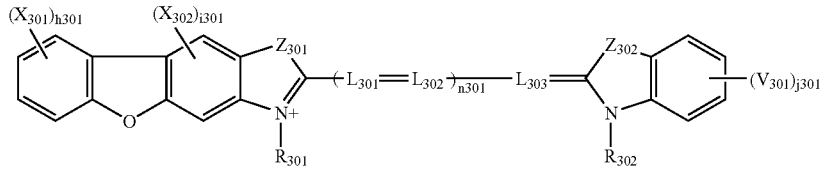

$M_{301}m_{301}$ wherein $Z_{301}$ and $Z_{302}$ each represents an oxygen atom, a sulfur atom, a selenium atom or a nitrogen atom, $X_{301}$ and $X_{302}$ each represents a substituent of the dibenzofuran ring, $V_{301}$ represents a substituent, $R_{301}$ represents an alkyl group, an aryl group or a heterocyclic group, each of which is substitued by one of an acidic group and a group having a positive electric charge is substitued, $L_{301}$, $L_{302}$ and $L_{303}$ each represents a methine group, n301 represents 0 or 1, h301 represents 0, 1, 2, 3 or 4, i301 represents 0, 1 or 2, j301 represents 0, 1, 2, 3 or 4, $M_{301}$ represents an electric charge balancing counter ion, and $m_{301}$ represents a number of 0 to more, necessary for neutralizing the electric charge of the molecule.

The general formulae (F) and (F1) will be further described hereinafter.

The general formula (F) can form any methine dye depending on the structure of Q. Preferred examples of the methine dye of the general formula (F) include methine dye chromophores such as cyanine dye, styryl dye, hemicyanine dye, melocyanine dye, trinuclear melocyanine dye, tetranuclear melocyanine dye, rhodacyanine dye, alopolar dye, oxonol dye, hemioxonol dye, squarium dye and croconium dye. Preferred among these methine dye chromophores are cyanine dye, melocyanine dye, trinuclear melocyanine dye, tetranuclear melocyanine dye, rhodacyanine dye, and oxonol dye. Even more desirable among these methine dye chromophores are cyanine dye, melocyanine dye, rhodacyanine dye, and oxonol dye. Particularly preferred among these methine dye chromophores are cyanine dye, and melocyanine dye. Most desirable among these methine dye chromophores is cyanine dye.

For the details of these dyes, reference can be made to Dye Reference [2] cited above.

In the case where a cyanine dye is formed by Q or other cases, the general formula (F) can be represented by the following resonance formula:

M1m1

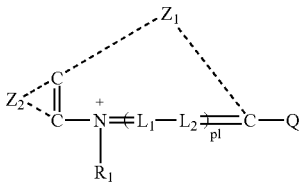

The general formula (F) of the invention preferably forms a cyanine dye or melocyanine dye, more preferably a cyanine dye.

$Z_1$ represents an atomic group required to form a 5- or 6-membered nitrogen-containing heterocyclic group. Examples of such a 5- or 6-membered nitrogen-containing heterocyclic group include thiazole nucleus, oxazole nucleus, selenazole nucleus, 3H-pyrrole nucleus (e.g., 3,3-dialkyl-3H-pyrrole nucleus), imidazole nucleus, 2-pyridine nucleus, and 4-pyridine nucleus. Preferred among these 5- or 6-membered nitrogen-containing heterocyclic groups are thiazole nucleus, oxazole nucleus, and imidazole nucleus. Particularly preferred among these 5- or 6-membered nitrogen-containing heterocyclic groups are thiazole nucleus and oxazole nucleus.

These nuclei may be substituted by or condensed with the substituents represented by W and rings. Preferred examples of these substituents and rings include alkyl group, aryl group, alkoxy group, halogen atom, and benzene ring. Even more desirable among these substituents and rings are methyl group, phenyl group, methoxy group, chlorine atom bromine atom, iodine atom, and benzene ring.

$Z_2$ represents an atomic group required to form an aliphatic or aromatic cyclic compound or an atomic group required to have a tetracyclic or higher polycyclic condensed structure, including nitrogen-containing heterocyclic groups formed by $Z_1$. Examples of the cyclic structure formed by $Z_2$ include aliphatic cyclic structures having an unsubstituted tricyclic or higher polycyclic condensed structure, aliphatic cyclic structures having a substituted tricyclic or higher polycyclic condensed structure (Examples of the substituents include those listed above as examples of the substituents W), aromatic cyclic structures having an unsubstituted tricyclic or higher polycyclic condensed structure (e.g., azlene, anthracene, phenanthrene), aromatic cyclic structures having a substituted tricyclic or higher polycyclic condensed structure (Examples of the substituents include those listed above as examples of the substituents W), heterocyclic groups having an unsubstituted tricyclic or higher polycyclic condensed structure, heterocyclic groups having a substituted tricyclic or higher polycyclic condensed structure (Examples of the substituents include those listed above as examples of the substituents W), and those having a tricyclic or higher polycyclic condensed structure obtained by the condensation of any three or more of aliphatic cyclic structures, aromatic cyclic structures and heterocyclic groups (e.g., dibenzofurane, dibenzothiophene, carbazole, coumarone, coumarine, phenoxathine, xanthene, thianthrene). These cyclic structures may be further substituted by the substituents W or the like.

Preferred examples of the cyclic structure formed by $Z_2$ include aromatic cyclic structures having an unsubstituted tricyclic or higher polycyclic condensed structure (e.g.,. azlene, anthracene, phenanthrene), aromatic cyclic structures having a substituted tricyclic or higher polycyclic condensed structure, and those having a tricyclic or higher polycyclic condensed structure obtained by the condensation of any three or more of aliphatic cyclic structures, aromatic cyclic structures and heterocyclic groups (e.g., dibenzofurane, dibenzothiophene, carbazole, coumarone, coumarine, phenoxathine, xanthene, thianthrene, those obtained by substituting these groups). Even more desirable among these cyclic structures are anthracene, dibenzofurane, dibenzothiophene, and carbazole. Particularly preferred among these cyclic structures is dibenzofurane.

R1 is an alkyl, aryl or heterocyclic group substituted by an acid group or a group having a positive charge.

The acid group is a group having a dissociative proton. Specific examples of such a group include groups which undergo dissociation of proton at some pKa and ambient pH values such as sulfo group, carboxyl group, sulfato group, —$CONHSO_2$— group (sulfonylcarbamoyl group, carbonylsulfamoyl group), —CONHCO— group (carbonylcarbamoyl group), —$SO_2NHSO_2$— group (sulfonylsulfamoyl group), sulfonamide group, sulfamoyl group, phosphato group, phosphono group, boronic acid group and phenolic hydroxyl group. For example, proton-dissociative acid groups which can undergo dissociation by 90% or more at a pH value of from 5 to 11. Even more desirable among these groups are sulfo group, carboxyl group, —$CONHSO_2$— group, —CONHCO— group, and —$SO_2NHSO_2$— group. Particularly preferred among these groups are sulfo group, and carboxyl group. Most desirable among these groups is sulfo group.

Examples of the group having a positive charge include ammonio group (e.g., trimethylammonio, ammonio), guanidino group, group containing a salt of nitrogen-containing aromatic heterocyclic group (e.g., pyridinium group, N-methlpyridinium group, imidazolium group), phosphonium group (e.g., trimethylphosphonium), arsonium group (e.g., trimethylarsonium), sulfonium group (e.g., dimethyl sulfonium), selenonium group (e.g., dimethyl selenonium), and telluronium group (e.g., dimethyl telluronium). Preferred among these groups are ammonio group, guanidino group, and group containing a salt of nitrogen-containing aromatic heterocyclic group. Even more desirable among these groups are ammonio group, and guanidino group. Particularly preferred among these groups is ammonio group.

Specific examples of the alkyl group, aryl group and heterocyclic group substituted by an acid group or a group having a positive charge represented by $R_1$ include substituted alkyl group having preferably from 1 to 18, more preferably from 1 to 7, particularly from 1 to 4 carbon atoms [Preferred examples include aralkyl group (e.g., 2-sulfobenzyl, 4-sulfobenzyl, 4-sulfophenethyl, 4-phosphobenzyl, 4-carboxybenzyl, 4-trimethylammonio benzyl), carboxyalkyl group (e.g., 2-carboxyethyl, 3-carboxypropyl, 4-carboxybutyl, carboxymethyl), aryloxyalkyl group (e.g., 2-(4-sulfophenoxy)ethyl, 2-(2-phosphophenoxy)ethyl), aryloxycarbonylalkyl group (e.g., 3-sulfosulfamoylmethyl), sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl, 3-phenyl-3-sulfopropyl, 4-phenyl-4-sulfobutyl, 3-(2-pyridyl)-3-sulfopropyl), sulfoalkenyl group, sulfatoalkyl group (e.g., 2-sulfatoethyl group, 3-sulfatopropyl, 4-sulfantobutyl), heterocyclic substituted alkyl group (e.g., 3-pyridinipropyl), alkyl sulfonylcarbamoylalkyl group (e.g., methanesulfonyl carbamoylmethyl group), acylcarbamoylalkyl group (e.g., acetylcarbamaoylmethyl group), acylsulfamoylalkyl group (e.g., acetylsulfamoylmethyl group), alkylsulfonyl sulfamoylalkyl group (e.g., methanesulfonyl sulfamoylmethyl group), ammonioalkyl group (e.g., 3-(trimethylammonio) propyl, 3-ammoniopropyl), aminoalkyl group (e.g., 3-aminopropyl, 3-(dimethylamino)propyl, 4-(methylamino) butyl), and guanidinoalkyl group (e.g., 4-guanidinobutyl)], substituted aryl group having preferably from 6 to 20, more preferably from 6 to 10, particularly from 6 to 8 carbon atoms (e.g., 4-sulfophenyl, 4-sulfonaphthyl, 4-trimethylammonio phenyl), and substituted heterocyclic group having preferably from 1 to 20, more preferably from 3 to 10, particularly from 4 to 8 carbon atoms (e.g., 4-sulfo-2-pyridyl). Preferred among these groups are sulfoalkyl group, ammonioalkyl group, and guanidinoalkyl group.

$L_1$ and $L_2$ each independently represent a methine group. Examples of the methine group represented by $L_1$ and $L_2$ include those listed above with reference to $L_{101}$, and $L_{102}$. $L_1$ and $L_2$ each are preferably one of these methine groups, more preferably unsubstituted methine group.

The suffix $p_1$ represents an integer of 0 or 1, preferably 0.

Examples of M1 and m1 include those listed above with reference to $M_{101}$, and $m_{101}$. M1 and m1 each are one of these groups.

The general formula (F1) will be further described hereinafter. Z301 and Z303 each represent an oxygen atom, sulfur atom, selenium atom or nitrogen atom, preferably oxygen atom, sulfur atom or nitrogen atom, more preferably oxygen atom or sulfur atom.

$X_{301}$ and $X_{302}$ each represent any substituent on dibenzofurane ring. Specific examples of such a substituent include those listed above with reference to W. Preferred among these substituents are alkyl group, aryl group, heterocyclic group, halogen atom, and alkoxy group, more preferably methyl group, ethyl group, phenyl group, methoxy group, chlorine atom, bromine atom.

$V_{301}$ may be arbitrary but is preferably W as described above. Two or more of $V_{301}$'s may together form a ring. Preferred examples of $V_{301}$ include halogen atom, alkyl group, alkoxy group, aromatic group, aromatic heterocyclic group (preferably having 5 members), and aromatic condensed ring. However, if the aromatic rings are condensed, it is disadvantageous in that the resulting dye has too low a solubility. In particular, the condensation of the dibenzofurane rings is disadvantageous.

$V_{301}$ is more preferably a halogen atom, alkoxy group, aromatic group or aromatic heterocyclic group (preferably having 5 members), even more preferably a halogen atom or 5-membered aromatic heterocyclic group, particularly 5-membered aromatic heterocyclic group. Preferred examples of the 5-membered aromatic heterocyclic group include furane ring, thiophene ring, and pyrrole ring. Even more desirable among these 5-membered aromatic heterocyclic groups is pyrrole ring. The position at which $V_{301}$ substitutes on the benzene ring is preferably 5-position.

Examples of $R_{301}$, include those listed above with reference to $R_1$. $R_{301}$ is preferably one of these groups. $R_{301}$ is more preferably an ammonioalkyl group or guanidinoalkyl group, even more preferably guanidinoalkyl group. Examples of $R_{302}$ include those listed above with reference to $R_{101}$. $R_{302}$ is preferably the same as R1, more preferably ammonioalkyl group or guanidinoalkyl group, even more preferably guanidinoalkyl group.

$L_{301}$, $L_{302}$ and $L_{303}$ each represent a methine group. Examples of the methine group represented by $L_{301}$, $L_{302}$ or $L_{303}$ include those listed above with reference to $L_{103}$, $L_{104}$ and $L_{105}$. $L_{301}$ and $L_{303}$ each are preferably an unsubstituted methine group. $L_{302}$ is preferably a methine group represented by an unsubstituted alkyl group (preferably ethyl). The suffix $n_{301}$ represents an integer of 0 or 1, preferably 1. The suffix h301 represents an integer of 0 to 4, preferably 0 or 1, more preferably 0. The suffix $i_{301}$ represents an integer of 0 to 2, preferably 0. The suffix $j_{301}$ represents an integer of 0 to 4, preferably 1 or 2, more preferably 1. $M_{301}$ represents a charge-balanced counter ion. Examples of the charge-balanced counter ion include those listed above with reference to $M_{101}$. The suffix m301 represents a number of 0 or more required to neutralize the charge of the molecule, preferably 0 to 4.

Specific examples of the dye represented by the general formula (F) or (F1) which is preferably used in the invention will be given below. Of course, the invention is not limited to these examples.

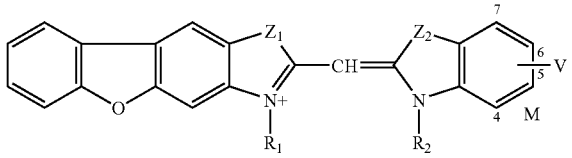

| No. | $Z_1$, $Z_2$ | $R_1$ | $R_2$ | V | M |
|---|---|---|---|---|---|
| F-1 | O, S | —$(CH_2)_3SO_3$– | —$(CH_2)_3SO_3$– | 5-Cl | TEAH+ |
| F-2 | O, S | —$(CH_2)_3SO_3$– | —$(CH_2)_3SO_3$– | 5-Br | TEAH+ |
| F-3 | O, S | —$(CH_2)_3SO_3$– | —$(CH_2)_3SO_3$–– | 5-I | TEAH+ |
| F-4 | O, S | —$(CH_2)_3SO_3$– | —$(CH_2)_3SO_3$– | 5-Ph | TEAH+ |
| F-5 | O, S | —$(CH_2)_3SO_3$– | —$(CH_2)_3SO_3$– | 5,6-diCl | TEAH+ |
| F-6 | O, S | —$(CH_2)_3SO_3$– | —$(CH_2)_3SO_3$– | 5-(2-thienyl) | TEAH+ |
| F-7 | O, S | —$(CH_2)_3SO_3$– | —$(CH_2)_3SO_3$– | 5-(2-furyl) | TEAH+ |
| F-8 | O, S | —$(CH_2)_3SO_3$– | —$(CH_2)_3SO_3$– | 5-(1-pyrrolyl) | TEAH+ |
| F-9 | O, S | —$(CH_2)_3SO_3$– | —$(CH_2)_3SO_3$– | 4,5-benzo | TEAH+ |
| F-10 | O, S | —$(CH_2)_3SO_3$– | —$(CH_2)_3SO_3$– | 5,6-benzo | TEAH+ |
| F-11 | O, S | —$(CH_2)_3SO_3$– | —$(CH_2)_3SO_3$– | 6,7-benzo | TEAH+ |
| F-12 | O, S | —$(CH_2)_3SO_3$– | —$(CH_2)_3SO_3$– | 5-$CH_3$ | TEAH+ |
| F-13 | O, S | —$(CH_2)_3SO_3$–– | —$(CH_2)_3SO_3$– | 5,6-di$CH_3$ | TEAH+ |
| F-14 | O, S | —$(CH_2)_3SO_3$– | —$(CH_2)_3SO_3$– | 5-$OCH_3$ | TEAH+ |
| F-15 | O, S | —$(CH_2)_3SO_3$– | —$(CH_2)_3SO_3$– | 5,6-di$OCH_3$ | TEAH+ |
| F-16 | O, S | —$(CH_2)_3SO_3$– | —$(CH_2)_3SO_3$– | 5-OH | TEAH+ |
| F-17 | O, S | —$(CH_2)_3SO_3$– | —$(CH_2)_3SO_3$– | 5-$CO_2H$ | TEAH+ |
| F-18 | O, S | —$(CH_2)_2CH(CH_3)SO_3$– | —$(CH_2)_2CH(CH_3)SO_3$– | 5-Cl | TEAH+ |
| F-19 | O, O | —$(CH_2)_4SO_3$– | —$(CH_2)_4SO_3$– | 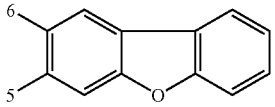 | TEAH+ |
| F-20 | O, O | —$(CH_2)_3SO_3$– | —$(CH_2)_3SO_3$– | 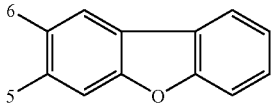 | TEAH+ |
| F-21 | S, S | —$(CH_2)_3SO_3$– | —$(CH_2)_3SO_3$– | 5-Cl | TEAH+ |
| F-22 | S, O | —$(CH_2)_3SO_3$– | —$(CH_2)_3SO_3$– | 5-Ph | TEAH+ |
| F-23 | O, O | —$(CH_2)_3SO_3$– | —$(CH_2)_3SO_3$– | 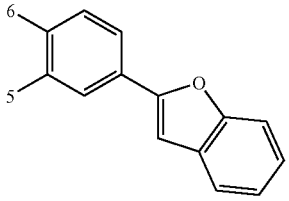 | TEAH+ |
| F-24 | O, O | —$(CH_2)_3SO_3$– | —$(CH_2)_3SO_3$– | 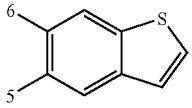 | TEAH+ |

-continued

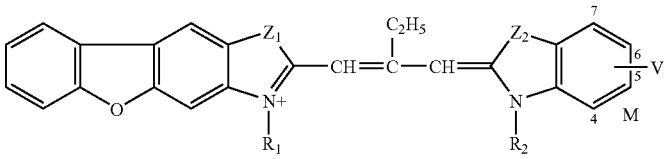

| No. | $Z_1$, $Z_2$ | $R_1$ | $R_2$ | V | M |
|---|---|---|---|---|---|
| F-25 | O, S | —$(CH_2)_3SO_3$– | —$(CH_2)_3SO_3$– | 5-Cl | Na+ |
| F-26 | O, S | —$(CH_2)_3SO_3$– | —$(CH_2)_3SO_3$– | 5-Br | TEAH+ |
| F-27 | O, S | —$(CH_2)_3SO_3$– | —$(CH_2)_3SO_3$–– | 5-I | TEAH+ |
| F-28 | O, S | —$(CH_2)_3SO_3$– | —$(CH_2)_3SO_3$– | 5-Ph | TEAH+ |
| F-29 | O, S | —$(CH_2)_3SO_3$– | —$(CH_2)_3SO_3$– | 5,6-diCl | TEAH+ |
| F-30 | O, S | —$(CH_2)_3SO_3$– | —$(CH_2)_3SO_3$– | 5-(2-thienyl) | TEAH+ |
| F-31 | O, S | —$(CH_2)_3SO_3$– | —$(CH_2)_3SO_3$– | 5-(2-furyl) | TEAH+ |
| F-32 | O, S | —$(CH_2)_3SO_3$– | —$(CH_2)_3SO_3$– | 5-(1-pyrrolyl) | TEAH+ |
| F-33 | O, S | —$(CH_2)_3SO_3$– | —$(CH_2)_3SO_3$– | 4,5-benzo | TEAH+ |
| F-34 | O, S | —$(CH_2)_4SO_3$– | —$(CH_2)_3SO_3$– | 5,6-benzo | K+ |
| F-35 | O, S | —$(CH_2)_3SO_3$– | —$(CH_2)_2SO_3$– | 6,7-benzo | TEAH+ |
| F-36 | O, S | —$(CH_2)_3SO_3$– | —$(CH_2)_3SO_3$– | 5-$CH_3$ | TEAH+ |
| F-37 | O, S | —$(CH_2)_3SO_3$–– | —$(CH_2)_3SO_3$– | 5,6-di$CH_3$ | TEAH+ |
| F-38 | O, S | —$(CH_2)_3SO_3$– | —$(CH_2)_3SO_3$– | 5-$OCH_3$ | TEAH+ |
| F-39 | O, S | —$(CH_2)_3SO_3$– | —$(CH_2)_3SO_3$– | 5,6-di$OCH_3$ | TEAH+ |
| F-40 | O, S | —$(CH_2)_3SO_3$– | —$(CH_2)_3SO_3$– | 5-OH | TEAH+ |
| F-41 | O, S | —$(CH_2)_3SO_3$– | —$(CH_2)_3SO_3$– | 5-$CO_2H$ | TEAH+ |
| F-42 | O, S | —$(CH_2)_2CH(CH_3)SO_3$– | —$(CH_2)_2CH(CH_3)SO_3$– | 5-Cl | TEAH+ |
| F-43 | O, O | —$(CH_2)_4SO_3$– | —$(CH_2)_4SO_3$– | 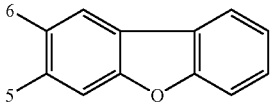 | K+ |
| F-44 | O, O | —$(CH_2)_3SO_3$– | —$(CH_2)_3SO_3$– | 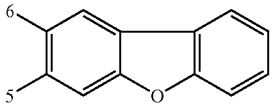 | K+ |
| F-45 | S, S | —$(CH_2)_3SO_3$– | —$(CH_2)_3SO_3$– | 5-Cl | TEAH+ |
| F-46 | S, O | —$(CH_2)_3SO_3$– | —$(CH_2)_3SO_3$– | 5-Ph | TEAH+ |
| F-47 | O, O | —$(CH_2)_3SO_3$– | —$(CH_2)_3SO_3$– | 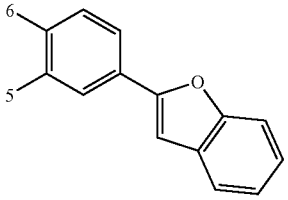 | TEAH+ |
| F-48 | O, O | —$(CH_2)_3SO_3$– | —$(CH_2)_3SO_3$– | 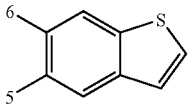 | TEAH+ |
| F-49 | S, S | —$(CH_2)_3SO_3$– | —$(CH_2)_3SO_3$– | 5-Br | TEAH+ |
| F-50 | S, S | —$(CH_2)_3SO_3$– | —$(CH_2)_3SO_3$– | 5-I | TEAH+ |
| F-51 | S, S | —$(CH_2)_3SO_3$– | —$(CH_2)_3SO_3$–– | 5-Ph | TEAH+ |
| F-52 | S, S | —$(CH_2)_3SO_3$– | —$(CH_2)_3SO_3$– | 5,6-diCl | TEAH+ |
| F-53 | S, S | —$(CH_2)_3SO_3$– | —$(CH_2)_3SO_3$– | 5-(2-thienyl) | TEAH+ |
| F-54 | S, S | —$(CH_2)_3SO_3$– | —$(CH_2)_3SO_3$– | 5-(2-furyl) | TEAH+ |
| F-55 | S, S | —$(CH_2)_3SO_3$– | —$(CH_2)_3SO_3$– | 5-(1-pyrrolyl) | TEAH+ |
| F-56 | S, S | —$(CH_2)_3SO_3$– | —$(CH_2)_3SO_3$– | 4,5-benzo | TEAH+ |
| F-57 | S, O | —$(CH_2)_3SO_3$– | —$(CH_2)_3SO_3$– | 5-Cl | TEAH+ |
| F-58 | S, O | —$(CH_2)_2CH(Ph)SO_3$– | —$(CH_2)_2CH(Ph)SO_3$– | 5-Br | TEAH+ |
| F-59 | S, O | —$(CH_2)_3SO_3$– | —$(CH_2)_3SO_3$– | 5-I | TEAH+ |
| F-60 | S, O | —$(CH_2)_3SO_3$– | —$(CH_2)_3SO_3$– | 5,6-diCl | TEAH+ |
| F-61 | S, O | —$(CH_2)_3SO_3$–– | —$(CH_2)_3SO_3$– | 5-(2-thienyl) | TEAH+ |
| F-62 | S, O | —$(CH_2)_3SO_3$– | —$(CH_2)_3SO_3$– | 5-(2-furyl) | TEAH+ |
| F-63 | S, O | —$(CH_2)_3SO_3$– | —$(CH_2)_3SO_3$– | 5-(1-pyrrolyl) | TEAH+ |
| F-64 | S, O | —$(CH_2)_3SO_3$– | —$(CH_2)_3SO_3$– | 4,5-benzo | TEAH+ |

-continued

| | | | | | |
|---|---|---|---|---|---|
| F-65 | S, S | —$(CH_2)_3SO_3$– | —$(CH_2)_3SO_3$– | 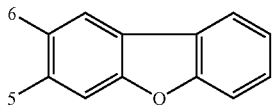 | TEAH+ |
| F-66 | O, S | —$(CH_2)_3SO_3$– | —$(CH_2)_3SO_3$– | 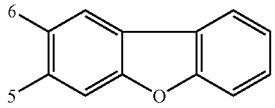 | TEAH+ |
| F-67 | O, O | —$(CH_2)_3SO_3$– | —$(CH_2)_3SO_3$– | 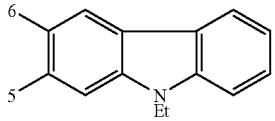 | TEAH+ |

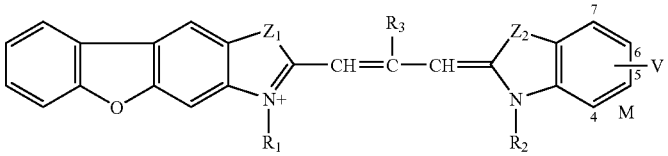

| No. | $Z_1$, $Z_2$ | $R_1$ | $R_2$ | $R_3$ | V | M |
|---|---|---|---|---|---|---|
| F-68 | NEt, S | —$(CH_2)_3SO_3$– | —$(CH_2)_3SO_3$– | —H | 5-Cl | TEAH+ |
| F-69 | NEt, S | —$(CH_2)_3SO_3$– | —$(CH_2)_3SO_3$– | —H | 5-Br | TEAH+ |
| F-70 | NEt, S | —$(CH_2)_3SO_3$– | —$(CH_2)_3SO_3$-- | —H | 5-I | TEAH+ |
| F-71 | NEt, S | —$(CH_2)_3SO_3$– | —$(CH_2)_3SO_3$– | —H | 5,6-diCl | TEAH+ |
| F-72 | NEt, S | —$(CH_2)_3SO_3$– | —$(CH_2)_3SO_3$– | —H | 5-(2-thienyl) | TEAH+ |
| F-73 | NEt, S | —$(CH_2)_3SO_3$– | —$(CH_2)_3SO_3$– | —H | 5-(2-furyl) | TEAH+ |
| F-74 | NEt, S | —$(CH_2)_3SO_3$– | —$(CH_2)_3SO_3$– | —H | 5-(1-pyrrolyl) | TEAH+ |
| F-75 | NEt, S | —$(CH_2)_3SO_3$– | —$(CH_2)_3SO_3$– | —H | 4,5-benzo | TEAH+ |
| F-76 | NEt, S | —$(CH_2)_3SO_3$– | —$(CH_2)_3SO_3$– | —H | 5-Cl | TEAH+ |
| F-77 | O, S | —$(CH_2)_3SO_3$– | —$(CH_2)_3SO_3$– | —$CH_3$ | 5-Cl | TEAH+ |
| F-78 | O, S | —$(CH_2)_3SO_3$– | —$(CH_2)_3SO_3$– | —Ph | 5-Cl | TEAH+ |
| F-79 | O, S | —$(CH_2)_3SO_3$– | —$(CH_2)_3SO_3$– | —$CH_2Ph$ | 5-Cl | TEAH+ |
| F-80 | O, S | —$CH_2C6H4SO_3$–.o | —$CH_2C6H4SO_3$–.o | —$CH_3$ | 5-Cl | TEAH+ |
| F-81 | O, S | —$(CH_2)_3SO_3$– | —$(CH_2)_3SO_3$– | —$CH(CH_3)_2$ | 5-(2-furyl) | TEAH+ |
| F-82 | O, S | —$(CH_2)_3SO_3$– | —$(CH_2)_3SO_3$– | —$C_4H_{9(n)}$ | 5-(1-pyrrolyl) | TEAH+ |
| F-83 | O, S | —$CH_2CONSO_2Me$– | —$CH_2CONSO_2Me$– | —Ph | 5-Cl | TEAH+ |
| F-84 | O, S | —$(CH_2)_3OPO_3$–$^{2}$ | —$(CH_2)_3OPO_3$–$^{2}$ | —Ph | 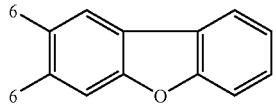 | TEAH+ |
| F-85 | O, S | —$(CH_2)_3SO_3$– | —$(CH_2)_3SO_3$– | | 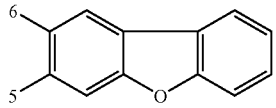 | TEAH+ |
| F-86 | O, O | —$(CH_2)_3SO_3$– | —$(CH_2)_3SO_3$– | | 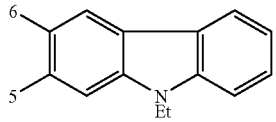 | TEAH+ |

F-87

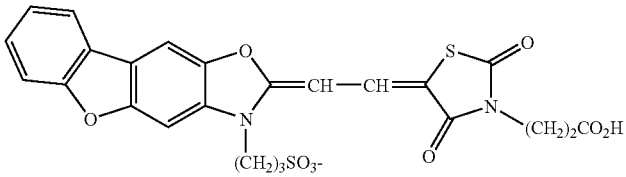

$TEAH^{+}$

-continued

F-88

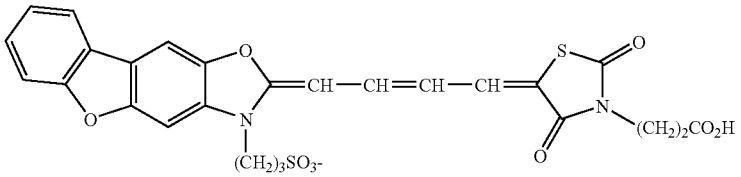

TEAH+

F-89

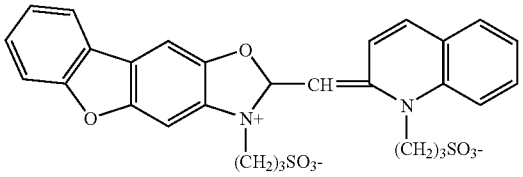

TEAH+

F-90

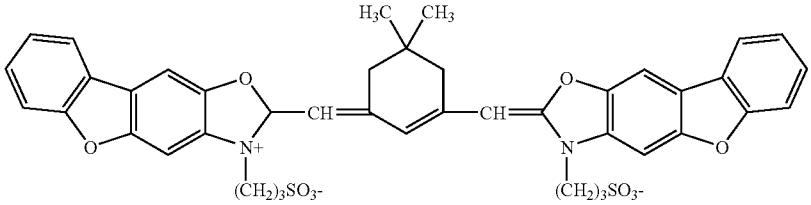

TEAH+

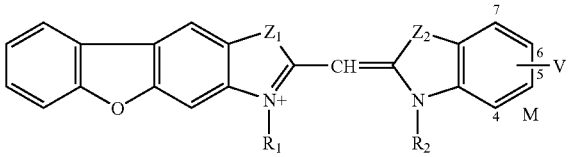

| No. | $Z_1$, $Z_2$ | $R_1$ | $R_2$ | V | M |
|---|---|---|---|---|---|
| F1-1 | O, S | —$(CH_2)_3NMe_3$+ | —$(CH_2)_3NMe_3$+ | 5-Cl | 3Br– |
| F1-2 | O, S | —$(CH_2)_3NMe_3$+ | —$(CH_2)_3NMe_3$+ | 5-Br | 3Br– |
| F1-3 | O, S | —$(CH_2)_3NMe_3$+ | —$(CH_2)_3NMe_3$+ | 5-I | 3Br– |
| F1-4 | O, S | —$(CH_2)_3NMe_3$+ | —$(CH_2)_3NMe_3$+ | 5-Ph | 3Br– |
| F1-5 | O, S | —$(CH_2)_3NMe_3$+ | —$(CH_2)_3NMe_3$+ | 5,6-diCl | 3Br– |
| F1-6 | O, S | —$(CH_2)_3NMe_3$+ | —$(CH_2)_3NMe_3$+ | 5-(2-thienyl) | 3Br– |
| F1-7 | O, S | —$(CH_2)_3NMe_3$+ | —$(CH_2)_3NMe_3$+ | 5-(2-furyl) | 3Br– |
| F1-8 | O, S | —$(CH_2)_3NMe_3$+ | —$(CH_2)_3NMe_3$+ | 5-(1-pyrrolyl) | 3Br– |
| F1-9 | O, S | —$(CH_2)_3NMe_3$+ | —$(CH_2)_3NMe_3$+ | 4,5-benzo | 3Br– |
| F1-10 | O, S | —$(CH_2)_3NMe_3$+ | —$(CH_2)_3NMe_3$+ | 5,6-benzo | 3Br– |
| F1-11 | O, S | —$(CH_2)_3NMe_3$+ | —$(CH_2)_3NMe_3$+ | 6,7-benzo | 3Br– |
| F1-12 | O, S | —$(CH_2)_3NMe_3$+ | —$(CH_2)_3NMe_3$+ | 5-$CH_3$ | 3Br– |
| F1-13 | O, S | —$(CH_2)_3NMe_3$+ | —$(CH_2)_3NMe_3$+ | 5,6-di$CH_3$ | 3Br– |
| F1-14 | O, S | —$(CH_2)_3NMe_3$+ | —$(CH_2)_3NMe_3$+ | 5-$OCH_3$ | 3Br– |
| F1-15 | O, S | —$(CH_2)_3NMe_3$+ | —$(CH_2)_3NMe_3$+ | 5,6-di$OCH_3$ | 3Br– |
| F1-16 | O, S | —$(CH_2)_3PMe_3$+ | —$(CH_2)_3PMe_3$+ | 5-Cl | 3Br– |
| F1-17 | O, S | —$(CH_2)_3NMe_3$+ | —$(CH_2)_3NMe_3$+ | 5-$CO_2H$ | 3Br– |
| F1-18 | O, S | —$(CH_2)_3NMe_3$+ | —$(CH_2)_3NMe_3$+ | 5-Cl | 3Br– |
| F1-19 | O, O | —$(CH_2)_3NMe_3$+ | —$(CH_2)_3NMe_3$+ | 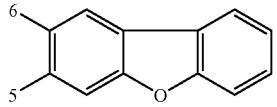 | 3Br– |
| F1-20 | S, S | —$(CH_2)_3NMe_3$+ | —$(CH_2)_3NMe_3$+ | 5-Cl | 3Br– |
| F1-21 | S, O | —$(CH_2)_3NMe_3$+ | —$(CH_2)_3NMe_3$+ | 5-Ph | 3Br– |

-continued
| | | | | |
|---|---|---|---|---|
| F1-22 O, O | —$(CH_2)_3NMe_3$+ | —$(CH_2)_3NMe_3$+ | 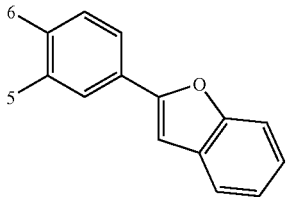 | 3Br− |
| F1-23 O, O | —$(CH_2)_3NMe_3$+ | —$(CH_2)_3NMe_3$+ | 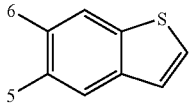 | 3Br− |
| F1-24 O, S | —$(CH_2)_3NH_3$+ | —$(CH_2)_3NH_3$+ | 5-Cl | 3Br− |
| F1-25 O, S | 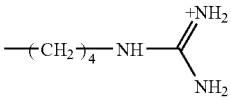 | 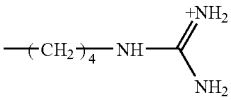 | 5-Cl | 3Br− |
| F1-26 O, S | 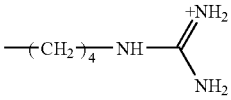 | 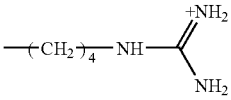 | 5-Ph | 3Br− |
| F1-27 O, S | 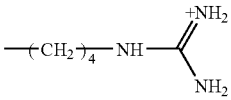 | 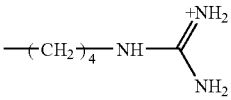 | 5,6-diCl | $3CF_3CO_2$− |
| F1-28 O, S | 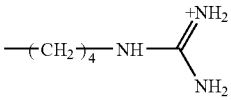 | 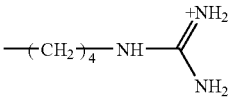 | 5-(2-thienyl) | 3Br− |
| F1-29 O, S | 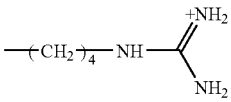 | 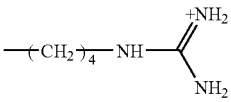 | 5-(2-furyl) | 3Br− |
| F1-30 O, S | 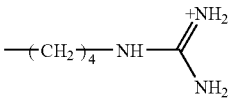 | 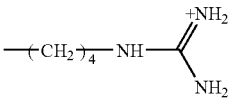 | 5-(1-pyrrolyl) | 3Br− |
| F1-31 O, S | 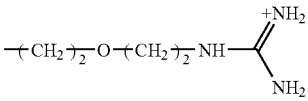 | 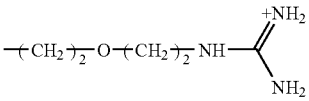 | 5-Cl | 3Br− |
| F1-32 O, S | 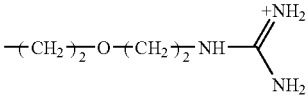 | 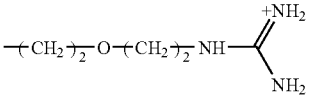 | 5-Ph | 3TsO− |
| F1-33 O, S | 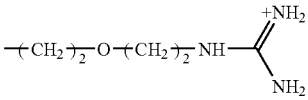 | 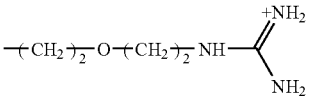 | 5,6-diCl | 3TsO− |
| F1-34 O, S | 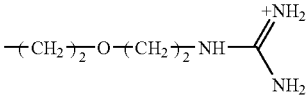 | 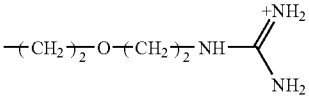 | 5-(2-thienyl) | 3Br− |

-continued
| | | | | | |
|---|---|---|---|---|---|
| F1-35 | O, S | $-(CH_2)_2-O-(CH_2)_2-NH-C(=NH_2^+)-NH_2$ | $-(CH_2)_2-O-(CH_2)_2-NH-C(=NH_2^+)-NH_2$ | 5-(2-furyl) | 3Br− |
| F1-36 | O, S | $-(CH_2)_2-O-(CH_2)_2-NH-C(=NH_2^+)-NH_2$ | $-(CH_2)_2-O-(CH_2)_2-NH-C(=NH_2^+)-NH_2$ | 5-(1-pyrrolyl) | 3Br− |
| F1-37 | S, S | $-(CH_2)_4-NH-C(=NH_2^+)-NH_2$ | $-(CH_2)_4-NH-C(=NH_2^+)-NH_2$ | 5-Cl | 3Br− |
| F1-38 | O, S | $-(CH_2)_3NEt_3^+$ | $-(CH_2)_3NEt_3^+$ | 5-Ph | 3Br− |
| F1-39 | O, O | $-(CH_2)_4-NH-C(=NH_2^+)-NH_2$ | $-(CH_2)_4-NH-C(=NH_2^+)-NH_2$ | 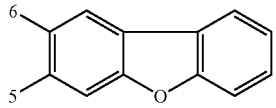 | 3Br− |
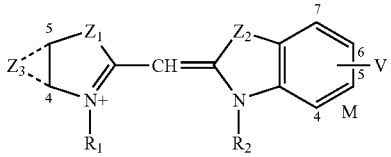
| No. | $Z_1$, $Z_2$ | $Z_3$ | $R_1$ |
|---|---|---|---|
| F1-40 | O, S | 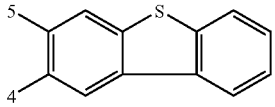 | $-(CH_2)_3NMe_3^+$ |
| F1-41 | O, S | 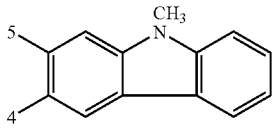 | $-(CH_2)_3NMe_3^+$ |
| F1-42 | O, S | 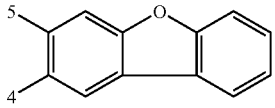 | $-(CH_2)_3NMe_3^+$ |
| F1-43 | O, S | 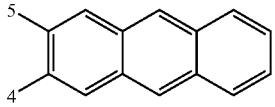 | $-(CH_2)_3NMe_3^+$ |
| F1-44 | O, S | 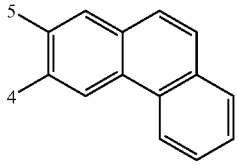 | $-(CH_2)_3NMe_3^+$ |
| F1-45 | O, O | 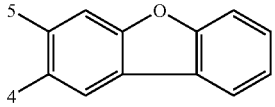 | $-(CH_2)_3NMe_3^+$ |

-continued

| | | | |
|---|---|---|---|
| F1-46 | NEt, NEt | 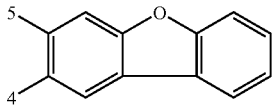 | —$(CH_2)_3NMe_3$+ |
| F1-47 | S, S | 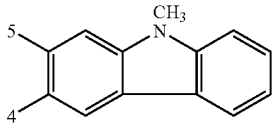 | 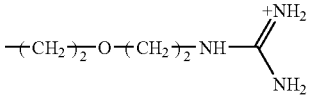 |

| No. | $R_2$ | V | M |
|---|---|---|---|
| F1-40 | —$(CH_2)_3NMe_3$+ | 5-Cl | 3Br− |
| F1-41 | —$(CH_2)_3NMe_3$+ | 5-Cl | 3Br− |
| F1-42 | —$(CH_2)_3NMe_3$+ | 5-(1-pyrrolyl) | 3Br− |
| F1-43 | —$(CH_2)_3NMe_3$+ | 5-(1-pyrrolyl) | 3Br− |
| F1-44 | —$(CH_2)_3NMe_3$+ | 5-(2-thienyl) | 3Br− |
| F1-45 | —$(CH_2)_3NMe_3$+ | 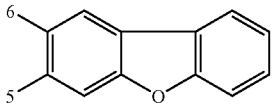 | 3Br− |
| F1-46 | —$(CH_2)_3NMe_3$+ | 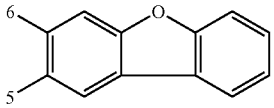 | 3Br− |
| F1-47 | 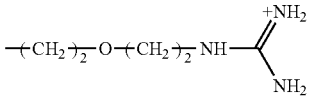 | 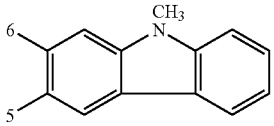 | 3Br− |

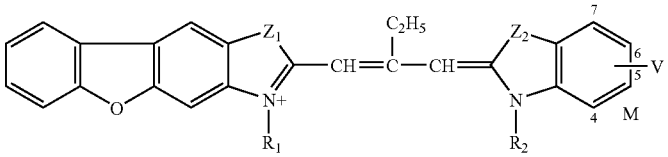

| No. | $Z_1$, $Z_2$ | $R_1$ | $R_2$ | V | M |
|---|---|---|---|---|---|
| F1-48 | O, S | —$(CH_2)_3NMe_3$+ | —$(CH_2)_3NMe_3$+ | 5-Cl | 3Br− |
| F1-49 | O, S | —$(CH_2)_3NMe_3$+ | —$(CH_2)_3NMe_3$+ | 5-Br | 3Br− |
| F1-50 | O, S | —$(CH_2)_3NMe_3$+ | —$(CH_2)_3NMe_3$+ | 5-I | 3Br− |
| F1-51 | O, S | —$(CH_2)_3NMe_3$+ | —$(CH_2)_3NMe_3$+ | 5-Ph | 3Br− |
| F1-52 | O, S | —$(CH_2)_3NMe_3$+ | —$(CH_2)_3NMe_3$+ | 5,6-diCl | 3Br− |
| F1-53 | O, S | —$(CH_2)_3NMe_3$+ | —$(CH_2)_3NMe_3$+ | 5-(2-thienyl) | 3Br− |
| F1-54 | O, S | —$(CH_2)_3NMe_3$+ | —$(CH_2)_3NMe_3$+ | 5-(2-furyl) | 3Br− |
| F1-55 | O, S | —$(CH_2)_3NMe_3$+ | —$(CH_2)_3NMe_3$+ | 5-(1-pyrrolyl) | 3Br− |
| F1-56 | O, S | —$(CH_2)_3NMe_3$+ | —$(CH_2)_3NMe_3$+ | 4,5-benzo | 3Br− |
| F1-57 | O, S | —$(CH_2)_3NMe_3$+ | —$(CH_2)_3NMe_3$+ | 5,6-benzo | $3CF_3CO_2$− |
| F1-58 | O, S | —$(CH_2)_3NMe_3$+ | —$(CH_2)_3NMe_3$+ | 6,7-benzo | 3Br− |
| F1-59 | O, S | —$(CH_2)_3NMe_3$+ | —$(CH_2)_3SO_3$− | 5-$CH_3$ | 3Br− |
| F1-60 | O, S | —$(CH_2)_3NMe_3$+ | —$(CH_2)_3NMe_3$+ | 5,6-di$CH_3$ | 3Br− |
| F1-61 | O, S | —$(CH_2)_3NMe_3$+ | —$(CH_2)_3NMe_3$+ | 5-$OCH_3$ | 3Br− |
| F1-62 | O, S | —$(CH_2)_3NMe_3$+ | —$(CH_2)_3NMe_3$+ | 5,6-di$OCH_3$ | 3Br− |
| F1-63 | O, S | —$(CH_2)_3PMe_3$+ | —$(CH_2)_3PMe_3$+ | 5-Cl | 3Br− |
| F1-64 | O, S | —$(CH_2)_3NMe_3$+ | —$(CH_2)_3NMe_3$+ | 5-$CO_2H$ | 3Br− |
| F1-65 | O, S | —$(CH_2)_3NMe_3$+ | —$(CH_2)_3NMe_3$+ | 5-Cl | 3Br− |
| F1-66 | O, O | —$(CH_2)_3NMe_3$+ | —$(CH_2)_3NMe_3$+ | 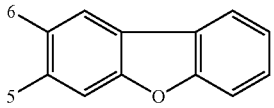 | 3Br− |

-continued
| | | | | | |
|---|---|---|---|---|---|
| F1-67 | S, S | —$(CH_2)_3NMe_3$+ | —$(CH_2)_3NMe_3$+ | 5-Cl | 3Br− |
| F1-68 | S, O | —$(CH_2)_3NMe_3$+ | —$(CH_2)_3NMe_3$+ | 5-Ph | 3Br− |
| F1-69 | O, O | —$(CH_2)_3NMe_3$+ | —$(CH_2)_3NMe_3$+ | 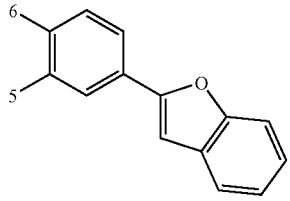 | 3Br− |
| F1-70 | O, O | —$(CH_2)_3NMe_3$+ | —$(CH_2)_3NMe_3$+ | 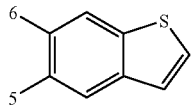 | 3Br− |
| F1-71 | O, S | —$(CH_2)_3NH_3$+ | —$(CH_2)_3NH_3$+ | 5-Cl | 3Br− |
| F1-72 | O, S | 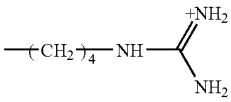 | 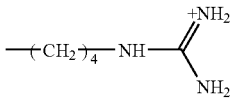 | 5-Cl | 3Br− |
| F1-73 | O, S | 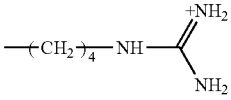 | 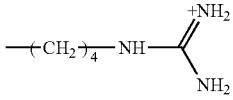 | 5-Ph | 3Br− |
| F1-74 | O, S | 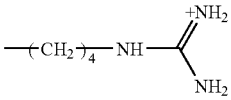 | 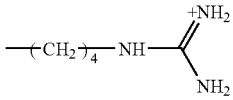 | 5,6-diCl | $3CF_3CO_2$− |
| F1-75 | O, S | 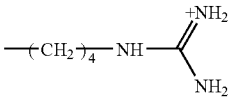 | 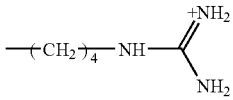 | 5-(2-thienyl) | 3Br− |
| F1-76 | O, S | 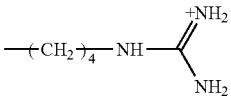 | 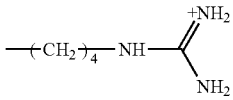 | 5-(2-furyl) | 3Br− |
| F1-77 | O, S | 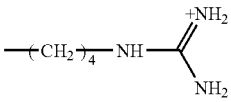 | 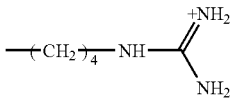 | 5-(1-pyrrolyl) | 3Br− |
| F1-78 | O, S | 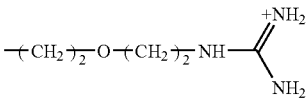 | 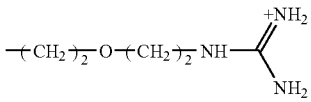 | 5-Cl | 3Br− |
| F1-79 | O, S | 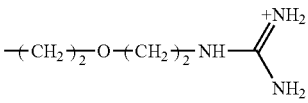 | 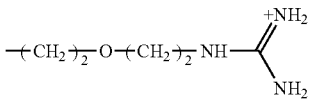 | 5-Ph | 3TsO− |
| F1-80 | O, S | 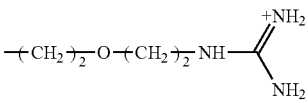 | 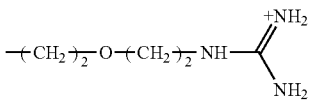 | 5,6-diCl | 3TsO− |
| F1-81 | O, S | 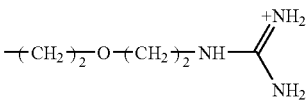 | 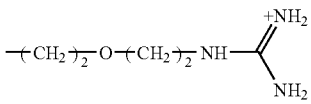 | 5-(2-thienyl) | 3Br− |

-continued
| | | | | | |
|---|---|---|---|---|---|
| F1-82 | O, S | $-(CH_2)_2-O-(CH_2)_2-NH-C(=NH_2^+)-NH_2$ | $-(CH_2)_2-O-(CH_2)_2-NH-C(=NH_2^+)-NH_2$ | 5-(2-furyl) | 3Br− |
| F1-83 | O, S | $-(CH_2)_2-O-(CH_2)_2-NH-C(=NH_2^+)-NH_2$ | $-(CH_2)_2-O-(CH_2)_2-NH-C(=NH_2^+)-NH_2$ | 5-(1-pyrrolyl) | 3Br− |
| F1-84 | S, S | $-(CH_2)_4-NH-C(=NH_2^+)-NH_2$ | $-(CH_2)_4-NH-C(=NH_2^+)-NH_2$ | 5-Cl | 3Br− |
| F1-85 | O, S | $-(CH_2)_3NEt_3^+$ | $-(CH_2)_3NEt_3^+$ | 5-Ph | 3Br− |
| F1-86 | O, O | $-(CH_2)_4-NH-C(=NH_2^+)-NH_2$ | $-(CH_2)_4-NH-C(=NH_2^+)-NH_2$ | 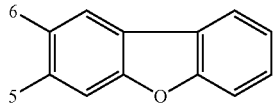 | 3Br− |
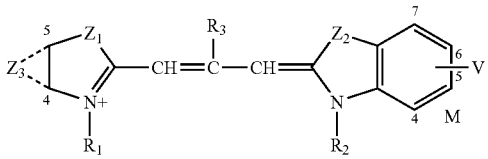
| No. | $Z_1$, $Z_2$ | $Z_3$ | $R_1$ |
|---|---|---|---|
| F1-87 | O, S | 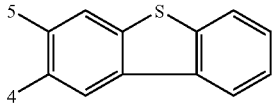 | $-(CH_2)_3NMe_3^+$ |
| F1-88 | O, S | 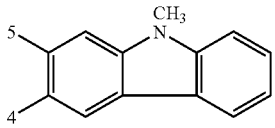 | $-(CH_2)_3NMe_3^+$ |
| F1-89 | O, S | 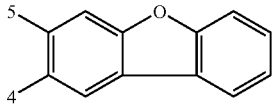 | $-(CH_2)_3NMe_3^+$ |
| F1-90 | O, S | 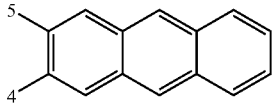 | $-(CH_2)_3NMe_3^+$ |
| F1-91 | O, S | 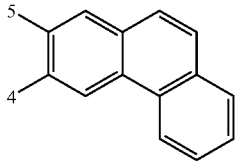 | $-(CH_2)_3NMe_3^+$ |
| F1-92 | O, O | 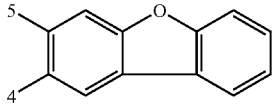 | $-(CH_2)_3NMe_3^+$ |

-continued
| | | | |
|---|---|---|---|
| F1-93 NEt, NEt | 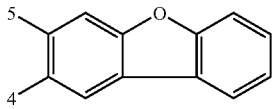 | —$(CH_2)_3NMe_3$+ | |
| F1-94 S, S | 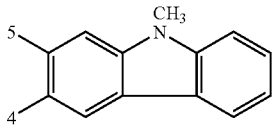 | 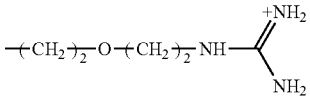 | |
| No. | $R_2$ | $R_3$ | V | M |
|---|---|---|---|---|
| F1-87 | —$(CH_2)_3NMe_3$+ | —$C_2H_5$ | 5-Cl | 3Br– |
| F1-88 | —$(CH_2)_3NMe_3$+ | —$C_2H_5$ | 5-Cl | 3Br– |
| F1-89 | —$(CH_2)_3NMe_3$+ | —$C_2H_5$ | 5-(1-pyrrolyl) | 3Br– |
| F1-90 | —$(CH_2)_3NMe_3$+ | —$C_2H_5$ | 5-(1-pyrrolyl) | 3Br– |
| F1-91 | —$(CH_2)_3NMe_3$+ | —$C_2H_5$ | 5-(2-thienyl) | 3Br– |
| F1-92 | —$(CH_2)_3NMe_3$+ | —$C_2H_5$ | 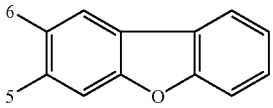 | 3Br– |
| F1-93 | —$(CH_2)_3NMe_3$+ | —H | 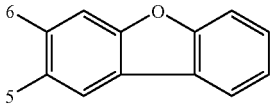 | 3Br– |
| F1-94 | 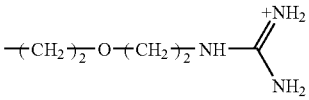 | —$C_2H_5$ | 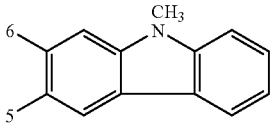 | 3Br– |
F1-95
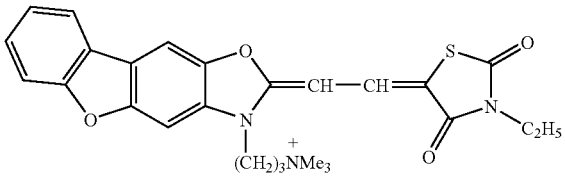
Br-
F1-96
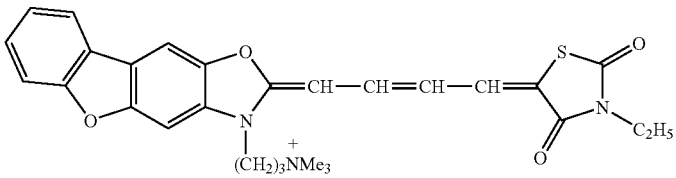
Br-
F1-97
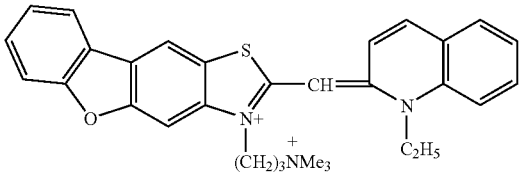
2Br- -continued

F1-98

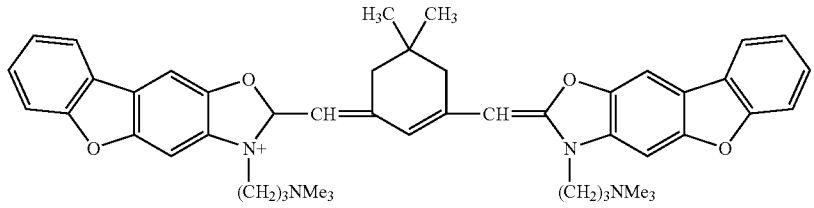

3Br-

TEAH+: triethyl ammonium
TsO−: p-toluene sulfonate

In the invention, it is particularly preferred that the dye represented by the general formula (G) be used.

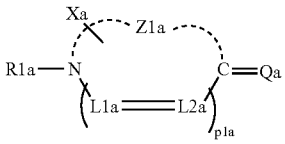

$M1_a m1_a$ wherein Z1a represents an atomic group necessary for forming a nitorgen-containing 5- or 6-membered heterocyclic ring, which may be condensed with a ring, Xa represents a substituted or unsubstituted benzofuran ring, L1a and L2a each represents a methine group, p1a represents 0 or 1, Qa represents a group necessary for forming a methine dye as the compound represented by the formula (G), R1a represents an alkyl group, an aryl group or a heterocyclic group, M1a represents an electric charge balancing counter ion, and m1a represents a number of 0 to more, necessary for neutralizing the electric charge of the molecule.

The general formula (G) will be further described hereinafter.

Examples of Qa include those listed above with reference to Q. Qa is preferably one of these examples. Examples of Z1a include those listed above with reference to $Z_{101}$. Z1a is preferably one of these examples. Examples of R1a include those listed above with reference to $R_{101}$. R1a is preferably one of these examples. Examples of L1a and $L_2a$ include those listed above with reference to $L_{100}$, and $L_{102}$. L1a and $L_2a$ each are preferably one of these examples. The suffix p1a is an integer of 0 or 1, preferably 0. Examples of M1a and m1a include those listed above with reference to $M_{101}$ and $m_{101}$. M1a and m1a each are preferably one of these examples.

Xa represents a benzofurane group. Xa may be bonded to any position on the 5- or 6-membered nitrogen-containing heterocyclic group represented by Z1a (including condensed ring). Xa is preferably bonded to a benzocondensed benzene ring. In the case where Z1a is a benzoazole ring, the position at which Xa is bonded to the benzene ring is preferably 5- or 6-position, particularly 5-position.

The substituents represented by W may further substitute on the benzofurane ring. However, the benzofurane ring is preferably unsubstituted or substituted by halogen, amide group, carbamoyl group, hydroxyl group or carboxyl group, more preferably unsubstituted or substituted by carbamoyl group, hydroxyl group or carboxyl group, particularly unsubstituted.

Particularly preferred among the dyes represented by the general formula (G) is one represented by the following general formula (G1).

(G1)

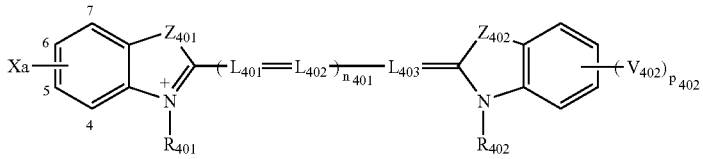

$M_{201}m_{201}$

In the general formula (G1), Xa is as defined in the general formula (G). Examples of Xa include those listed above with reference to the general formula (G). Xa is preferably one of these examples. The position at which Xa substitutes on the benzene ring.

$Z_{401}$, $Z_{402}$, $V_{402}$, $p_{402}$, $R_{401}$, $R_{402}$, $L_{401}$, $L_{502}$, $L_{403}$, $n_{401}$, $M_{401}$ and $m_{401}$ have the same meaning as $Z_{201}$, $Z_{202}$, $V_{202}$, $p_{202}$, $R_{201}$, $R_{202}$, $L_{201}$, $L_{202}$, $L_{203}$, $n_{201}$, $M_{201}$ and $m_{201}$ in the general formula (E), respectively. Examples of $Z_{401}$, $Z_{402}$, $V_{402}$, $p_{402}$, $R_{401}$, $R_{402}$, $L_{401}$, $L_{502}$, $L_{403}$, n401, $M_{401}$ and $m_{401}$ include those listed above with reference to the general formula (E). $Z_{401}$, $Z_{402}$, $V_{402}$, $p_{402}$, $R_{401}$, $R_{402}$, $L_{401}$, $L_{502}$, $L_{403}$, $n_{401}$, M401 and $m_{401}$ each are preferably one of these examples.

Specific examples of the dye represented by the general formula (G) or (G1) which is particularly preferably used in the invention will be given below of course, the invention is not limited to these examples.

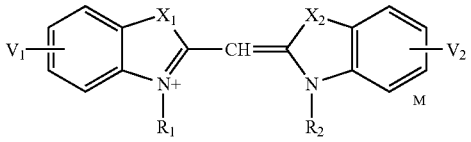
| No. | X1 | X2 | V1 | V2 | R1 | R2 | M |
|---|---|---|---|---|---|---|---|
| G-1 | S | S | 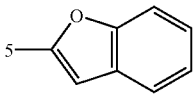 | 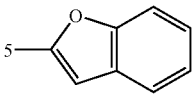 | PRS* | PRS* | $Et_2NH^+$ |
| G-2 | S | S | 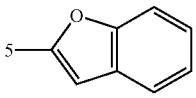 | 4,5-Benzo | PRS* | PRS* | $Et_3NH^+$ |
| G-3 | S | S | 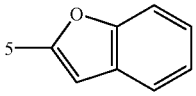 | 5-ph | TMAP* | TMAP* | $(Br^-)_2$ |
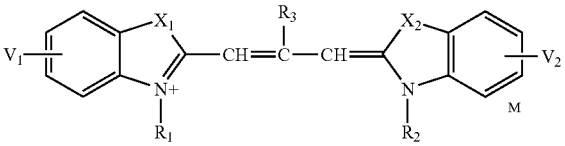
| No. | X1 | X2 | V1 | V2 | R1 | R2 | R3 | M |
|---|---|---|---|---|---|---|---|---|
| G-4 | O | O | 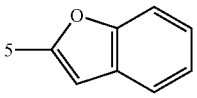 | 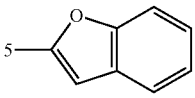 | PRS* | PRS* | Et | 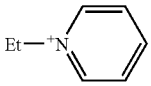 |
| G-5 | O | O | 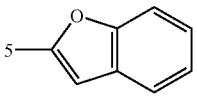 | 5-Ph | PRS* | PRS* | Et | $Et_3NH^+$ |
| G-6 | O | O | 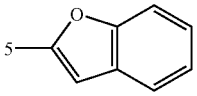 | 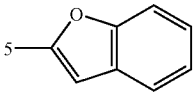 | TMAP* | TMAP* | Et | $(Br^-)_3$ |
| G-7 | O | O | 4,5-benzo | 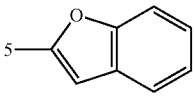 | PRS* | PRS* | Et | 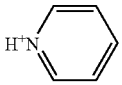 |
| G-8 | O | S | 5,6-benzo | 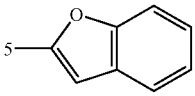 | PRS* | PRS* | Et | $Et_3NH^+$ |
| G-9 | S | S | 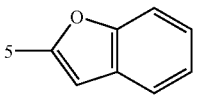 | 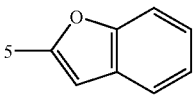 | PRS* | PRS* | Et | $Et_3NH^+$ |
| G-10 | S | S | 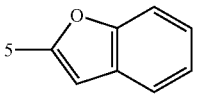 | 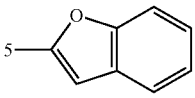 | TMAP* | TMAP* | Et | $(Br^-)_3$ |

-continued
| | | | | | | | | |
|---|---|---|---|---|---|---|---|---|
| G-11 | S | S | 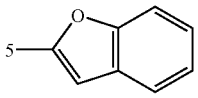 | 5-4,5-benzo | PRS* | PRS* | Et | $Et_3NH^+$ |
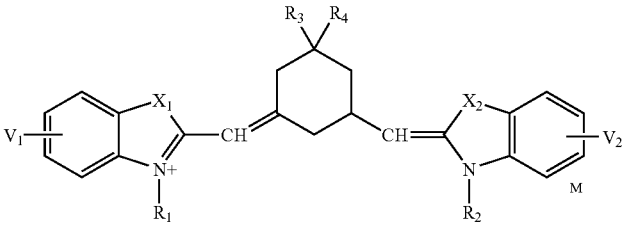
| No. | X1 | X2 | V1 | V2 | R1 | R2 | R3 | R4 | M |
|---|---|---|---|---|---|---|---|---|---|
| G-12 | S | S | 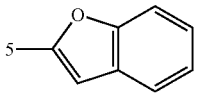 | 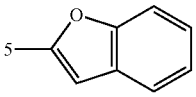 | PRS* | PRS* | $CH_3$ | $CH_3$ | $Et_3NH^+$ |
| G-13 | O | S | 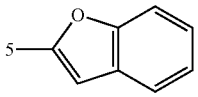 | H | PRS* | PRS* | $CH_3$ | H | $Et_3NH^+$ |
| G-14 | S | S | 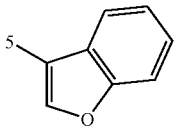 | 5-Cl | ES* | ES* | $CH_3$ | $CH_3$ | $Et_3NH^+$ |
G-15
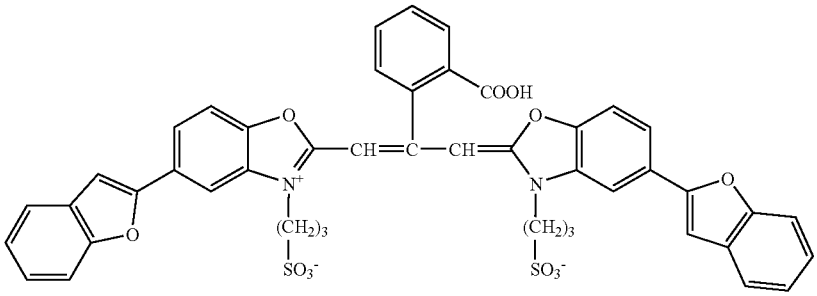
G-16
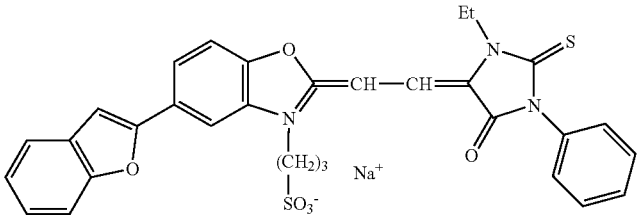
G-17
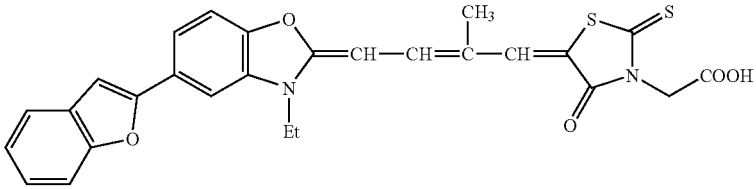

-continued
G-18
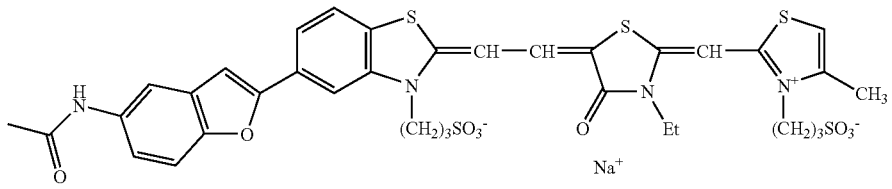
G-19
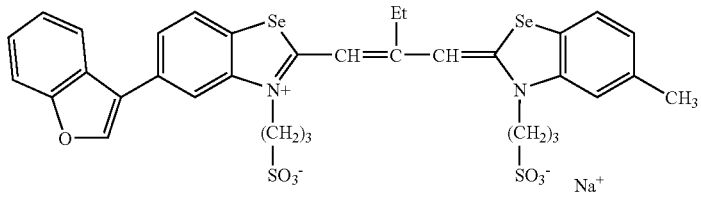
G-20
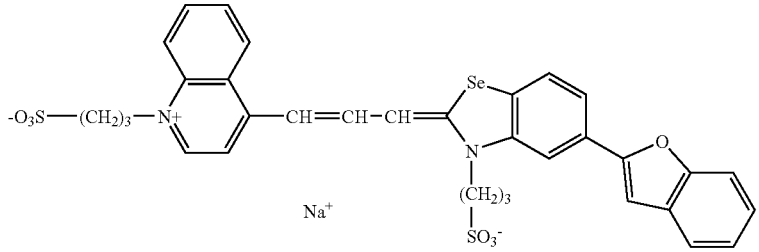
G-21
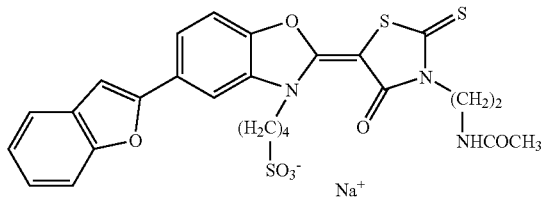
*PRS = —$(CH_2)_3SO_3^-$, ES = —$(CH_2)_2SO_3^-$, TMAP = —$(CH_2)_3N^+Me_3$
Examples of synthesis of the dye represented by the general formula (G) to be used in the invention will be given below.
A dye (G-4) was synthesized according to the following scheme.
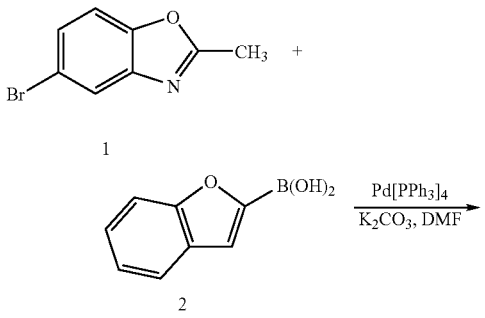
-continued
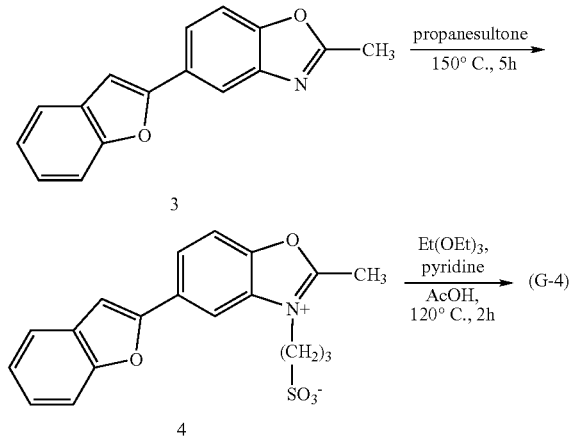

In a stream of nitrogen, 21 g of 5-bromo-2-methylbenzooxazole (1), 25 g of arylboric acid (2), 43 g of potassium carbonate and 200 m1 of DMF were mixed. To the mixture was then added 2 g of tetrakis triphenyl phosphine palladium with stirring at an ambient temperature of 100° C. The mixture was then stirred at the same temperature for 5 hours. After the termination of the reaction, to the mixture were then added 200 ml of water and 300 ml of ethyl acetate. The mixture was then thoroughly stirred. The mixture was then filtered through celite. The filtrate was transferred into a separating funnel where it was then allowed to stand. The resulting organic phase was separated, dried over ethyl acetate, filtered to remove foreign matters therefrom, and then subjected to distillation by a rotary evaporator to remove the solvent. The crystal thus obtained was then recrystallized from ethyl acetate to obtain Compound 3. The compound thus obtained was then identified as Compound by NMR. (Yield: 72%)

Subsequently, 6 g of Compound 3, 4.4 g of propane sultone, 15 ml of pyridine and 5 ml of acetic acid were mixed. The mixture was then stirred at an ambient temperature of 120° C. for 2 hours. The mixture was then allowed to cool. To the mixture was then added 100 ml of acetone. The mixture was then stirred at room temperature for 30 minutes. The resulting crystal was then withdrawn by filtration. The crystal was washed with methanol under heating, withdrawn by filtration, and then dried. The crystal thus obtained was then identified as Dye (G-4) by NMR. (Yield: 1.36 (23%))

The aforementioned general formulae (E), (F) (preferably (F1)) and (G) (preferably (G1)) which are preferably used in the invention may not satisfy the aforementioned conditions (1), (2) and (3) but preferably satisfy these conditions.

As the dye constituting other multilayer adsorption there may be used one disclosed in the above cited Patent [3] concerning multilayer adsorption.

As Da, La and Db in the general formula (Q) there may be also preferably used D1, La and D2 described in JP-A-2002-169251, respectively.

Specific examples will be given, but the invention is not limited thereto.

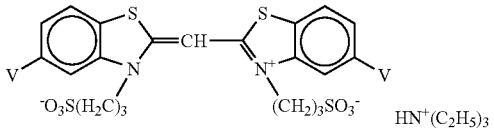

(A-1) V = Cl
(A-2) V = Ph
(A-3) V = CONHPh
(A-4) V = Br

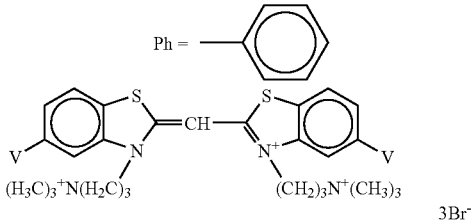

(A-5) V = Cl
(A-6) V = Ph
(A-7) V = CONHPh
(A-8) V = Br

-continued (A-9)

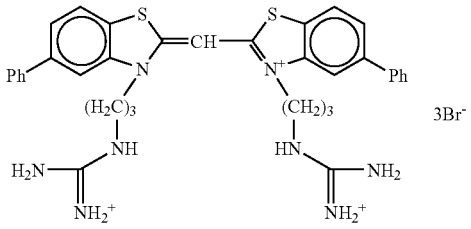

(A-10)

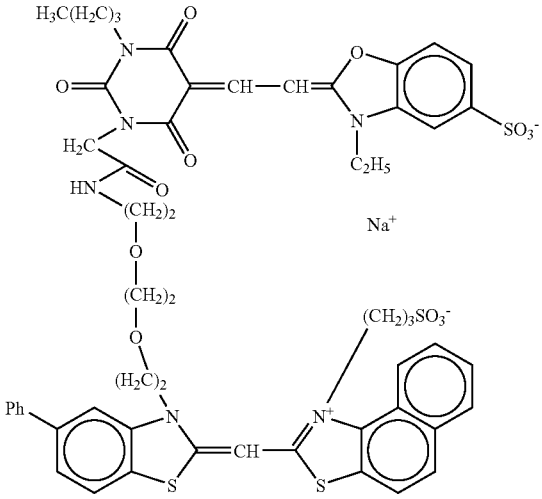

(A-11)

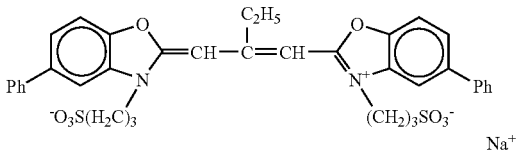

(A-12)

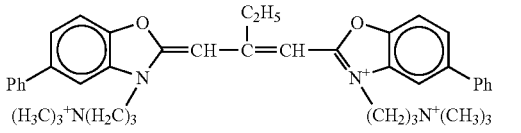

(A-13)

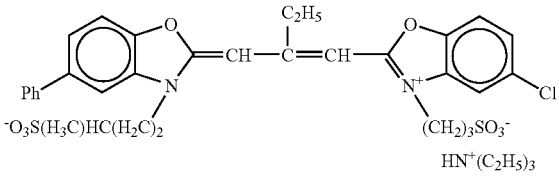

-continued
(A-14)
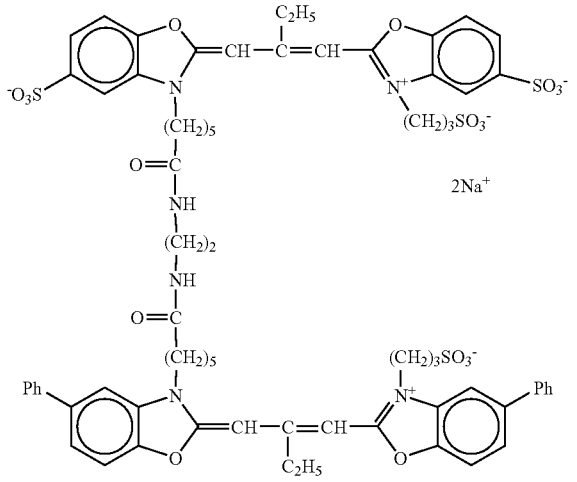
(A-15)
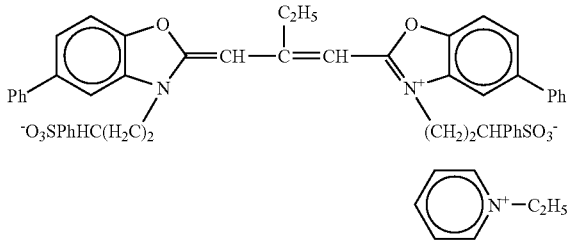
(A-16)
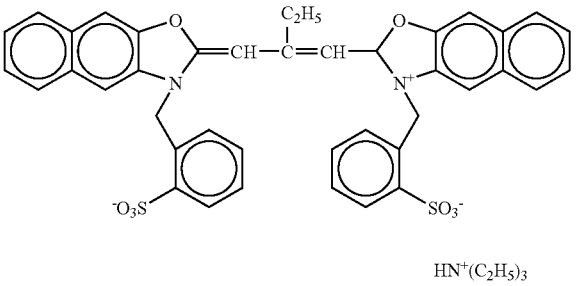
(A-17)
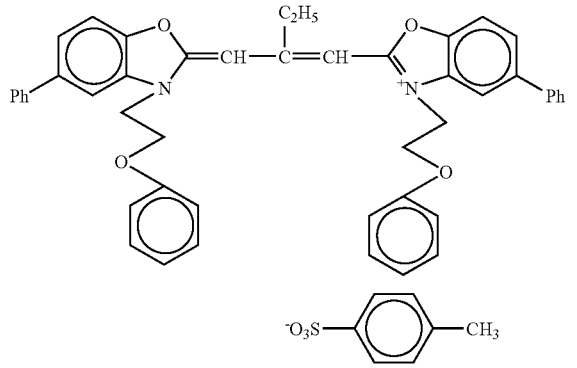
-continued
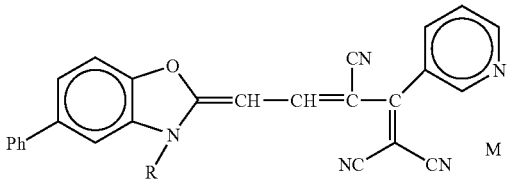
(A-18) R = $(CH_2)_3$ $SO_3^-$, M = $HN^+(C_2H_5)_3$
(A-19) R= $(CH_2)_3N^+(CH_3)_3$, M = $Br^-$
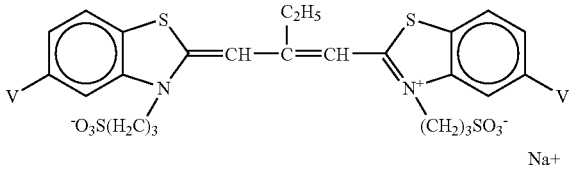
(A-20) V = Cl (A-21) V = Ph (A-22) V = CONHPh (A-23) V = Br
(A-24) V= F
(A-25)
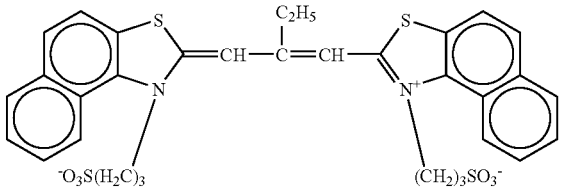
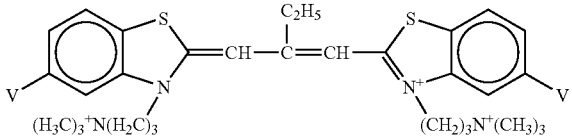
(A-26) V = Cl (A-27) V = Ph (A-28) V = CONHPh (A-29) V = Br
(A-30) V = F
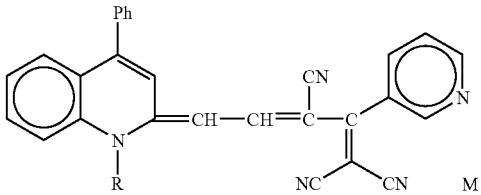
(A-31) R = $(CH_2)_3SO_3^-$, M = $HN^+(C_2H_5)_3$
(A-32) R = $(CH_2)_4N^+(CH_3)_3$, M = $CH_3SO_3^-$
(A-33)
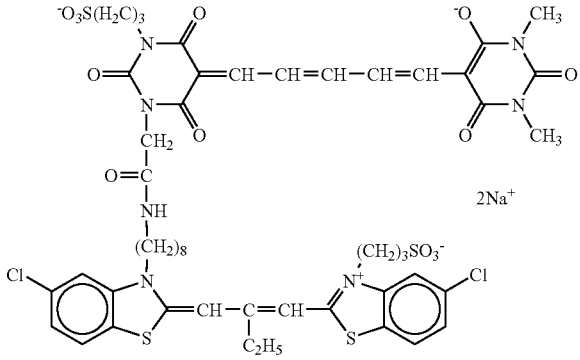

-continued

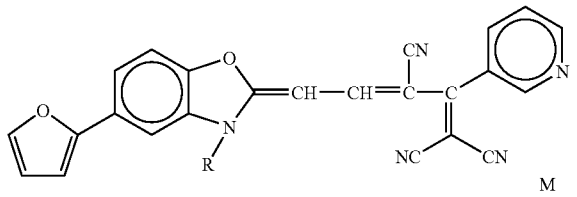

(A-34) R = $(CH_2)_3SO_3^-$, M = $HN^+(C_2H_5)_3$
(A-35) R = $(CH_2)_3N^+(CH_3)_3$, M = $Br^-$

The dyes of the present invention can be synthesized by the methods described in F. M. Harmer, *Heterocyclic Compounds—Cyanine Dyes and Related Compounds*, John Wiley & Sons, New York, London (1964), D. M. Sturmer, *Heterocyclic Compounds—Special topics in heterocyclic chemistry*, Chap. 18, Sec. 14, pp. 482–515, John Wiley & Sons, New York, London (1977), and *Rodd's Chemistry of Carbon Compounds,* 2nd ed., Vol. IV, Part B, Chap. 15, pp. 369–422, Elsevier Science Publishing Company Inc., New York (1977).

In the present invention, not only the sensitizing dyes of the present invention but also sensitizing dyes other than those of the present invention may be used or may be used in combination. Preferred examples of the dye which can be used include cyanine dyes, merocyanine dyes, rhodacyanine dyes, trinuclear merocyanine dyes, tetranuclear merocyanine dyes, allopolar dyes, hemicyanine dyes and styryl dyes. Among these, more preferred are cyanine dyes, merocyanine dyes and rhodacyanine dyes, still more preferred are cyanine dyes. These dyes are described in detail in [2] Dye Publications above.

These sensitizing dyes may be used either individually or in combination of two or more thereof. The combination of sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-49336 (the term "JP-B" as used herein means an "examined Japanese patent publication"), JP-B-53-12375, JP-A-52-110618 and JP-A-52-109925.

Together with the sensitizing dye, a dye which itself has no spectral sensitization effect or a substance which absorbs substantially no visible light, but which exhibits supersensitization may be contained in the emulsion.

Examples of the supersensitizing agent (for example, pyrimidylamino compounds, triazinylamino compounds, azolium compounds, aminostyryl compounds, aromatic organic acid formaldehyde condensates, azaindene compounds and cadmium salts) useful for the spectral sensitization of the present invention and examples of the combination of a supersensitizing agent with a sensitizing dye are described in U.S. Pat. Nos. 3,511,664, 3,615,613, 3,615,632, 3,615,641, 4,596,767, 4,945,038, 4,965,182, 2,933,390, 3,635,721, 3,743,510, 3,617,295 and 3,635,721. With respect to the use method thereof, those described in these patents are also preferred.

The dye compound or sensitizing dye (the same applies to other sensitizing dyes and supersensitizing agent) for use in the present invention may be added to the silver halide emulsion of the present invention in any process during the preparation of the emulsion, which has been heretofore recognized as useful. The addition may be performed at any time or step as long as it is before the coating of the emulsion, for example, during the formation and/or before the desalting of silver halide grains, during the desalting and/or after the desalting but before the initiation of chemical ripening as disclosed in U.S. Pat. Nos. 2,735,766, 3,628,960, 4,183,756 and 4,225,666, JP-A-58-184142 and JP-A-60-196749, immediately before or during the chemical ripening, or after the chemical ripening but before the coating as disclosed in JP-A-58-113920. Also, as disclosed in U.S. Pat. No. 4,225,666 and JP-A-58-7629, the same compound solely or a combination of compounds differing in the structure may be added in parts, for example, during the grain formation and during the chemical ripening or after the completion of chemical ripening, or before or during the chemical ripening and after the completion of chemical ripening when added in parts, the kind of the compound or the combination of compounds may be varied.

The amount added of the dye compound or sensitizing dye (the same applies to other sensitizing dyes and supersensitizing dye) for use in the present invention varies depending on the shape and size of silver halide grain and the dye compound or sensitizing dye may be added in any amount, but the dye compound or sensitizing dye can be used preferably in an amount of $1\times10^{-8}$ to 1 mol, more preferably from $1\times10^{-6}$ to $3\times10^{-2}$ mol, per mol of silver halide. For example, when the silver halide grain size is from 0.2 to 1.3 μm, the amount added of the dye compound or sensitizing dye is preferably from $2\times10^{-6}$ to $3.5\times10^{-3}$ mol, more preferably from $7.5\times10^{-6}$ to $1.5\times10^{-3}$ mol, per mol of silver halide.

However, in the case where the dye chromophore is adsorbed in multiple layers, the dye compound or sensitizing dye must be added in an amount necessary for the multilayer adsorption.

The dye compound or sensitizing dye (the same applies to other sensitizing dyes and supersensitizing dye) for use in the present invention can be dispersed directly in the emulsion or can be added to the emulsion in the form of a solution after dissolving the dye compound or sensitizing dye in an appropriate solvent such as methyl alcohol, ethyl alcohol, methyl cellosolve, acetone, water or pyridine or in a mixed solvent thereof. At this time, additives such as base, acid or surfactant can be allowed to be present together. For the dissolution, an ultrasonic wave may also be used. With respect to the method for adding these compounds, a method of dissolving the compound in a volatile organic solvent, dispersing the solution in a hydrophilic colloid and adding the dispersion to the emulsion described in U.S. Pat. No. 3,469,987, a method of dispersing the compound in a water-soluble solvent and adding the dispersion to the emulsion described in JP-B-46-24185, a method of dissolving the compound in a surfactant and adding the solution to the emulsion described in U.S. Pat. No. 3,822,135, a method of dissolving the compound by using a compound capable of red shifting and adding the solution to the emulsion described in JP-A-51-74624, and a method of dissolving the compound in an acid substantially free of water and adding the solution to the emulsion described in JP-A-50-80826 may be used. In addition, for the addition to the emulsion, the methods described in U.S. Pat. Nos. 2,912,343, 3,342,605, 2,996,287 and 3,429,835 may be used.

The silver halide used in the photographic emulsion undertaking the photosensitive mechanism in the present invention may be any of silver bromide, silver iodobromide, silver chlorobromide, silver iodide, silver iodochloride, silver iodobromochloride and silver chloride, but a stronger adsorption structure can be established when the halogen composition in the outermost surface of emulsion contains 0.1 mol % or more, preferably 1 mol % or more, more preferably 5 mol % or more, of iodide.

The emulsion which can be preferably used in the light-sensitive material of the present invention is an emulsion of silver iodobromide, silver bromide or silver chloroiodobromide tabular grains.

Out of the photographic light-sensitive materials according to the present invention, the color photographic light-sensitive material is preferably a photographic light-sensitive material where each unit light-sensitive layer is constituted by a plurality of silver halide emulsion layers having substantially the same color sensitivity but differing in the light sensitivity and 50% or more of the entire projected area of silver halide grains contained in at least one emulsion layer having highest sensitivity among the silver halide emulsion layers constituting each unit light-sensitive layer is occupied by a tabular silver halide grain (hereinafter also referred to as a tabular grain). In the present invention, the average aspect ratio of the tabular grains is preferably 2 or more, more preferably 8 or more, still more preferably 12 or more, and most preferably 15 or more.

In the tabular grain, the "aspect ratio" means a ratio of diameter to thickness of silver halide, that is, a value obtained by dividing the diameter by the thickness of individual silver halide grains. The "diameter" as used herein indicates a diameter of a circle having an area equal to the projected area of a grain when the silver halide grain is observed through a microscope or an electron microscope. Also, the average aspect ratio as used in the present invention means an average value of aspect ratios of all tabular grains in the emulsion.

As one example of the method for measuring the aspect ratio, a method of taking a photograph through a transmission electron microscope by a replica process and determining the equivalent circle diameter and thickness of individual grains is known. In this case, the thickness is calculated from the length of shadow of the replica.

The shape of the tabular grain for use in the present invention is generally hexagonal. The "hexagonal shape" means that the shape of the main plane of a tabular grain is hexagonal and the ratio of adjacent sides (maximum side length/minimum side length) thereof is 2 or less. The ratio of adjacent sides is preferably 1.6 or less, more preferably 1.2 or less. Needless to say, the lower limit is 1.0. In grains having a high aspect ratio, particularly, in tabular grains, a triangular tabular grain increases. The triangular tabular grain appears when the Ostwald ripening excessively proceeds. In order to obtain a substantially hexagonal tabular grain, the time period of performing this ripening is preferably minimized. For this purpose, a design to increase the ratio of tabular grain by nucleation is necessary. As described in JP-A-63-11928 by Saito, in order to elevate the probability of generation of hexagonal tabular grains at the time of adding silver ion and bromide ion to a reaction mixture by a double jet method, one or both of an aqueous silver ion solution and an aqueous bromide ion solution preferably contains gelatin.

The hexagonal tabular grain contained in the light-sensitive material of the present invention is formed through the steps of nucleation, Ostwald ripening and growth. Although these steps all are important for suppressing the widening of grain size distribution, the size distribution should be prevented from widening in the first nucleation process-, because the size distribution widened in a previous step cannot be narrowed by a later step. In the nucleation process, important is the relationship between the temperature of the reaction solution and the time period of nucleation of adding silver ion and bromide ion to a reaction solution by a double jet method and producing a precipitate. JP-A-63-92942 by Saito discloses that the temperature of the reaction solution at the nucleation is preferably from 20 to 45° C. for obtaining good monodispersity. Furthermore, JP-A-2-222940 by Zola et al. states that the temperature at the nucleation is preferably 60° C. or less.

For the purpose of obtaining monodisperse tabular grains having a high aspect ratio, gelatin is sometimes further added during the grain formation. The gelatin used here is preferably a chemically modified gelatin described in JP-A-10-148897 and JPA-11-143002. This chemically modified gelatin is a gelatin characterized in that at least two or more carboxyl groups are newly introduced at the chemical modification of amino group in the gelatin. A trimellitated gelatin is preferred and a succinated gelatin is also preferred. This gelatin is preferably added before the growth step, more preferably immediately after the nucleation. The amount added thereof is preferably 60% or more, more preferably 80% or more, still more preferably 90% or more, based on the mass. of the entire dispersion medium during the grain formation.

The tabular grain emulsion comprises silver iodobromide, silver bromide or silver chloroiodobromide. Although the emulsion may contain silver chloride, the silver chloride content is preferably 8 mol % or less, more preferably 3 mol % or less, and most preferably 0 mol %. As for the silver iodide content, the coefficient of variation in the grain size distribution of the tabular grain emulsion is preferably 30% or less and therefore, the silver iodide content is preferably 20 mol % or less, By decreasing the silver iodide content, the coefficient of variation in the equivalent-circle diameter distribution of the tabular grain emulsion can be easily made small. Particularly, the coefficient of variation in the grain size distribution of the tabular grain emulsion is preferably 20% or less and the silver iodide content is preferably 10 mol % or less.

With respect to the silver iodide distribution, the tabular grain emulsion preferably has a structure within a grain. In this case, the silver iodide distribution may have a duple structure, a triple structure, a quadruple structure or a structure of higher order.

In the present invention, the tabular grain preferably has a dislocation line. The dislocation line of a tabular grain can be observed by a direct method using a transmission-type electron microscope at a low temperature described, for example, in J. F. Hamilton, *Phot. Sci. Eng.,* 11, 57 (1967) and T. Shiozawa, *J. Soc. Phot. Sci. Japan,* 3, 5, 213 (1972). More specifically, a silver halide grain is taken out from an emulsion by taking care not to impose a pressure high enough to generate a dislocation line on the grain, the silver halide grain is placed on a mesh for the observation through an electron microscope, and the sample is observed according to the transmission method while keeping the sample in the cooled state so as to prevent damages (for example, print-out) by the electron beam. At this time, as the thickness of the grain is larger, the electron beam is more difficult to transmit, therefore, a high-voltage type (200 kV or more for a grain having a thickness of 0.25 μm) electron microscope is preferably used for attaining clearer observation. From the photograph of grains taken by this method, the position and number of dislocation lines on each grain when viewed from the direction perpendicular to the main plane can be determined.

The number of dislocation lines of the tabular grain for use in the present invention is preferably 10 or more on average, more preferably 20 or more on average, per one grain. In the case where the dislocation lines observed are densely present or intersected with each other, the number of dislocation lines per one grain may not be exactly: counted in some oases. However, even in these cases, an approximate number may be counted like about 10, 20 or 30 lines and this case can be distinguished from the case where only a few dislocation lines are present. The average number of dislocation lines per one grain is determined as a number average by counting the number of dislocation lines on 100 or more grains. In some cases, hundreds of dislocation lines are observed.

The dislocation line can be introduced, for example, in the vicinity of the outer circumference of a tabular grain. In this case, the dislocation is nearly perpendicular to the outer circumference and the dislocation line is generated to extend from the position at the x % length of the distance between the center of the tabular grain and the side (outer circumference) and reach the outer circumference. This x value is preferably from 10 to less than 100, more preferably from 30 to less than 99, and most preferably from 50 to less than 98. In this case, the shape formed by connecting the starting points of dislocation lines is nearly similar to the grain shape but not completely a similar figure and may deform in some cases. This type of dislocation line is not observed in the center region of a grain. The dislocation lines are crystallographically directed nearly in the (211) direction but often weaving or intersecting with each other.

The dislocation lines may be present almost uniformly throughout the outer circumference of a tabular grain or may be present at a local site on the outer circumference. More specifically, for example, in the case of a hexagonal tabular silver halide grain, the dislocation lines may be limited only to the neighborhood of six apexes or may be limited only to the neighborhood of one apex among them. On the contrary, the dislocation lines may be limited only to the sides exclusive of the neighborhood of six apexes.

Furthermore, the dislocation lines may be formed over the region including the centers of two parallel main planes of a tabular grain. When the dislocation lines are formed over the entire surface of a main plane, these are sometimes crystallographically directed nearly in the (211) direction when viewed from the direction perpendicular to the main plane, or sometimes formed randomly or in the (110) direction. Also, respective dislocation lines are sometimes random in the length, where some dislocation is observed as a short line on the main plane and some dislocation is observed as a long line reaching to the side (outer circumference). The dislocation lines are linear or weaving in many cases. Also, the dislocation lines are often intersecting with each other.

As described above, the sites of dislocation lines may be limited on the outer circumference, on the main plane or at the local site or the dislocation lines may be formed on these sites in combination, that is, may be present on the outer circumference and on the main plane at the same time.

The dislocation line can be introduced into a tabular grain by providing a specific high silver iodide phase within the grain. In this case, a high silver iodide region may be discontinuously provided in the high silver iodide phase. More specifically, after preparing a base grain, a high silver iodide phase is provided and the outside thereof is covered with a phase having a silver iodide content lower than that of the high silver iodide phase, whereby a high silver iodide phase can be obtained inside the grain. The silver iodide content of the base tabular grain is lower than that of the high silver iodide phase and is preferably from 0 to 20 mol %, more preferably from 0 to 15 mol %.

In the present invention, the "high silver iodide phase inside a grain" means a silver halide solid solution containing silver iodide. In this case, the silver halide is preferably silver iodide, silver iodobromide or silver chloroiodobromide, more preferably silver iodide or silver iodobromide (the silver iodide content is from 10 to 40 mol % based on the silver halide contained in the high silver iodide phase). For selectively causing the high silver iodide phase inside a grains (hereinafter referred to as "internal high silver iodide phase") to be present on any site of sides, corners and faces of the base grain, the conditions for the production of the base grain, the internal high silver iodide phase and the phase covering the outside thereof are preferably controlled. With respect to the conditions for the production of the base grain, important factors are the pAg (logarithm of the reciprocal of silver ion concentration), the presence or absence, kind and amount of a silver halide solvent and the temperature. When the base grain is grown at a pAg of 8.5 or less, preferably 8 or less, the internal high silver iodide phase can be formed selectively in the vicinity of apex or on the face of the base grain at the subsequent production of the internal high silver iodide phase.

On the other hand, when the base grain is growth at a pAg of 8.5 or more, preferably 9 or more, the internal high silver iodide phase can be formed on the side of the base grain at the subsequent production of the internal high silver iodide phase. The threshold value of the pAg varies to be high or low according to the temperature and the presence or absence, kind and amount of a silver halide solvent. For example, when a thiocyanate is used as the silver halide solvent, the threshold value of pAg deviates toward a higher value. The most important pAg at the growth is the pAg at the termination of growth of the base grain. Even when the pAg at the growth does not satisfy the above-described value, the selected site of the internal high silver iodide phase can be controlled by adjusting the pAg to the above-described value after the growth of the base grain and then performing the ripening. At this time, the effective silver halide solvent is ammonia, an amine compound, a thiourea derivative or a thiocyanate salt. For the production of the internal high silver iodide phase, a so-called conversion method may be used.

The conversion method includes a method of adding, during the grain formation, a halide ion of which salt for forming silver ion has a solubility lower than that of the halide ion constituting the grain or the vicinity of the surface of the grain at that time. In the present invention, the amount of the low-solubility halide ion added is preferably larger than a certain value (relating to the halogen composition) based on the surface area of the grain at that time. For example, during the grain formation, KI is preferably added in an amount larger than a certain amount based on the surface area of a silver halide grain at that time. More specifically, $8.2\times10^{-5}$ mol/m$^2$ or more of an iodide salt is preferably added.

The method for producing the internal high silver iodide phase is more preferably a method of adding an aqueous silver salt solution simultaneously with the addition of an aqueous halide salt solution containing an iodide salt.

For example, an aqueous $AgNO_3$ solution is added simultaneously with the addition of an aqueous KI solution by double jet. At this time, the addition initiating time and addition completing time of the aqueous KI solution may differ from those of the aqueous AgNO3 solution and one may be earlier or later than the other. The addition molar ratio of the aqueous $AgNO_3$ solution to the aqueous KI solution is preferably 0.1 or more, more preferably 0.5 or more, still more preferably 1 or more. The total addition molar amount of the aqueous $AgNO_3$ solution may be in a silver excess region based on the halide ion in the system and the iodide ion added. The pAg at the double jet addition of an aqueous halide solution containing iodide ion and an aqueous silver salt solution is preferably decreased with the passage of double jet addition time. The pAg before the initiation of addition is preferably from 6.5 to 13, more preferably from 7.0 to 11. The pAg at the completion of addition is most preferably from 6.5 to 10.0.

In practicing the above-described method, the solubility of silver halide in the mixing system is preferably as low as possible. Therefore, the temperature of the mixing system at the formation of the high silver iodide phase is preferably from 30 to 80° C., more preferably from 30 to 70° C.

The internal high silver iodide phase can be still more preferably formed by adding fine grain silver iodide, fine grain silver iodobromide, fine grain silver chloro-iodide or fine grain silver chloroiodobromide, particularly preferably by adding fine grain silver iodide. These fine grains generally have a grain size of 0.01 to 0.1 μm, but a fine grain having a grain size of 0.01 μm or less or a grain size of 0.1 μm or more can also be used. The preparation method of these fine silver halide grains is described in JP-A-1-183417, JP-A-2-44335, JP-A-1-183644, JP-A-1-183645, JP-A-2-43534 and JP-A-2-43535. By adding such a fine grain silver halide and performing the ripening, the internal high silver iodide phase can be provided. In dissolving the fine grain by ripening, the above-described silver halide solvent can also be used. It is not necessary that all fine grains added are immediately dissolved and disappear, but it may suffice if the fine grains are dissolved and disappear when the final grain is completed.

The internal high silver iodide phase is preferably present in the range from 5 to less than 100 mol %, more preferably from 20 to less than 95 mol %, and most preferably from 50 to less than 90 mol %, based on the silver amount of the entire grain, as measured from the center of a hexagon or the like formed by the projection of a grain. The amount of silver halide forming this internal high silver iodide phase is, in terms of the silver amount, 50 mol % or less, preferably 20 mol % or less, based on the silver amount of the entire grain. These values relating to the high silver iodide phase are a formulated value for the production of a silver halide emulsion but not a value obtained by measuring the halogen composition of a final grain according to various analysis methods. The internal high silver iodide phase often completely disappears in the final grain due to recrystallization or the like in the shell forming process and the above-described silver amounts all are a formulated value.

Accordingly, although the dislocation line in the final grain may be easily observed by the above-described method, the internal silver iodide phase introduced for the introduction of dislocation line often cannot be confirmed as a clear phase because the silver iodide composition at the boundary continuously changes. The halogen composition at respective parts of a grain can be confirmed by combining X-ray diffraction, an EPMA (sometimes also called XMA) method (a method of scanning a silver halide grain by an electron beam and thereby detecting the silver halide composition);, an ESCA method (sometimes also called XPS) method (a method of irradiating an X ray and spectrally separating photoelectrons emitted from the grain surface) or the like.

The outside phase for covering the internal high silver iodide phase has a silver iodide content lower than that of the internal high silver iodide phase. The silver iodide content is preferably from 0 to 30 mol %, more preferably from 0 to 20 mol %, and most preferably from 0 to 10 mol %, based on the amount of silver halide contained in the outside phase for the covering.

The temperature and pAg at the formation of the outside phase for covering the internal high silver iodide phase can be freely selected, but the temperature is preferably from 30 to 80° C., most preferably from 35 to 70° C., and the pAg is preferably from 6.5 to 11.5. In some case, the above-described silver halide solvent is preferably used. The silver halide solvent is most preferably a thiocyanate salt.

Another method for introducing a dislocation line into a tabular grain is a method of using an iodide ion-releasing agent described in JP-A-6-11782, and this method is preferably used.

Also, the dislocation line can be introduced by appropriately combining this method for introducing a dislocation line with the above-described method for introducing a dislocation line.

The coefficient of variation in the iodine distribution among silver halide grains contained in the light-sensitive material of the present invention is preferably 20% or less, more preferably 15% or. less, still more preferably 10% or less. If the coefficient of variation in the iodine content distribution of individual silver halides exceeds 20%, a high contrast is disadvantageously not obtained and the sensitivity also greatly decreases when a pressure is applied.

As for the production method itself of silver halide grains having a narrow iodine distribution among grains contained in the light-sensitive material of the present invention, known methods such as method of adding fine grains described in JP-A-1-183417 and method of using an iodide ion-releasing agent described in JP-A-2-68538 can be used individually or in combination.

In the silver halide grain of the present invention, the coefficient of variation in the iodine distribution among grains is preferably 20% or less and the most preferred method for obtaining the monodisperse iodide distribution among grains is the method described in JP-A-3-213845. More specifically, an aqueous water-soluble silver salt solution and an aqueous water-soluble halide (containing 95 mol % or more of iodide ion) solution are mixed in a mixer provided outside a reaction vessel to form fine silver halide grains containing 95 mol % or more of silver iodide and immediately after the formation, the fine silver halide grains are supplied to the reaction vessel, whereby a monodisperse iodine distribution can be accomplished among grains. The "reaction vessel" as used herein means a vessel where nucleation and/or crystal growth of tabular silver halide grains is performed.

With respect to the method for adding silver halide grains prepared in the mixer and the preparation means for use therein, the following three techniques described in JP-A-3-213845 can be employed:

(1) fine grains are added to a reaction vessel immediately after the formation in the mixer;

(2) powerful and efficient stirring is performed in the mixer; and (3) an aqueous protective colloid solution is injected into the mixer.

The protective colloid used in (3) above may be solely injected into the mixer or may be incorporated into an aqueous silver halide solution or an aqueous silver nitrate solution before the injection into the mixer. The concentration of the protective colloid is 1 mass % or more, preferably from 2 to 5 mass %. Examples of the polymer compound exhibiting a protective colloid activity to silver halide grains for use in the present invention include polyacrylamide polymers, amino polymers, polymers having a thioether group, polyvinyl alcohol, acrylic acid polymers, polymers having hydroxyquinoline, cellulose, starch, acetal, polyvinylpyrrolidone and ternary polymers. A low molecular weight gelatin is preferably used. The weight average molecular weight of the low molecular weight gelatin is preferably 30,000 or less, more preferably 10,000 or less.

The grain formation temperature at the preparation of fine silver halide grains is preferably 35° C. or less, more preferably 25° C. or less. The temperature of the reaction vessel to which fine silver halide grains are added is 50° C. or more, preferably 60° C. or more, more preferably 70° C. or more.

The grain size of fine-size silver halide for use in the present invention can be determined by placing the grain on a mesh and observing the grain as it is through a transmission electron microscope. The size of the fine grain of the present invention is preferably 0.3 μm or less, more preferably 0.1 μm or less, still more preferably 0.01 μm or less. This fine silver halide may be added simultaneously with the addition of other halide ion and silver ion or only the fine silver halide may be added. The fine silver halide grain is mixed to a concentration of 0.005 to 20 mol %, preferably from 0.01 to 10 mol %, based on the entire silver halide.

The silver iodide content of individual grains can be measured by analyzing the composition of individual grains by means of an X-ray microanalyzer. The "coefficient of variation in the iodine distribution among grains" means a value defined by the formula:

$$(\text{standard deviation}/\text{average silver iodide content})\times 100=\text{coefficient of variation}$$

wherein the standard deviation of silver iodide content and the average silver iodide content are obtained by measuring the silver iodide content of at least 100, preferably 200 or more, and more preferably 300 or more emulsion grains. The measurement of silver iodide content of individual grains is described, for example, in European Patent 147868. A correlation is sometimes present or not present between the silver iodide content Yi (mol %) of individual grains and the equivalent-sphere diameter Xi (micron) of each grain, but is preferably not present therebetween. The structure relating to the silver halide composition of a grain of the present invention can be confirmed by combining, for example, X-ray diffraction, an EPMA method (a method of scanning a silver halide grain are scanned by an electron beam and thereby detecting the silver halide composition) and an ESCA method (a method of irradiating an X ray and spectrally separating photoelectrons emitted from the grain surface). In measuring the silver iodide content in the present invention, the "grain surface" means the region in a depth of about 50 Å from the surface and the "grain inside" means the region except for the above-described surface. The halogen composition of the grain surface can be usually measured by an ESCA method.

In the present invention, a grain having a regular crystal form such as cubic, octahedral and tetradecahedral form, or an amorphous twin grain can be used other than the tabular grain.

The silver halide emulsion of the present invention is preferably subjected to selenium sensitization or gold sensitization, more preferably to selenium sensitization.

The selenium sensitizer which can be used in the present invention may be a selenium compound disclosed in conventionally known patents. Usually, a labile selenium compound and/or a non-labile selenium compound is added and the emulsion is stirred at a high temperature, preferably at 40° C. or more, for a fixed time. Preferred examples of the labile selenium compound include the compounds described in JP-B-44-15748, JP-B-43-13489, JP-A-4-25832 and JP-A-4-109240.

Specific examples of the labile selenium sensitizer include isoselenocyanates (for example, aliphatic isoselenocyanates such as allyl isoselenocyanate), selenoureas, selenoketones, selenoamides, selenocarboxylic acids (e.g., 2-selenopropionic acid, 2-selenobutyric acid), selenoesters, diacyl selenides (e.g., bis(3-chloro-2,6-dimethoxybenzoyl)selenide), selenophosphates, phosphine selenides and colloidal metal selenium.

Preferred categories of the labile selenium compound are described above but the present invention is not limited thereto. As for the labile selenium compound as a sensitizer for photographic emulsions, it is generally understood by one skilled in the art that the structure of the compound is not particularly important insofar as the selenium is labile and the organic moiety of the selenium sensitizer molecule plays no part other than to carry selenium and allow the selenium in a labile form to be present in emulsion. In the present invention, labile selenium compounds having such a wide concept are advantageously used.

Examples of the non-labile selenium compound which can be used in the present invention include the compounds described in JP-B-46-4553, JP-B-52-34492 and JP-B-52-34491. Specific examples of the non-labile selenium compound include selenious acid, potassium selenocyanate, selenazoles, quaternary salt of selenazoles, diaryl selenide, diaryl diselenide, dialkyl selenide, dialkyl diselenide, 2-selenazolidinedione, 2-selenooxazolidinethione and derivatives thereof.

The selenium sensitizer is dissolved in water, a sole organic solvent such as methanol and ethanol, or a mixed solvent thereof, and added at the chemical sensitization, preferably before the initiation of chemical sensitization. The selenium sensitizer used is not limited to one selenium sensitizer but two or more of the above-described sensitizers may also be used in combination. A combination use of a labile selenium compound and a non-labile selenium compound is preferred.

The amount added of the selenium sensitizer which can be used in the present invention varies depending on the activity of selenium sensitizer used, the kind and size of silver halide, and the temperature and time period of ripening, however, the amount added is preferably from $2\times10^{-6}$ to $5\times10^{-6}$ mol per mol of silver halide. In the case of using a selenium sensitizer, the chemical sensitization temperature is preferably from 40 to 80° C. The pAg and pH may be freely selected. For example, with a pH over a wide range from 4 to 9, the effect of the present invention can be obtained.

The selenium sensitization can be more effectively achieved by performing the sensitization in the presence of a silver halide solvent.

Examples of the silver halide solvent which can be used in the present invention include (a) organic thioethers described in U.S. Pat. Nos. 3,271,157, 3,531,289 and 3,574,628, JP-A-54-1019 and JP-A-54-158917, (b) thiourea derivatives described in JP-A-53-82408, JP-A-55-77737 and JP-A-55-2982, (c) silver halide solvents having a thiocarbonyl group sandwiched by an oxygen or sulfur atom and a nitrogen atom described in JP-A-53-144319, (d) imidazoles described in JP-A-54-100717, (e) sulfite and (f) thiocyanate.

Particularly, the silver halide solvent is preferably thiocyanate or tetramethylthiourea. The amount of the solvent used varies depending on the kind, but the amount used is preferably from $1\times10^{-4}$ to $1\times10^{-2}$ mol per mol of silver halide.

The gold sensitizer for use in the gold sensitization may have a gold oxidation number of either +1 or +3 and gold compounds commonly used as the gold sensitizer can be used. Representative examples thereof include chloroauric acid salt, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The amount of the gold sensitizer added varies depending on various conditions but, as -a rough standard, the amount added is preferably from $1\times10^{-7}$ to $5\times10^{-5}$ mol per mol of silver halide.

In the chemical sensitization of the emulsion of the present invention, sulfur sensitization is preferably used in combination.

The sulfur sensitization is generally performed by adding a sulfur sensitizer and stirring the emulsion at a high temperature, preferably at 40° C. or above, for a fixed time.

In the sulfur sensitization, those known as the sulfur sensitizer can be used. Examples thereof include thiosulfate, allylthiocarbamidothiourea, allyl isothiacyanate, cystine, p-toluenethiosulfonate and rhodanine. Other than these, sulfur sensitizers described, for example, in U.S. Pat. Nos. 1,574,944, 2,410,689, 2,278,947, 2,728,668, 3,501,313 and 3,656,955, German Patent No. 1,422,869, JP-B-56-24937 and JP-A-55-45016 may also be used. The amount of the sulfur sensitizer added is sufficient if it is large enough to effectively increase the sensitivity of the emulsion. This amount varies over a fairly wide range depending on various conditions such as pH, temperature and size of silver halide grain, but is preferably from $1\times10^{-7}$ to $5\times10^{-5}$ mol per mol of silver halide.

The silver halide emulsion of the present invention may also be subjected to reduction sensitization during grain formation, after grain formation but before chemical sensitization, or during or after chemical sensitization.

For the reduction sensitization, any method may be selected from a method of adding a reduction sensitizer to the silver halide emulsion, a method called silver ripening of performing t he growth or ripening in a low pAg atmosphere at a pAg of 1 to 7, and a method called high pH ripening of performing the growth or ripening in a high pH atmosphere at a pH of 8 to 11. Also, two or more methods may be used in combination.

The method of adding a reduction sensitizer is advantageous in that the level of reduction sensitization can be subtly adjusted.

Examples of known reduction sensitizers include stannous salt, ascorbic acid and derivatives thereof, amines and polyamines, hydrazine derivatives, formamidine-sulfinic acid, silane compounds and borane compounds. In the reduction sensitization of the present invention, a sensitizer may be selected from these known reduction sensitizers and used. Also, two or more compounds may be used in combination. Preferred compounds as the reduction sensitizer are stannous chloride, thiourea dioxide, dimethylaminoborane, ascorbic acid and derivatives thereof. The amount of the reduction sensitizer added depends on the emulsion production conditions and therefore, must be selected, however, the amount added is suitably from $10^{-7}$ to $10^{-3}$ mol per mol of silver halide.

The reduction sensitizer is dissolved in water or an organic solvent such as alcohols, glycols, ketones, esters and amides and added during the grain growth. The reduction sensitizer may be previously added to a reaction vessel but is preferably added at an appropriate time during the grain growth. Also, the reduction sensitizer may be previously added to an aqueous solution of water-soluble silver salt or water-soluble alkali halide and by using this aqueous solution, silver halide grains may be precipitated. Furthermore, a method of adding the reduction sensitizer solution in several parts as the grain growth proceeds or continuously adding the reduction sensitizer over a long period of time is also preferred.

During the preparation of the emulsion of the present invention, an oxidizing agent for silver is preferably used. The term "oxidizing agent for silver" as used herein means a compound having a function of acting on metal silver to convert it into silver ion. In particular, a compound capable of converting very small silver grains generated as a by-product during the formation and chemical sensitization of silver halide grains, into silver ion is effective. The silver ion produced here may form a sparingly water-soluble silver salt such as silver halide, silver sulfide and silver selenide, or may form a readily water-soluble silver salt such as silver nitrate. The oxidizing agent for silver may be an inorganic material or an organic material. Examples of the inorganic oxidizing agent include ozone, hydrogen peroxide; adducts thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2.6H_2O]$), oxygen acid salts such as permanganate (e.g., $KMnO_4$) and chromate (e.g., $K_2Cr_2O_7$), halogen elements such as iodine and bromine, perhalogenates (e.g., potassium periodate), salts of metal having a high valency (e.g., potassium hexacyanoferrate), and thiosulfonates.

Examples of the organic oxidizing agent include quinones such as p-quinone, organic peroxides such as peracetic acid and perbenzoic acid, and active halogen-releasing compounds (for example, N-bromosuccinimide, Chloramine T, Chloramine B).

Among these oxidizing agents, preferred in the present invention are inorganic oxidizing agents such as ozone, hydrogen peroxide or adduct thereof, halogen element and thiosulfonate, and organic oxidizing agents such as quinones.

In a preferred embodiment, the above-described reduction sensitization is used in combination with the oxidizing agent for silver. A method of using the oxidizing agent and then performing the reduction sensitization or a method reversed thereto may be used. This method can be applied at the grain formation or chemical sensitization.

In the present invention, a compound where one-electron oxidant produced by one-electron oxidation can release one or more electron is preferably contained.

This compound is described in detail in Japanese Patent Application Nos. 2002-192373, 2002-188537, 2002-188536 and 2001-272137 and the compounds described in these patent applications can be preferably used. The compound is also described in detail in JP-A-9-211769 (Compounds PMT-1 to S-37 shown in Tables E and F at pages 28 to 32), JP-A-9-211774, JP-A-11-95355 (Compounds INVL to INV36), JP-T-2001-500996 (the term "JP-T" as used herein means a "published Japanese translation of a PCT patent application") (Compounds 1 to 74, 80 to 87 and 92 to 122), U.S. Pat. Nos. 5,747,235 and 5,747,236, EP-A-786692 (Compounds INV1 to INV35), EP-A-893732 and U.S. Pat. Nos. 6,054,260 and 5,994,051. The compounds called "one-photon two-electron sensitizer" or "deprotonated electron-donating sensitizer" described in these patent publications can be preferably used, and the former compounds are more preferred.

The distance between twin planes of the silver halide grain for use in the present invention is preferably 0.017 μm or less, more preferably from 0.007 to 0.017 μm, still more preferably from 0.007 to 0.015 μm.

The fogging during aging of the silver halide emulsion of the present invention can be improved by adding and dissolving a previously prepared silver iodobromide emulsion at the chemical sensitization. The timing of addition may be any time during the chemical sensitization, but it is preferred to first add and dissolve the silver iodobromide emulsion and then add a sensitizing dye and a chemical sensitizer in this order. The silver iodobromide emulsion used has an iodine content lower than the surface iodine content of a host grain and this emulsion is preferably a pure silver bromide emulsion. The size of the silver iodobromide emulsion is not limited as long as it can be completely dissolved, but the equivalent-sphere diameter is preferably 0.1 μm or less, more preferably 0.05 μm or less. The amount of the silver iodobromide emulsion added varies depending on the host grain used, but basically, the amount added is preferably from 0.005 to 5 mol %, more preferably from 0.1 to 1 mol %, per mol of silver.

In the emulsion for use in the present invention, a normal dopant known to be useful for a silver halide emulsion can be used. Examples of the normal dopant include Fe, Co, Ni, Ru, Rh, Pd, Re, Os, Ir, Pt, Au, Hg, Pb and Tl. In the present invention, hexacyanoiron(II) complex and hexacyanoruthenium complex (hereinafter sometimes simply referred to as "metal complex") are preferably used.

The amount of the metal complex added is preferably from $10^{-7}$ to $10^{-3}$ mol, more preferably from $1.0\times10^{-5}$ to $5\times10^{-4}$ mol, per mol of silver halide.

The metal complex for use in the present invention may be added and incorporated at any stage in the preparation of silver halide grains, that is, nucleation, growth, physical ripening and before or after chemical sensitization. Also, the metal complex may be added and incorporated in several parts. However, 50% or more of the entire content of the metal complex contained in a silver halide grain is preferably present in a layer within ½ as silver amount from the outermost surface of the silver halide grain used. On the outer side of the metal complex-containing layer with respect to the support, a layer not containing a metal complex may also be provided.

The metal complex is preferably incorporated by dissolving it in water or in an appropriate solvent and adding the resulting solution directly to the reaction solution during the formation of silver halide grains, or by adding it to an aqueous halide solution, an aqueous silver salt solution or other solution for the formation of silver halide grains and then performing the grain formation. Also, a method of adding and dissolving silver halide grains where the metal complex is previously incorporated, and depositing the grain on another silver halide grain, thereby incorporating the metal complex, is preferred.

With respect to the hydrogen ion concentration in the reaction solution at the addition of the metal complex, the pH is preferably from 1 to 10, more preferably from 3 to 7.

In the present invention, compounds useful for the elevation of sensitivity of a silver halide photographic light-sensitive material described, for example, in EP-A-1016902 and U.S. Pat. Nos. 2002/0,042,033A and 6,319,660B1 are preferably used.

In a multilayer silver halide color photographic light-sensitive material, the unit light-sensitive layers are generally arranged in the order of a red color-sensitive layer, a green color-sensitive layer and a blue color-sensitive layer from the support side. However, depending upon the purpose, this arrangement order may be reversed or a layer having different light sensitivity may be interposed between layers having the same color sensitivity. A light-insensitive layer -may also be provided between the above-described silver halide light-sensitive layers or as an uppermost or lowermost layer. This layer may contain a coupler, a DIR compound, a color mixing inhibitor and the like, which are described later. The plurality of silver halide emulsion layers constituting each unit light-sensitive layer are preferably arranged such that the light sensitivity sequentially decreases toward the support by using two layers of a high-sensitivity emulsion layer and a low-sensitivity emulsion layer as described in German Patent 1,121,470 and British Patent 923,045. It is also possible to provide a low-sensitivity emulsion layer in the side farther from the support and provide a high-sensitivity emulsion layer in the side closer to the support as described in JP-A-57-112751, JP-A-62-200350, JP-A-62-206541 and JP-A-62-206543.

Specific examples of the layer arrangement from the side remotest from the support include an order of low-sensitivity blue-sensitive layer (BL)/high-sensitivity blue-sensitive layer (Be)/high-sensitivity green-sensitive layer (GH)/low-sensitivity green-sensitive layer (GL)/high-sensitivity red-sensitive layer (RH)/low-sensitivity red-sensitive layer (AL), an order of BH/BL/GL/GH/RH/RL and an order of BH/BL/GH/GL/RL/RH.

Also, as described in JP-B-55-34932, arrangement in the order of blue-sensitive layer/GH/RH/GL/RL from the side remotest from the support may be employed. Furthermore, as described in JP-A-56-25738 and JP-A-62-63936, arrangement in the order of blue-sensitive layer/GL/RL/GH/RH from the side remotest from the support may also be employed.

In addition, arrangement consisting of three layers differing in the light sensitivity may be used as described in JP-B-49-15495, where a silver halide emulsion layer having highest light sensitivity is provided as an upper layer, a silver halide emulsion layer having light sensitivity lower than that of the upper layer is provided as a medium layer and a silver halide emulsion layer having light sensitivity lower than that of the medium layer is provided as a lower layer so as to sequentially decrease the light sensitivity toward the support. Also in this structure consisting of three layers differing in the light sensitivity, the layers having the same color sensitivity may be disposed in the order of medium-sensitivity emulsion layer/high-sensitivity emulsion layer/low-sensitivity emulsion layer from the side remote from the support as described in JP-A-59-202464.

Other than this, the layers may also be disposed in the order of high-sensitivity emulsion layer/low-sensitivity emulsion layer/medium-sensitivity emulsion layer, or low-sensitivity emulsion layer/medium-sensitivity emulsion layer/high-sensitivity emulsion layer.

The layer arrangement may be changed as described above also in the case of four or more layers.

In order to improve the color reproducibility, an interlayer inhibiting effect is preferably utilized.

The silver halide grain for use in the layer of giving an interlayer effect to the red-sensitive layer is not particularly limited in, for example, the size or shape thereof, however, a so-called tabular grain having a high aspect ratio, a monodisperse emulsion having a uniform grain size, or a silver iodobromide grain having an iodine layer structure is preferably used. Furthermore, for enlarging the exposure latitude, two or more emulsions differing in the grain size are preferably mixed.

The donor layer of giving an interlayer effect to the red-sensitive layer may be provided at any position on the support but is preferably provided at a position closer to the support than the blue-sensitive layer and remoter from the support than the red-sensitive layer. Also, the donor layer is preferably positioned in the side closer to the support than the yellow filter layer.

The donor layer of giving an interlayer effect to the red-sensitive layer is more preferably provided in the side closer to the support than the green-sensitive layer and remoter from the support than the red-sensitive layer, and most preferably in adjacent to the green-sensitive layer in the side close to the support. The term "in adjacent to" as used herein means that an interlayer or the like is not intervening therebetween.

The layer of giving an interlayer effect to the red-sensitive layer may comprise a plurality of layers. In this case, these layers may be adjacent to each other or may be separated from each other.

In the present invention, the solid disperse dye described in JP-A-11-305396 can be used.

The emulsion for use in the light-sensitive material of the present invention may be a surface latent image-type emulsion where a latent image is mainly formed on the surface, an internal latent image-type emulsion where a latent image is formed inside a grain, or an emulsion having a latent image both on the surface and in the inside of a grain, however, the emulsion must be a negative-type emulsion. The internal latent image-type emulsion may be a core/shell internal latent image-type emulsion described in JP-A-63-264740 and the preparation method thereof is described in JP-A-59-133542. The thickness of the shell of this emulsion is preferably from 3 to 40 nm, more preferably from 5 to 20 nm, though this varies depending on the development processing or the like.

The silver halide emulsion is usually subjected to physical ripening, chemical ripening and spectral sensitization before use. The additives used in these steps are described in RD Nos. 17643, 18716 and 307105 and the pertinent portions thereof are summarized in the Table later.

In the same layer of the light-sensitive material of the present invention, a mixture of two or more emulsions differing in at least one property of the light-sensitive silver halide emulsion, that is, grain size, grain size distribution, halogen composition, grain shape or sensitivity, may be used.

A silver halide grain with the grain surface being fogged described in U.S. Pat. No. 4,082,553, a silver halide grain with the grain inside being fogged described in U.S. Pat. No. 4,626,498 and JP-A-59-214852 or a colloidal silver is preferably applied to a light-sensitive silver halide emulsion layer and/or a substantially light-insensitive hydrophilic colloid layer. The term "silver halide grain with the grain inside or surface being fogged" as used herein means a silver halide grain which can be uniformly (non-imagewise) developed irrespective of an unexposed area or an exposed area of the light-sensitive material. The preparation method of such a grain is described in U.S. Pat. No. 4,626,498 and JP-A-59-214852. The silver halide constituting the inner core of a core/shell type silver halide grain with the grain inside being fogged may have a different halogen composition. The silver halide with the grain inside or surface being fogged may be any of silver chloride, silver chlorobromide, silver iodobromide and silver chloroiodobromide. The fogged silver halide grain preferably has an average grain size of 0.01 to 0.75 μm, more preferably from 0.05 to 0.6 μm. The grain may have a regular shape and the emulsion may be a polydisperse emulsion, but the emulsion is preferably a monodisperse emulsion (an emulsion where at least 95% by mass or number of silver halide grains have a grain size within the average grain size ±40%).

In the present invention, a light-insensitive fine grain silver halide is preferably used. The term "light-insensitive fine grain silver halide" as used herein means a silver halide fine grain which is not exposed at the imagewise exposure for obtaining a dye image and is substantially not developed at the development processing of the dye image. The light-insensitive fine grain silver halide is preferably not fogged in advance. This fine grain silver halide has a silver bromide content of 0 to 100 mol % and, if desired, may contain silver chloride and/or silver iodide, but preferably contains from 0.5 to 10 mol % of silver iodide. Furthermore, this fine grain silver halide preferably has an average grain size (an average of equivalent-circle diameters of the projected areas) of 0.01 to 0.5 μm, more preferably from 0.02 to 0.2 μm.

This fine grain silver halide can be prepared by the same method as those for normal light-sensitive silver halide. The surface of the silver halide grain needs not be optically sensitized and also needs not be spectrally sensitized. However, a known stabilizer such as triazole-base compound, azaindene-base compound, benzothiazolium-base compound, mercapto-base compound or zinc compound is preferably added to the fine grain silver halide prior to the addition to a coating solution. The layer containing this fine silver halide grain may contain colloidal silver.

In the light-sensitive material of the present invention, various additives described above are used but various additives other than those may also be used according to the purpose.

These additives are more specifically described in *Research Disclosure*, Item 17643 (December, 1978), ibid., Item 18716 (November, 1979) and ibid., Item 308119 (December, 1989). The pertinent portions are shown together in the Table below.

| | Kinds of Additives | RD17643 | RD18716 | RD308119 |
|---|---|---|---|---|
| 1. | Chemical sensitizer | p. 23 | p. 648, right col. | p. 996 |
| 2. | Sensitivity increasing agent | | p. 648, right col. | |
| 3. | Spectral sensitizer, supersensitizer | pp. 23–24 | p. 648, right col. to p. 649, right col. | p. 996, right to p. 998, right |
| 4. | Brightening agent | p. 24 | | p. 998, right |
| 5. | Antifoggant, stabilizer | pp. 24–25 | p. 649, right col. | p. 998, right to p. 1000, right |
| 6. | Light absorbent, filter dye, UV absorbent | pp. 25–26 | p. 649, right col. to p. 650, left col. | p. 1003, left to right |
| 7. | Stain inhibitor | p. 25, right col. | p. 650, left to right cols. | p. 1002, right |
| 8. | Dye Image Stabilizer | p. 25 | | p. 1002, right |

-continued

| | Kinds of Additives | RD17643 | RD18716 | RD308119 |
|---|---|---|---|---|
| 9. | Hardening agent | p. 26 | p. 651, left col. | p. 1004, right to p. 1005, left |
| 10. | Binder | p. 26 | p. 651, left col. | p. 1003, right to p. 1004, right |
| 11. | Plasticizer, lubricant | p. 27 | p. 650, right col. | p. 1006, left to right |
| 12. | Coating aid, surfactant | pp. 26–27 | p. 650, right col. | p. 1005, left to p. 1006, left |
| 13. | Antistatic agent | p. 27 | p. 650, right col. | p. 1006, right to p. 1007, left |
| 14. | Matting agent | | | p. 1008, left to p. 1009, left |

The techniques such as layer arrangement, the silver halide emulsion, the dye-forming coupler, the functional couplers such as DIR; coupler, various additives and the development processing, which can be used for the emulsion of the present invention and for the photographic light-sensitive material using the emulsion, are described in EP-A-0565096 (published on Oct. 13, 1993) and patents cited therein. Respective items and the portions describing the items are enumerated below.

1. Layer structure:
page 61, lines 23 to 35 and from page 61, line 41 to page 62, line 14
2. Interlayer:
page 61, lines 36 to 40
3. Interlayer effect-imparting layer:
page 62, lines 15 to 18
4. Silver halide halogen composition:
page 62, lines 21 to 25
5. Silver halide grain crystal habit:
page 62, lines 26 to 30
6. Silver halide grain size:
page 62, lines 31 to 34
7. Production method of emulsion:
page 62, lines 35 to 40
8. Silver halide grain size distribution:
page 62, lines 41 to 42
9. Tabular grain:
page 62, lines 43 to 46
10. Inner structure of grain:
page 62, lines 47 to 53
11. Latent image formation-type emulsion:
from page 62, line 54 to page 63, line 5
12. Physical ripening/chemical ripening of emulsion:
page 63, lines 6 to 9
13. Use of a mixture of emulsions:
page 63, lines 10 to 13
14. Fogged emulsion:
page 63, lines 14 to 31
15. Light-insensitive emulsion:
page 63, lines 32 to 43
16. Coated silver amount:
page 63, lines 49 to 50
17. Formaldehyde scavenger:
page 64, lines 54 to 57
18. Mercapto-base antifoggant:
page 65, lines 1 and 2
19. Fogging agent or the like-releasing agent:
page 65, lines 3 to 7
20. Dye:
page 65, lines 7 to 10
21. Color couplers in general:
page 65, lines 11 to 13
22. Yellow, magenta and cyan couplers:
page 65, lines 14 to 25
23. Polymer coupler:
page 65, lines 26 to 28
24. Diffusive dye-forming coupler:
page 65, lines 29 to 31
25. Colored coupler:
page 65, lines 32 to 38
26. Functional couplers in general:
page 65, lines 39 to 44
27. Bleaching accelerator-releasing coupler:
page 65, lines 45 to 48
28. Development accelerator-releasing coupler:
page 65, lines 49 to 53
29. Other DIR couplers:
from page 65, line 54 to page 66, line 4
30. Coupler dispersing method:
page 66, lines 5 to 28
31. Antiseptic/antifungal:
page 66, lines 29 to 33
32. Kind of light-sensitive material:
page 66, lines 34 to 36
33. Thickness and swelling rate of light-sensitive layer:
from page 66, line 40 to page 67, line 1
34. Back layer:
page 67, lines 3 to 8
35. Development processing in general:
page 67, lines 9 to 11
36. Developer and developing agent:
page 67, lines 12 to 30
37. Developer additives:
page 67, lines 31 to 44
38. Reversal processing:
page 67, lines 45 to 56
39. Opening ratio of processing solution:
from page 67, line 57 to page 68, line 12
40. Development time;
page 68, lines 13 to 15
41. Bleach-fixing, bleaching and fixing:
from page 68, line 16 to page 69, line 31
42. Automatic developing machine:
page 69, lines 32 to 40
43. Water washing, rinsing and stabilization:
from page 69, line 41 to page 70, line 18
44. Replenishment and re-use of processing solution:
page 70, lines 19 to 23
45. Light-sensitive material self-containing developing Agent:
page 70, lines 24 to 33
46. Development processing temperature:
page 70, lines 34 to 38
47. Use for film with lens:
page 70, lines 39 to 41

As for the material of giving an interlayer effect, a compound which reacts with an oxidation product of a developing agent, obtained by the development, and thereby releases a development inhibitor or a precursor thereof is used. Examples of the compound include DIR (development inhibitor-releasing) couplers, DIR hydroquinone and couplers of releasing DIR hydroquinone or a precursor thereof. In the case of a development inhibitor having high diffusivity, the development inhibiting effect can be obtained no matter where the donor layer is provided in the interlayer multilayer structure. However, the development inhibiting effect also occurs in unintended directions and therefore, for correcting this, the donor layer is preferably color-formed (for example, color-formed to the same color as that of the layer subject to undesirable effect by the development inhibitor). In the present invention, the donor layer of giving an interlayer effect is preferably color-formed to magenta so that the light-sensitive material can have desired spectral sensitivity.

A bleaching solution containing a 2pyridine carboxylic acid or 2,6-pyridine dicarboxylic acid, a ferric salt such as ferric nitrate, and a persulfate described in European Pat. No. 602,600 can also be preferably used. In the case of using this bleaching solution, a stopping step and a water washing step are preferably interposed between the color developing step and the bleaching step and for the stopping solution, an organic acid such as acetic acid, succinic acid and maleic acid is preferably used. Furthermore, for the purpose of pH adjustment or preventing bleach fogging, the bleaching solution preferably contains an organic acid such as acetic acid, succinic acid, maleic acid, glutaric acid and adipic acid, in the range from 0.1 to 2 mol/liter (hereinafter the liter is sometimes denoted as "L", and the milli-liter is sometimes denoted as "mL").

The magnetic recording layer which is preferably used in the present invention is described below.

The magnetic recording layer which is preferably used in the present invention is provided on a support by coating an aqueous or organic solvent-base coating solution obtained by dispersing magnetic particles in a binder.

The magnetic particle which can be used in the present invention includes ferromagnetic iron oxide (e.g., $\gamma$-$Fe_2O_3$), Co-doped $\gamma$-$Fe_2O_3$, Co-doped magnetite, Co-containing magnetite, ferromagnetic chromium dioxide, ferromagnetic metal, ferro-magnetic alloy, hexagonal Ba ferrite, Sr ferrite, Pb ferrite and Ca ferrite. Among these, Co-doped ferromagnetic iron oxide such as Co-doped $\gamma$-Fe2$O_3$ is preferred. The shape of the magnetic particle may be any of acicular, rice grains like, spherical, cubic and platy forms. The specific surface area as $S_{BET}$ is preferably 20 $m^2/g$ or more, more preferably 30 $m^2/g$ or more.

The saturation magnetization ($\sigma s$) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to a surface treatment with silica and/or alumina or with an organic material. Furthermore, the magnetic particle may be subjected to a surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder used for the magnetic particle may be a thermoplastic resin, a thermosetting resin, a radiation-curable resin, a reactive resin, an acid-, alkali- or bio-degradable polymer, a natural polymer (e.g., cellulose derivative, sugar derivative) or a mixture thereof described in JP-A-4-219569. The above-described resin preferably has a Tg of from −40° C. to 300° C. and a weight average molecular weight of from 2,000 to 1,000,000. Examples of the binder include vinyl-base copolymers, cellulose derivatives such as cellulose diacetate, cellulose triacetate, cellulose acetate propionate, cellulose acetate butyrate and cellulose tripropionate, acrylic resins and polyvinyl acetal resins. Gelatin is also preferably used. Among these, cellulose di(tri)acetate is preferred. The binder may be cured by adding an epoxy-base, aziridine-base or isocyanate-base crosslinking agent. Examples of the isocyanate-base crosslinking agent include isocyanates such as tolylenediisocyanate, 4,4'-diphenylmethanediisocyanate, hexamethylenediisocyanate and xylylenediisocyanate, reaction products of the isocyanate described above with a polyalcohol (e.g., a reaction product of 3 mol of tolylenediisocyanate with 1 mol of trimethylolpropane), and polyisocyanates obtained by the condensation of the isocyanate described above. These are described, for example, in JP-A-6-59357.

The magnetic material is preferably dispersed in the binder by the method using a kneader, a pin-type mill or an annular-type mill described in JP-A-6-35092 and these may also be preferably used in combination. The dispersant described in JP-A-5-088283 and other known dispersants may be used. The thickness of the magnetic recording layer is from 0.1 to 10 μm, preferably from 0.2 to 5 μm, more preferably from 0.3 to 3 μm. The mass ratio of the magnetic particle to the binder is preferably from 0.5:100 to 60:100, more preferably from 1:100 to 30:100. The coated amount of magnetic particles is from 0.005 to 3 $g/m^2$, preferably from 0.01 to 2 $g/m^2$, more preferably from 0.02 to 0.5 $g/m^2$. The transmission yellow density of the magnetic recording layer is preferably from 0.01 to 0.50, more preferably from 0.03. to 0.20, still more preferably from 0.04 to 0.15. The magnetic recording layer may be provided by coating or printing on the back surface of a photographic support throughout the back surface or like stripes. For coating the magnetic recording layer, air doctor, blade, air knife, squeeze, soakage, reverse roller, transfer roller, gravure, kiss, cast, spray, dip, bar, extrusion or the like may be used and the coating solution described in JP-A-5-341436 is preferably used.

The magnetic recording layer may be designed to also have functions of, for example, improving lubricity, controlling curling, preventing electrostatic charge, preventing adhesion or abrading the head, or other functional layers may be provided to undertake these functions. At least one or more of particles is preferably an abrasive of an aspheric inorganic particle having a Moh's hardness of 5 or more. The composition of the aspheric inorganic particle is preferably an oxide such as aluminum oxide, chromium oxide, silicon dioxide, titanium dioxide and silicone carbide, a carbide such as silicon carbide and titanium carbide, or a fine particle of diamond or the like. The abrasive may be subjected to a surface treatment with a silane coupling agent or a titanium coupling agent. This particle may be added to the magnetic recording layer or may be overcoated on the magnetic recording layer (for example, as a protective layer or a lubricant layer). The binder used here may be selected from those described above and the same binder as in the magnetic recording layer is preferably used. The light-sensitive material having a magnetic recording layer is described in U.S. Pat. Nos. 5,336,589, 5,250,404, 5,229,259 and 5,215,874 and European Patent 466,130.

The polyester support which is preferably used in the present invention is described below, but the details thereon including light-sensitive material, processing, cartridge and experimental examples, which are referred to later, are described in *JIII Journal of Technical Disclosure* No. 94-6023 (Mar. 15, 1994). The polyester for use in the present invention essentially consists of a diol and an aromatic dicarboxylic acid. Examples of the aromatic dicarboxylic acid include 2,6-naphthalenedicarboxylic acid, 1,5-naphthalenedicarboxylic acid, 1,4-naphthalene-dicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and biphenol. The polymer polymerized from these includes homopolymers such as polyethylene terephthalate, polyethylene naphthalate and polycyclohexanedimethanol terephthalate. Among these, preferred are polyesters containing from 50 to 100 mol % of 2,6-naphthalenedicarboxylic acid, and more preferred is polyethylene-2,6-naphthalate. The weight average molecular weight is approximately from 5,000 to 200,000. The polyester for use in the present invention preferably has a Tg of 50° C. or more, more preferably 90° C. or more.

The polyester support is then preferably heat-treated at a heat treatment temperature of from 40° C. to less than Tg, more preferably from (Tg−20° C.) to less than Tg, so as to have less curling habit. This heat treatment may be performed at a constant temperature within the above-described temperature range or may be performed while cooling. The heat treatment time is preferably from 0.1 to 1,500 hours, more preferably from 0.5 to 200 hours. The support may be heat-treated in a roll form or as a web under conveyance. The surface may be made uneven (for example, by coating electrically conducting inorganic fine particles such as $SnO_2$ or $Sb_2O_5$)) to improve the surface state. Also, it is preferred to make some designs, for example, to knurl the edge part to slightly increase the height only of the edge and thereby prevent cut copy at the winding core portion. The heat treatment may be performed at any stage, that is, after the formation of the support film, after the surface treatment, after the coating of back layer (e.g., antistatic agent, slipping agent) or after the coating of an undercoat layer. The preferred stage is after the coating of an antistatic agent.

An ultraviolet absorbent may be kneaded into the polyester. Alternatively, in order to prevent light piping, a commercially available dye or pigment for polyesters, such as Diaresin produced by Mitsubishi Chemicals Industries, Ltd. or Kayaset produced by Nippon Kayaku K. K., may be kneaded in to attain the purpose.

In the present invention, the support is preferably subjected to a surface treatment so as to obtain good adhesion to a constituent layer of the light-sensitive material. Examples thereof include surface activation treatments such as chemical treatment, mechanical treatment, corona discharge treatment, flame treatment, ultraviolet treatment, high frequency treatment, glow discharge treatment, active plasma treatment, laser treatment, mixed acid treatment and ozone oxidation treatment. Among these surface treatments, preferred are ultraviolet irradiation treatment, flame treatment, corona treatment and glow treatment.

The undercoating method is described below. The undercoat may comprise a single layer or two or more layers. Examples of the binder for the undercoat layer include polyethyleneimine, epoxy resin, grafted gelatin, nitrocellulose and gelatin as well as copolymers starting from a monomer selected from vinyl chloride, vinylidene chloride, butadiene, methacrylic acid, acrylic acid, itaconic acid and maleic acid anhydride. Examples of the compound for swelling the support include resorcin and p-chlorophenol. Examples of the gelatin hardening agent for use in the undercoat layer include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resins and active vinyl sulfone compounds. Furthermore, a fine particle of $SiO_2$, $TiO_2$ or an inorganic material, or a polymethyl methacrylate copolymer fine particle (of 0.01 to 10 μm) may be incorporated as a matting agent.

In the present invention, an antistatic agent is also preferably used. Examples of the antistatic agent include polymers containing a carboxylic acid, a carboxylate or a sulfonate, cationic polymers, and ionic surfactant compounds.

Most preferred antistatic agents are a fine particle of at least one crystalline metal oxide having a volume resistivity of $10^7$ Ω·cm or less, more preferably $10^5$ Ω·cm or less, and a particle size of 0.001 to 1.0 μm, selected from ZnO, $TiO_2$, $SnO_2$, $Al_2O_3$, $In_2O_3$, $SiO_2$, MgO, BaO, $MoO_3$ and $V_2O_5$, or a composite oxide thereof (Sb, P, B, In, S, Si, C, etc.), and a fine particle of a sol-like metal oxide or a composite oxide thereof.

The content of the antistatic agent in the light-sensitive material is preferably from 5 to 500 mg/$m^2$, more preferably from 10 to 350 mg/$m^2$. The ratio of the electrically conducting crystalline oxide or a composite oxide thereof to the binder is preferably from 1/300 to 100/1, more preferably from 1/100 to 100/5.

The light-sensitive material of the present invention preferably has slipperiness. The slipping agent-containing layer is preferably provided on both the light-sensitive layer surface and the back surface. The slipperiness in terms of a coefficient of dynamic friction is preferably from 0.01 to 0.25. This is a value determined when the light-sensitive material is transported at a speed of 60 cm/min (25° C., 60% RH) against a stainless steel ball having a diameter of 5 mm. In this evaluation, even when the other part material is changed to the light-sensitive layer surface, a value almost on the same level is obtained.

Examples of the slipping agent which can be used in the present invention include polyorganosiloxane, higher fatty acid amide, higher fatty acid metal salts and esters of a higher fatty acid with a higher alcohol. Examples of the polyorganosiloxane which can be used include polydimethylsiloxane, polydiethylsiloxane, polystyrylmethylsiloxane and polymethylphenylsiloxane. The layer to which the slipping agent is added is preferably an outermost emulsion layer or a back layer. In particular, polydimethylsiloxane and esters having a long chain alkyl group are preferred.

The light-sensitive material of the present invention preferably contains a matting agent. The matting agent may be present on either the emulsion surface or the back surface but is preferably added to the outermost layer in the emulsion layer side. The matting agent may or may not be soluble in the processing solution and preferably, these two types of matting agents both are used in combination. Preferred examples thereof include polymethyl methacrylate, poly (methyl methacrylate/methacrylic acid=9/1 or 5/5 (by mol)) and particulate polystyrene. The particle size is preferably from 0.8 to 10 μm, the particle size distribution is preferably narrower, and 90% or more by number of all particles preferably have a particle size between 0.9 and 1.1 times the average particle size. In order to increase the matting property, fine particles of 0.8 μm or less are preferably added at the same time and examples thereof include polymethyl methacrylate (0.2 μm), poly(methyl methacrylate/methacrylic acid=9/1 (by mol), 0.3 μm), particulate polystyrene (0.25 μm) and colloidal silica (0.03 μm).

The support for use in the present invention can be prepared by the method described in Example 1 of JP-A-2001-281815.

The film patrone for use in the present invention is described below. The patrone for use in the present invention may be mainly made of a metal or a synthetic plastic.

Preferred plastic materials are polystyrene, polyethylene, polypropylene and polyphenyl ether. The patrone for use in the present invention may further contain various antistatic agents and preferred examples thereof include carbon black, particulate metal oxides, nonionic, anionic, cationic and betaine surfactants, and polymers The patrone imparted with the antistatic property by using such an antistatic agent is described in JP-A-1-312537 and JP-A-1-312538. In particular, the resistance at 25° C. and 25% RH is preferably $10^{12}$ Ω or less. Usually, the plastic patrone is produced using a plastic having kneaded therein carbon black or a pigment so as to impart light-shielding property. The patrone may have a currently used 135 size but it is also effective for achieving miniaturization of a camera to reduce the cartridge size from 25 mm in the current 135 size to 22 mm or less. The volume of the patrone case is preferably 30 $cm^3$ or less, more preferably 25 $cm^3$ or less. The mass of plastic used in the patrone and patrone case is preferably from 5 to 15 g.

A patrone which delivers the film by rotating a spool may also be used in the present invention. Furthermore, the patrone may have such a structure that a film leading end is housed in the patrone body and the film leading end is delivered from the port of the patrone towards the outside by rotating the spool shaft in the film delivery direction. These are disclosed in U.S. Pat. Nos. 4,834,306 and 5,226,613. The photographic film for use in the present invention may be a so-called green film before development or may be a developed photographic film. Also, a green film and a developed photographic film may be housed in the same new patrone or in different patrones.

The color photographic light-sensitive material of the present invention is suitable also as a negative film for advanced photo system (hereinafter referred to as AP system) and examples thereof include NEXIA A, NEXIA F and NEXA H (ISO 200, 100 and 400, respectively) (all manufactured by Fuji Photo Film Co., Ltd., hereinafter referred to as Fuji Film) prepared by processing a film into an AP system format and housing it in a cartridge exclusive to the system. The above-described cartridge film for AP system is used by loading it into a camera for AP system such as Epion Series (e.g., Epion 300Z) manufactured by Fuji Film.

The color photographic light-sensitive material of the present invention is also suitable for the film with lens such as Fuji Color "Utsurundesu" Super Slim and "Utsurundesu" ACE 800, both manufactured by Fuji Film.

The film photographed by such a system is printed through the following steps in the case of a mini-lab system:

(1) receipt (receipt of an exposed cartridge film from users), (2) detaching (the film is transferred from the cartridge to an intermediate cartridge for development processing), (3) development of film, (4) reattaching (return the developed negative film into the original cartridge), (5) printing (C/H/P3-type print and index print are continuously and automatically printed on a color paper [preferably on Super FA8 produced by Fuji Film]), and (6) check and shipping (cartridge and index print are checked by the ID number and shipped together with the print).

Preferred examples of this system include Fuji Film Mini-Lab Champion Super FA-298/F-278/FA-258/FA-238 and Fuji Film Digital Lab System Frontier. Examples of the film processor for the Mini-Lab Champion include FP922AL/FP562B/FP562B,AL/FP362B/FP362B,AL, and the processing chemical recommendable therefor are Fuji Color Just It CN-16L and CN-16Q. Examples of the printer processor include PP3008AR/PP3008A/PP1828AR/PP1828A/PP1258AR/PP1258A/PP728AR/PP728A, and the processing chemical recommendable therefor are Fuji Color Just It CF-47L and CP-40FAII. In the Frontier system, a scanner & image processor SP-1000 and a laser printer & paper processor LP-1000P or a laser printer LP-1000W are used. The detacher for use in the detaching step and the reattacher for use in the reattaching step are preferably DT200/DT100 and AT200/AT100, respectively, manufactured by Fuji Film.

The AP system can also be enjoyed in the photo joy system including the digital image work station Aladdin 1000 manufactured by Fuji Film. For example, a developed AP system cartridge film is directly loaded into Aladdin 1000 or the image information on negative film, positive film or print is input using a 35-mm film scanner FE-550 or a flat head scanner PE-550 and the obtained digital image data can be easily processed and edited. The data can be-output as a print by a light-fixing type heat-sensitive color print-system digital color printer NC-550AL, a laser-exposure heat-development transfer-system Pictrography 3000, or an existing lab instrument through a film recorder. Furthermore, Aladdin 1000 can output the digital information directly into a floppy disk or a zip disk, or into a CD-R through a CD writer.

On the other hand, at homes, the photograph can be enjoyed on TV merely by loading the developed AP system cartridge film into Photo Player AP-1 manufactured by Fuji Film. When loaded into Photo Scanner AS-1 manufactured by Fuji Film, the image information can be continuously taken in at a high rate into a personal computer. For inputting a film, a print or a stereoscopic material into a personal computer, Photo Vision FV-10/FV-5 manufactured by Fuji Film can be used. The image information recorded on a floppy disk, a zip disk, a CD-R or a hard disk can be variously processed and enjoyed on a personal computer by using an application soft Photo Factory produced by Fuji Film. For outputting a high-quality image print from the personal computer, a digital color printer NC-2/NC-2D in a light-fixing type heat-sensitive color print system, manufactured by Fuji Film, is suitably used.

For housing the developed AP system cartridge film, Fuji Color Pocket Album AP-5 Pop L, AP-1 Pop L, AP-1 Pop KG or Cartridge File 16 is preferably used.

The silver halide emulsion prepared by the present invention can be used for either a color photographic light-sensitive material or a black-and-white photographic light-sensitive material. Examples of the color photographic light-sensitive material include color printing paper, color photographing film, color reversal film and color instant film, and examples of the black-and-white photographic light-sensitive material include film for general photographing, X-ray film, film for medical diagnosis, and film for light-sensitive material used for printing.

In the field of film for medical diagnosis and film for light-sensitive material used for printing, the exposure can be efficiently performed by using a laser image setter or a laser imager.

The techniques in these fields are described in JP-A-7-287337, JP-A-4-335342, JP-A-5-313289, JP-A-8-122954 and JP-A-8-292512.

A heat-developable light-sensitive material may also be preferably used. For example, a light-sensitive material having a light-sensitive layer comprising a binder matrix having dispersed therein a catalytic amount of photocatalyst (e.g., silver halide), a reducing agent, a reducible silver salt (e.g., organic silver salt) and if desired, a color control agent for controlling the color of silver is known. Examples thereof include those described in U.S. Pat. Nos. 3,152,904, 3,457,075, 2,910,377 and 4,500,626, JP-B-43-4924, JP-A-

11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and Japanese Patent Application No. 2000-89436.

The method for exposing the silver halide photographic light-sensitive material of the present invention is described below.

Exposure for obtaining a photographic image may be performed by using a normal method. More specifically, any of various known light sources can be used, such as natural light (sunlight), tungsten lamp, fluorescent lamp, mercury lamp, xenon arc lamp, carbon arc lamp, xenon flash lamp, laser, LED and CRT. Also, the light-sensitive photographic material may be exposed with light emitted from a phosphor excited by an electron beam, an X ray, a γ (gamma) ray or an α (alpha) ray.

In the present invention, a laser light source is sometimes preferably used. Examples of the laser ray include those using a helium-neon gas, an argon gas, a krypton gas or a carbon dioxide gas as the laser oscillation medium, those using a solid such as ruby or cadmium as the oscillation medium, and those emitted from a liquid laser or a semiconductor laser. Unlike light usually used for illumination and the like, these laser rays are coherent light having sharp directivity with single frequency and uniform phase and therefore, the silver halide photographic light-sensitive material exposed by using such a laser as a light source must have spectral properties coincided with the emission wavelength of the laser used. Among the above-described lasers, use of a semiconductor laser is preferred.

EXAMPLES

The present invention is described in greater detail below by referring to Examples, however, the present invention should not be construed as being limited thereto.

Example 1

Preparation of Silver Bromide Octahedral Emulsion (Emulsion A) and Silver Bromide Tabular Emulsions (Emulsion B and Emulsion C)

To a reactor, 1,000 ml of water, 25 g of deionized ossein gelatin, 15 ml of an aqueous 50% $NH_4NO_3$ solution and 7.5 ml of an aqueous 25% $NH_3$ solution were added. The mixture was kept at 50° C. and thoroughly stirred and thereto, 750 mL of an aqueous 1N silver nitrate solution and 1 mol/liter of an aqueous potassium bromide solution were added over 50 minutes. During the reaction, the silver potential was kept at −40 mV. The silver bromide grain obtained was octahedral and had an equivalent-sphere diameter of 0.846±0.036 μm. The temperature of the obtained emulsion was lowered and the emulsion was desalted by ultrafiltration. Subsequently, 95 g of deionized ossein gelatin and 430 ml of water were added to adjust the pH and the pAg at 50° C. to 6.5 and 8.3, respectively. After adding potassium thiocyanate, chloroauric acid and sodium thiosulfate to give optimal sensitivity, the emulsion was ripened at 55° C. for 50 minutes. The obtained emulsion was designated as Emulsion A.

In 1.2 liter of water, 6.4 g of potassium bromide and 6.2 g of low molecular weight gelatin having an average molecular weight of 15,000 or less were dissolved and while keeping at 30° C., 8.1 ml of an aqueous 16.4% silver nitrate solution and 7.2 ml of an aqueous 23.5% potassium bromide solution were added by a double jet method over 10 seconds. Subsequently, an aqueous 11.7% gelatin solution was further added and after elevating the temperature to 75° C., the emulsion was ripened for 40 minutes. Thereafter, 370 ml of an aqueous 32.2% silver nitrate solution and an aqueous 20% potassium bromide solution were added over 10 minutes while keeping the silver potential at −20 mV. After the physical ripening for 1 minute, the temperature was lowered to 35° C. As a result, a monodisperse pure silver bromide tabular emulsion (specific gravity: 1.15) having an average projected area diameter of 2.32 μm, a thickness of 0.09 μm and a coefficient of variation in diameter of 15.1% was obtained. After this, the emulsion was desalted by ultrafiltration. While again keeping the temperature at 40° C., 45.6 g of gelatin, 10 ml of an aqueous sodium hydroxide solution in a concentration of 1 mol/liter, 167 ml of water and 1.66 ml of 35% phenoxy ethanol were added and the pAg and the pH were adjusted to 8.3 to 6.20, respectively. After adding potassium thiocyanate, chloroauric acid and sodium thiosulfate to give optimal sensitivity, this emulsion was ripened at 55° C. for 50 minutes. The obtained emulsion was designated as Emulsion B.

Also, an emulsion was prepared by performing the chemical sensitization using potassium thiocyanate, chloroauric acid, pentafluorophenyl-diphenylphosphine selenide and sodium thiosulfate in place of potassium thiocyanate, chloroauric acid and sodium thiosulfate, and the obtained emulsion was designated as Emulsion C.

Assuming that the dye occupation area is 80 $Å^2$, the single layer saturation coverage of Emulsions A, B and C was $5.4\times10^{-4}$ mol/mol-Ag, $1.42\times10^{-3}$ mol/mol-Ag and $1.42\times10^{-3}$ mol/mol-Ag, respectively.

While keeping each of the thus-obtained emulsions at 50° C., dyes and compounds shown in Table 1 were added.

The amount added and addition method are as follows.

Sample 11:

(A-24) $5.4\times10^{-4}$ mol/mol-Ag

Sample 12:

(E-15) $5.4\times10^{-4}$ mol/mol-Ag

Sample 13:

10 Minutes after adding (A-24) $5.4\times10^{-4}$ mol/mol-Ag, (A-30) $5.4\times10^{-4}$ mol/mol-Ag was added and after 10 minutes, (A-24) $5.4\times10^{-4}$ mol/mol-Ag was further added.

Sample 14:

10 Minutes after adding (Eg15) $5.4\times10^{-4}$ mol/mol-Ag, (E-19) $5.4\times10^{-4}$ mol/mol-Ag was added and after 10 minutes, (E-15) $5.4\times10^{-4}$ mol/mol-Ag was further added.

Samples 15 and 19:

(A-24) $1.42\times10^{-4}$ mol/mol-Ag

Samples 16 and 20:

(E-15) $1.42\times10^{-4}$ mol/mol-Ag

Samples 17 and 21:

10 Minutes after adding (A-24) $1.42\times10^{-4}$ mol/mol-Ag, (A-30) $1.42\times10^{-4}$ mol/mol-Ag was added and after 10 minutes, (A-24) $1.42\times10^{-4}$ mol/mol-Ag was further added.

Samples 18 and 22:

10 Minutes after adding (E-15) $1.42\times10^{-4}$ mol/mol-Ag, (E-19) $1.42\times10^{-4}$ mol/mol-Ag was added and after 10 minutes, (E-15) $1.42\times10^{-4}$ mol/mol-Ag was further added.

Sample 23:

10 Minutes after adding (A-24) $1.42\times10^{-4}$ mol/mol-Ag, (F1-55) $1.42\times10^{-4}$ mol/mol-Ag was added and after 10 minutes, (F-32) $1.42\times10^{-4}$ mol/mol-Ag was further added.

Sample 24:

10 Minutes after adding (A-24) $1.42\times10^{-4}$ mol/mol-Ag, (G-10) $1.42\times10^{-4}$ mol/mol-Ag was added and after 10 minutes, (G-9) $1.42\times10^{-4}$ mol/mol-Ag was further added.

Here, the sensitizing dyes and compounds each was used as a solid fine dispersion prepared by the method described in JP-A-11-52507. More specifically, 0.8 parts by mass of sodium nitrate and 3.2 parts by mass of sodium sulfate were dissolved in 43 parts of ion exchanged water and thereto 13 parts by mass of a sensitizing dye or compound was added and dispersed by using a dissolver blade at 2,000 rpm for 20 minutes under the condition of 60° C. to obtain a solid dispersion of the sensitizing dye or compound.

The adsorbed amount of the dye or the compound of the present invention was determined as follows. The liquid emulsion in the coating solution of (4) was centrifuged at 10,000 rpm for 10 minutes, the precipitate was freeze-dried, and 25 ml of an aqueous 25% sodium thiosulfate solution and methanol were added to 0.05 g of the precipitate to make 50 ml. The resulting solution was analyzed by high-performance liquid chromatography and the dye or compound concentration was determined by quantitation. From the thus-obtained amount of dye adsorbed and the single layer saturation coverage, the total number of layers adsorbed of dye chromophore was determined.

The light absorption intensity per unit area was measured as follows. The emulsion in the coating solution of (4) was thinly coated on a slide glass and the transmission spectrum and reflection spectrum of individual grains were measured by means of a microspectrophotometer MSP65 manufactured by Karl Zweiss according to the following method to determine the absorption spectrum. For the reference of transmission spectrum, the area where grains were not present was used, and for the reference of reflection spectrum, the value obtained by measuring silicon carbide of which reflectance is known was used. The measured area was a circular aperture part having a diameter of 1 μm. After adjusting the position to prevent the contour of a grain from overlapping the aperture part, the transmission spectrum and reflection spectrum were measured in the wave number region from 10,000 cm, (1,000 nm) to 28,000 $cm^{-1}$ (357 nm). The absorption spectrum was determined from the absorption factor A which was 1—T (transmittance)—R (reflectance). Using the absorption factor A' obtained by subtracting the absorption of silver halide, −Log(1−A') was integrated with respect to the wave number ($cm^{-1}$) and the value obtained was halved and used as the light absorption intensity per unit area. The integration range was from 10,000 to 28,000 $cm^{-1}$ At this time, the light source used was a tungsten lamp and the light source voltage was 8 V. In order to minimize the damage of dye due to light irradiation, a monochromator in the primary side was used and the wavelength distance and the slit width were set to 2 nm and 2.5 nm, respectively. The absorption spectrum and light absorption intensity were determined on 200 grains and the average thereof was employed.

(4) Preparation of Coated Sample

As shown in Table 1, the emulsion obtained above and an emulsified product (prepared from a coupler, B-1, tricresyl phosphate and an aqueous gelatin solution) were mixed for 60 minutes and thereafter, an emulsion layer and a protective layer were coated on a triacetyl cellulose film support having provided thereon ah undercoat layer to form a constitution shown in Table 1, thereby preparing a sample.

TABLE 1

Emulsion Coating Conditions (1) Emulsion Layer

Emulsion: Emulsion A, B or C (dye used is shown in Table 2) — ($2.1\times10^{-2}$ mol/$m^2$ as silver)

Coupler: — ($1.5\times10^{-3}$ mol/$m^2$)

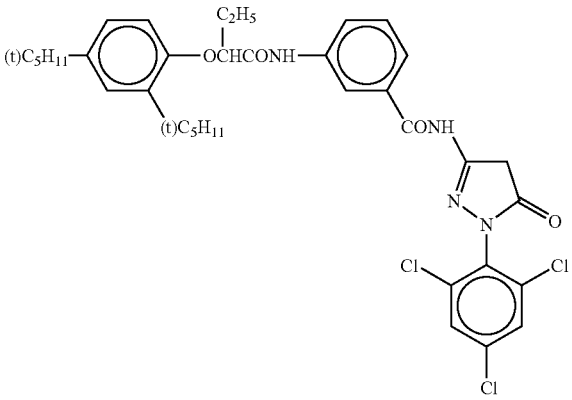

B-1: — (0.47 g/$m^2$)

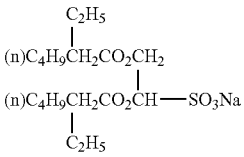

Tricresyl phosphate — (1.10 g/$m^2$)

Gelatin — (2.30 g/$m^2$)

(2) Protective Layer 2,4-Dichloro-6-hydroxy-s-triazine sodium salt — (0.08 g/$m^2$)

Gelatin — (1.80 g/$m^2$)

These samples each was subjected to exposure for sensitometry (1/100 seconds) by using a tungsten bulb (color temperature: 2,854 K) while cutting light of 500 nm or less by using, as a color filter, Fuji Gelatin Filter SC-50 (manufactured by Fuji Photo Film Co., Ltd.) for minus blue exposure so as to excite the dye side and then subjected to the following color development.

Processing Method:

| Step | Processing Time | Processing Temperature (° C.) | Replenishing Amount (ml) | Tank Volume (liter) |
|---|---|---|---|---|
| Color development | 2 min 45 sec | 38 | 33 | 20 |
| Bleaching | 6 min 30 sec | 38 | 25 | 40 |
| Water washing | 2 min 10 sec | 24 | 1,200 | 20 |
| Fixing | 4 min 20 sec | 38 | 25 | 30 |
| Water washing (1) | 1 min 05 sec | 24 | counter-current piping system from (2) to (1) | 10 |
| Waster washing (2) | 1 min 00 sec | 24 | 1,200 | 10 |
| Stabilization | 1 min 05 sec | 38 | 25 | 10 |
| Drying | 4 min 20 sec | 55 | | |

The replenishing amount was per 1-m length in 35-mm width.

The composition of each processing solution is shown below.

| | Mother Solution (g) | Replenisher (g) |
|---|---|---|
| (Color Developer) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 ml | — |
| Hydroxylamine sulfate | 2.4 | 2.8 |
| 4-[N-Ethyl-N-(β-hydroxyethyl)-amino]-2-methylaniline sulfate | 4.5 | 5.5 |
| Water to make | 1.0 liter | 1.0 liter |
| Ph | 10.05 | 10.05 |
| (Bleaching Solution) | | |
| Sodium ethylenediamine-tetraacetatoferrate tihydrate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| PH | 6.0 | 5.7 |
| (Fixing Solution) | | |
| Sodium ethylenediaminetetraacetate | 0.5 | 0.7 |
| Sodium sulfite | 7.0 | 8.0 |
| Sodium bisulfite | 5.0 | 5.5 |

-continued

| | Mother Solution (g) | Replenisher (g) |
|---|---|---|
| Aqueous ammonium thiosulfate solution (70%) | 170.0 ml | 200.0 ml |
| Water to make | 1.0 liter | 1.0 liter |
| PH | 6.7 | 6.65 |
| (Stabilizing Solution) | | |
| Formalin (37%) | 2.0 ml | 3.0 ml |
| Polyoxyethylene-p-monononylphenyl ether (average polymerization degree: 10) | 0.3 | 0.45 |
| Disodium ethylenediaminetetraacetate | 0.05 | 0.08 |
| Water to make | 1.0 liter | 1.0 liter |
| PH | 5.8–8.0 | 5.8–8.0 |

Each processed sample was measured on the density through a green filter and evaluated on the sensitivity, The sensitivity is defined as a reciprocal of the exposure amount of giving a density 0.2 higher than the fog density. The sensitivity of Samples 11 to 14 is shown by a relative value to Sample 11 of which sensitivity is taken as 100, the sensitivity of Samples 15 to 18 is shown by a relative value to Sample 15 of which sensitivity is taken as 100, and the sensitivity of Samples 19 to 24 is shown by a relative value to Sample 19 of which sensitivity is taken as 100. The emulsion and dye used in each Sample and the sensitivity of each Sample are shown in Table 2.

TABLE 2

| Sample | Dye | Emulsion | Number of Layers Adsorbed | Sensitivity | Remarks |
|---|---|---|---|---|---|
| 11 | (A-24) | A | 0.90 | 100 (control) | Comparison |
| 12 | (E-15) | " | 0.90 | 99 | " |
| 13 | (A-24) + (A-30) + (A-24) | " | 2.05 | 165 | " |
| 14 | (E-15) + (E-19) + (E-15) | " | 2.63 | 240 | Invention |
| 15 | (A-24) | B | 0.91 | 100 (control) | Comparison |
| 16 | (E-15) | " | 0.90 | 100 | " |
| 17 | (A-24) + (A-30) + (A-24) | " | 2.05 | 164 | " |
| 18 | (E-15) + (E-19) + (E-15) | " | 2.75 | 251 | Invention |
| 19 | (A-24) | C | 0.90 | 100 (control) | Comparison |
| 20 | (E-15) | " | 0.90 | 99 | " |
| 21 | (A-24) + (A-30) + (A-24) | " | 2.04 | 164 | " |
| 22 | (E-15) + (E-19) + (E-15) | " | 2.76 | 259 | Invention |
| 23 | (A-24) + (F1-55) + (F-32) | " | 2.72 | 251 | " |
| 24 | (A-24) + (G-10) + (G-9) | " | 2.77 | 262 | " |

It is seen from Table 2 that as compared with Comparative Samples, samples of the present invention have high sensitivity and also that in samples of the present invention, the number of layers adsorbed is increased. As revealed from these, according to the present invention, a high-sensitivity silver halide photographic light-sensitive can be provided.

Samples 19 and 22 were measured on the light absorption intensity of the liquid emulsion, as a result, the light absorption intensity of Comparative Sample 21 was 85, whereas the light absorption intensity of Sample 22 of the present invention was as high as 260.

Furthermore, as seen from comparison of Emulsions A, B and C, the present invention exhibits more excellent performance in the case of using a tabular grain and also in the case of using an emulsion subjected to selenium sensitization. Here, tabular grains having various aspect ratios were prepared in the same manner as Emulsion B by adjusting the silver potential and evaluated in the same manner, as a result, it was found that excellent performance is exhibited when the aspect ratio is 2 or more, particularly 8 or more.

Incidentally, Dye (A-24) had {Agg(Dye X)/Agg(Dye 1)} of 0.64, {log P(Dye X)/log P(Dye 1)} of 0.94 and {J-Agg (Dye X)/J-Agg(Dye 1)} of 0.06, whereas Dye (E-15) had {Agg(Dye X)/Agg(Dye 1)} of 2.58, {log P(Dye X)/log P(Dye 1)} of 5.91 and {J-Agg(Dye X)/J-Agg(Dye 1)} of 137.37, the Dye (F1-55) had {Agg(Dye X)/Agg(Dye 1)} of 2.07, {log P(Dye X)/log P(Dye 1)} of 1.85 and {J-Agg(Dye X)/J-Agg(Dye 1)} of 9.48, the Dye (F-32) had {Agg(Dye X)/Agg(Dye 1)} of 1.25, {log P(Dye X)/log P(Dye 1)} of 6.02 and {J-Agg(Dye X)/J-Agg(Dye 1)} of 21.22.

In the above, the log P value was determined by the method of (a).

Example 2

The same comparison as in Example 1 was performed for the color negative light-sensitive system in Example 1 of JP-A-11-305369, for the color reversal light-sensitive material systems in Example 1 of JP-A-7-92601 and JP-A-11-160828, for the color paper light-sensitive material system in Example 1 of JP-A-6-347944, for the instant light-sensitive material system in Example 1 of JP-A-2000-284442, for the light-sensitive material system for printing in Example 1 of JP-A-8-292512, for the X-ray light-sensitive material system in Example 1 of JP-A-8-122954, and for the heat-developable light-sensitive material systems in Example 5 of JP-A-2000-122206, Example 1 of JP-A-2001-281785 (Japanese Patent Application No. 2000-89436) and Example 1 of JP-A-6-130607. As a result, the same effects as in Example 1 were exhibited.

According to the present invention, a high-sensitivity silver halide photographic light-sensitive material can be obtained.

This application is based on Japanese patent applications JP 2003-053430, filed on Feb. 28, 2003 and JP 2003-414328, filed on Dec. 12, 2003, the entire content of which is hereby incorporated by reference, the same as if set forth at length.

What is claimed is:

1. A silver halide photographic light-sensitive material comprising a silver halide photographic emulsion containing a silver halide grain, wherein the silver halide photographic emulsion includes a dye compound consisting of one chromophore adsorbed in multiple layers on the surface of the silver halide grain, and the chromophore of the dye compound is Dye X satisfying Condition 1 represented by the following formula (1):

$$\{\mathrm{Agg}(\mathrm{Dye}\ X)/\mathrm{Agg}(\mathrm{Dye}\ 1)\} \geqq 1.1$$

wherein Agg(Dye 1) represents an aggregation property of the following Dye 1 and Agg(Dye X) represents an aggregation property of Dye X:

Dye 1:

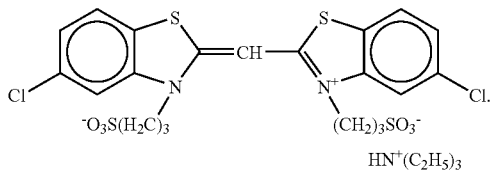

2. A silver halide photographic light-sensitive material comprising a silver halide photographic emulsion containing a silver halide grain, wherein the silver halide photographic emulsion includes a dye compound consisting of one chromophore adsorbed in multiple layers on the surface of the silver halide grain, and the chromophore of the dye compound is Dye X satisfying Condition 2 represented by the following formula (2):

$$\{\log P(\mathrm{Dye}\ X)/\log P(\mathrm{Dye}\ 1)\} \geqq 1.1$$

wherein log P(Dye 1) represents a hydrophilicity/hydrophobicity of the following Dye 1 and log P(Dye X) represents a hydrophilicity/hydrophobicity of Dye X:

Dye 1:

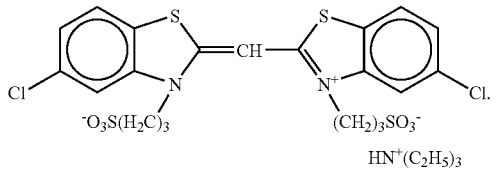

3. A silver halide photographic light-sensitive material comprising a silver halide photographic emulsion containing a silver halide grain, wherein the silver halide photographic emulsion includes a dye compound consisting of one chromophore adsorbed in multiple layers on the surface of the silver halide grain, and the chromophore of the dye compound is Dye X satisfying Condition 3 represented by the following formula (3);

$$\{J\text{-}\mathrm{Agg}(\mathrm{Dye}\ X)/J\text{-}\mathrm{Agg}(\mathrm{Dye}\ 1)\} \geqq 1.1$$

wherein J-Agg(Dye 1) represents a J-aggregation property of the following Dye 1 and J-Agg(Dye X) represents a J-aggregation property of Dye X:

Dye 1:

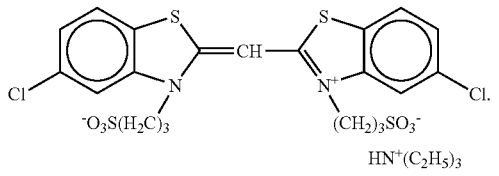

4. A silver halide photographic light-sensitive material comprising a silver halide photographic emulsion containing a silver halide grain, wherein the silver halide photographic emulsion includes a dye compound consisting of one chromophore adsorbed in multiple layers on the surface of the silver halide grain, and the chromophore of the dye compound is Dye X satisfying all of Conditions 1 to 3 represented by the following formulas (1) to (3), respectively:

Condition 1:

$$\{\text{Agg(Dye } X)/\text{Agg(Dye 1)}\} \geqq 1.1 \qquad \text{Formula (1)}$$

wherein Agg(Dye 1) represents an aggregation property of the following Dye 1 and Agg(Dye X) represents an aggregation property of Dye X, Condition 2:

$$\{\log P(\text{Dye } X)/\log P(\text{Dye 1})\} \geqq 1.1 \qquad \text{Formula (2)}$$

wherein log P(Dye 1) represents a hydrophilicity/hydrophobicity of the following Dye 1 and LogP(Dye X) represents a hydrophilicity/hydrophobicity of Dye X, Condition 3:

$$\{J\text{-Agg(Dye } X)J\text{-Agg(Dye 1)}\} \geqq 1.1 \qquad \text{Formula (3)}$$

wherein J-Agg(Dye 1) represents a J-aggregation property of the following Dye 1 and J-Agg(Dye X) represents a J-aggregation property of Dye X:

Dye 1:

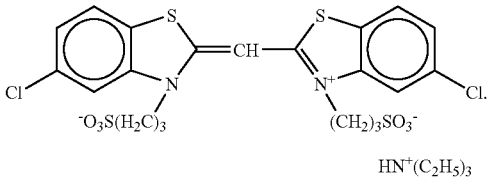

5. The silver halide photographic light-sensitive material as described in claim 1, wherein in the silver halide photographic emulsion, tabular silver halide grains having an aspect ratio of 2 or more occupy 50% (area) or more of all silver halide grains in the emulsion.

6. The silver halide photographic light-sensitive material as described in claim 2, wherein in the silver halide photographic emulsion, tabular silver halide grains having an aspect ratio of 2 or more occupy 50% (area) or more of all silver halide grains in the emulsion.

7. The silver halide photographic light-sensitive material as described in claim 3, wherein in the silver halide photographic emulsion, tabular silver halide grains having an aspect ratio of 2 or more occupy 50% (area) or more of all silver halide grains in the emulsion.

8. The silver halide photographic light-sensitive material as described in claim 4, wherein in the silver halide photographic emulsion, tabular silver halide grains having an aspect ratio of 2 or more occupy 50% (area) or more of all silver halide grains in the emulsion.

9. The silver halide photographic light-sensitive material as described in claim 1, wherein the silver halide photographic emulsion is subjected to a selenium sensitization.

10. The silver halide photographic light-sensitive material as described in claim 2, wherein the silver halide photographic emulsion is subjected to a selenium sensitization.

11. The silver halide photographic light-sensitive material as described in claim 3, wherein the silver halide photographic emulsion is subjected to a selenium sensitization.

12. The silver halide photographic light-sensitive material as described in claim 4, wherein the silver halide photographic emulsion is subjected to a selenium sensitization.

* * * * *